US008273511B2

(12) United States Patent
Nukada et al.

(10) Patent No.: US 8,273,511 B2
(45) Date of Patent: Sep. 25, 2012

(54) ELECTROPHOTOGRAPHIC PHOTORECEPTOR, MANUFACTURING METHOD OF ELECTROPHOTOGRAPHIC PHOTORECEPTOR, PROCESSING CARTRIDGE, AND IMAGE FORMING APPARATUS

(75) Inventors: Katsumi Nukada, Kanagawa (JP); Wataru Yamada, Kanagawa (JP); Takatsugu Doi, Kanagawa (JP); Hitoshi Takimoto, Kanagawa (JP); Akira Hirano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 671 days.

(21) Appl. No.: 12/431,514

(22) Filed: Apr. 28, 2009

(65) Prior Publication Data

US 2010/0167193 A1 Jul. 1, 2010

(30) Foreign Application Priority Data

Dec. 25, 2008 (JP) ..... 2008-331461
Dec. 26, 2008 (JP) ..... 2008-335004

(51) Int. Cl.
*G03G 5/147* (2006.01)

(52) U.S. Cl. ..... 430/58.65; 430/66

(58) Field of Classification Search ..... 430/58.65, 430/66

See application file for complete search history.

(56) References Cited

U.S. PATENT DOCUMENTS 5,283,145 A 2/1994 Nukada et al.
5,290,928 A 3/1994 Nukada et al.
5,298,617 A 3/1994 Nukada et al.
5,302,479 A 4/1994 Daimon et al.
5,308,728 A 5/1994 Imai et al.
5,338,636 A 8/1994 Nukada et al.
5,358,813 A 10/1994 Iijima et al.
5,378,569 A 1/1995 Nukada et al.
5,393,629 A 2/1995 Nukada et al.
5,411,827 A 5/1995 Tamura et al.
5,416,207 A 5/1995 Imai et al.
5,427,880 A 6/1995 Tamura et al.
5,456,989 A 10/1995 Nogami et al.
5,459,004 A 10/1995 Daimon et al.
5,463,043 A 10/1995 Nukada et al.
5,496,671 A 3/1996 Tamura et al.
5,639,581 A 6/1997 Iwasaki et al.
5,654,119 A 8/1997 Ishii et al.
5,695,898 A 12/1997 Go et al.
5,734,003 A 3/1998 Iwasaki et al.

(Continued)

FOREIGN PATENT DOCUMENTS

EP 1 734 411 A1 12/2006

(Continued)

OTHER PUBLICATIONS

Machine English language translation of JP 2008262232, Oct. 2008.*

(Continued)

*Primary Examiner* — Hoa V Le
(74) *Attorney, Agent, or Firm* — Oliff & Berridge, PLC

(57) ABSTRACT

The invention provides an electrophotographic photoreceptor having comprising at least an electrically conductive substrate and a photo-sensitive layer provided on the conductive substrate, the outermost layer is being a cured film of comprising a composition containing at least one compound (a) having a triphenylamine structure and four or more methacryloyl groups in one and the same molecule.

16 Claims, 14 Drawing Sheets

U.S. PATENT DOCUMENTS

| | | | |
|---|---|---|---|
| 6,416,915 | B1 | 7/2002 | Kikuchi et al. |
| 2002/0119382 | A1 | 8/2002 | Nakata et al. |
| 2004/0043312 | A1 | 3/2004 | Kikuchi et al. |
| 2004/0248024 | A1 | 12/2004 | Suzuki et al. |
| 2004/0253527 | A1 | 12/2004 | Suzuki et al. |
| 2005/0158641 | A1 | 7/2005 | Yanagawa et al. |
| 2005/0181292 | A1 | 8/2005 | Fujii et al. |
| 2005/0287452 | A1 | 12/2005 | Tamura et al. |
| 2007/0122724 | A1 | 5/2007 | Suzuki et al. |
| 2007/0154828 | A1 | 7/2007 | Fujii et al. |
| 2007/0178400 | A1 | 8/2007 | Kikuchi et al. |
| 2008/0020305 | A1 | 1/2008 | Suzuki et al. |
| 2008/0310897 | A1 | 12/2008 | Naruse et al. |

FOREIGN PATENT DOCUMENTS

| | | | |
|---|---|---|---|
| EP | 1 847 881 | A2 | 10/2007 |
| JP | A-62-251757 | | 11/1987 |
| JP | A-04-189873 | | 7/1992 |
| JP | A-05-040360 | | 2/1993 |
| JP | A-05-098181 | | 4/1993 |
| JP | A-05-140472 | | 6/1993 |
| JP | A-05-140473 | | 6/1993 |
| JP | A-05-216249 | | 8/1993 |
| JP | A-05-263007 | | 10/1993 |
| JP | A-05-279591 | | 10/1993 |
| JP | A-05-323630 | | 12/1993 |
| JP | A-07-072640 | | 3/1995 |
| JP | A-07-146564 | | 6/1995 |
| JP | A-08-176293 | | 7/1996 |
| JP | A-08-208820 | | 8/1996 |
| JP | A-11-052603 | | 2/1999 |
| JP | A-2000-019749 | | 1/2000 |
| JP | A-2000-206715 | | 7/2000 |
| JP | A-2000-206717 | | 7/2000 |
| JP | A-2000-264961 | | 9/2000 |
| JP | A-2001-125297 | | 5/2001 |
| JP | A-2001-166510 | | 6/2001 |
| JP | A-2001-175016 | | 6/2001 |
| JP | A-2002-082469 | | 3/2002 |
| JP | B2-3287678 | | 6/2002 |
| JP | A-2004-012986 | | 1/2004 |
| JP | A-2004-078147 | | 3/2004 |
| JP | A-2004-302450 | | 10/2004 |
| JP | A-2005-181992 | | 7/2005 |
| JP | A-2006-010963 | | 1/2006 |
| JP | A-2006-084711 | | 3/2006 |
| JP | A-2007-086522 | | 4/2007 |
| JP | A-2008-233118 | | 10/2008 |
| JP | A-2008-262232 | | 10/2008 |
| JP | A-2008-292574 | | 12/2008 |
| JP | A-2008-309902 | | 12/2008 |

OTHER PUBLICATIONS

Apr. 28, 2010 Search Report issued in European Patent Application No. 09163243.0.

Office Action issued in Japanese Patent Application No. 2008-335004 dated Nov. 16, 2010 (with translation).

* cited by examiner

ELECTROPHOTOGRAPHIC PHOTORECEPTOR, MANUFACTURING METHOD OF ELECTROPHOTOGRAPHIC PHOTORECEPTOR, PROCESSING CARTRIDGE, AND IMAGE FORMING APPARATUS

CROSS-REFERENCE TO RELATED APPLICATIONS

This application is based on and claims priority under 35 USC 119 from Japanese Patent Application No. 2008-331461 filed on Dec. 25, 2008 and No. 2008-335004 filed on Dec. 26, 2008.

BACKGROUND

1. Technical Field

The present invention relates to an electrophotographic photoreceptor, a manufacturing method of the electrophotographic photoreceptor, a processing cartridge, and an image forming apparatus.

2. Related Art

Generally, an electrophotographic image forming apparatus has the following structure and processes. Specifically, the surface of an electrophotographic photoreceptor is uniformly charged by a charging means to desired polarity and potential, and the charged surface of the electrophotographic photoreceptor is selectively removed of charge by subjecting to image-wise exposure to form an electrostatic latent image. The latent image is then developed into a toner image by attaching a toner to the electrostatic latent image by a developing means, and the toner image is transferred to an image-receiving medium by a transfer means, then the image-receiving medium is discharged as an image formed material.

Electrophotographic photoreceptors are currently been widely used in the field of copying machines, laser beam printers and other apparatus due to advantages of high speed and high printing quality. As electrophotographic photoreceptors used in image forming apparatus, organic photoreceptors using organic photoconductive materials are mainly used which are superior in cost efficiency, manufacturability and disposability, compared to conventionally used electrophotographic photoreceptors using inorganic photoconductive materials such as selenium, selenium-tellurium alloy, selenium-arsenic alloy and cadmium sulfide.

As a charging method, a corona charging method utilizing a corona charging device has been conventionally used. However, a contact charging method having advantages such as low ozone production and low electricity consumption has recently been put into practical used and is widely used. In the contact charging method, the surface of a photoreceptor is charged by bringing a conductive member as a charging member into contact with, or in close proximity to, the surface of the photoreceptor, and applying a voltage to the charging member. There are two methods of applying a voltage to the charging member: a direct current method in which only a direct current voltage is applied, and an alternating current superimposition method in which a direct current voltage superimposed by an alternating current voltage is applied. The contact charging method has advantages of downsizing the apparatus and suppressing generation of harmful gases such as ozone.

As a transfer method, a method of transferring directly to a paper has conventionally been the mainstream. However, a method of transferring to a paper via an intermediate transfer body, in which a wider variety of paper can be used, is currently frequently used.

SUMMARY

According to an aspect of the invention, there is provided an electrophotographic photoreceptor having comprising at least an electrically conductive substrate and a photo-sensitive layer provided on the conductive substrate, the outermost layer is being a cured film of comprising a composition containing at least one compound (a) having a triphenylamine structure and four or more methacryloyl groups in one and the same molecule.

BRIEF DESCRIPTION OF THE DRAWINGS

Exemplary embodiments of the invention will be described in detail based on the following figures, wherein.

DETAILED DESCRIPTION

[Electrophotographic Photoreceptor]

Figure 1:
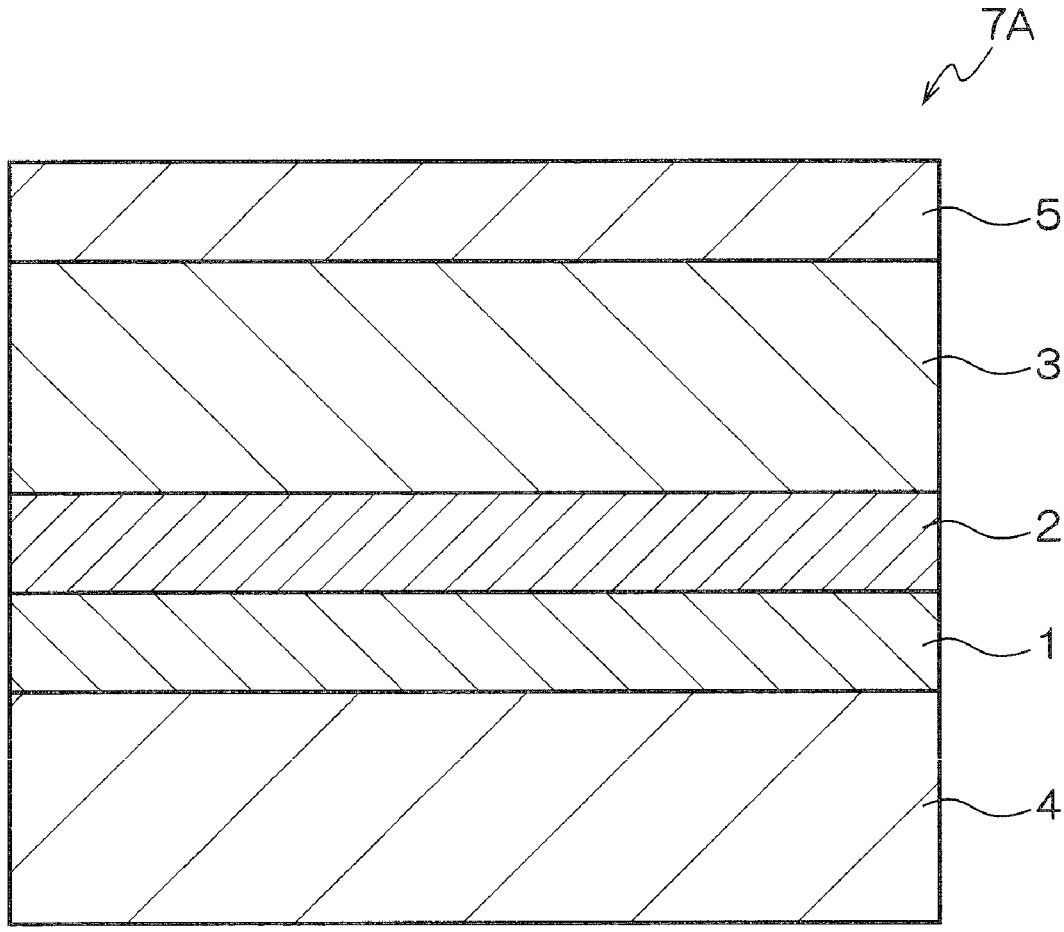
FIG. 1 is a schematic partial cross sectional drawing showing the electrophotographic photoreceptor concerning an aspect of the invention.

The electrophotographic photoreceptor according to an exemplary embodiment of an aspect (hereinafter also referred to as "this embodiment") is an electrophotographic photoreceptor having at least an electrically conductive substrate and a photo-sensitive layer provided on the conductive substrate, wherein the outermost layer is a cured film of a composition containing at least one compound (a) having a triphenylamine structure and four or more methacryloyl groups in one and the same molecule.

Hereinafter, the compounds (a) having a triphenylamine structure and four or more methacryloyl groups in one and the same molecule are properly called as specific charge transporting materials (a).

In the electrophotographic photoreceptor according to this embodiment, by taking the above constitution, the outermost layer having high mechanical strength, and stable electric characteristics and image properties can be obtained even by repeated use for long.

The mechanism exhibiting the above advantages is not necessarily clearly known but it is presumed as follows.

In the first places the specific charge transporting materials (a) for use in the invention are characterized in that they have methacryloyl groups in the molecule. In general, highly reactive acryl groups are used in curing reaction in many cases, but if highly reactive acryl groups are used as the substituents in a bulky charge transporting structure such as a triphenylamine structure, it is thought that heterogeneous curing reaction tends to occur and a microscopic (or macroscopic) sea-island structure is liable to be generated. Such a sea-island structure hardly causes particular problems in the fields other than the electronic field. However, when a sea-island structure is used in an electrophotographic photoreceptor, unevenness and wrinkles are easily generated on the outermost layer and the parts different in charge transportability are macroscopically generated, which results in the problem of image unevenness and the like. Incidentally, it is thought that the formation of such a sea-island structure is especially conspicuous when a plurality of functional groups are attached to one charge transporting structure (a triphenylamine structure).

Since the formation of the above sea-island structure can be restrained when the specific charge transporting materials (a) have methacryloyl groups, it is thought that the electrophotographic photoreceptor having the outermost layer comprising a cured film of the composition containing the specific charge transporting materials (a) can stably obtain electric characteristics and image properties.

Further, since the specific charge transporting materials (a) have four methacryloyl groups in the molecule, a cured film having high crosslinking density can be obtained and an outermost layer having sufficient mechanical strength can be formed by using it.

Further, since a highly viscous composition can be obtained from the specific charge transporting materials (a) for its structure, volume shrinkage is difficult to occur in obtaining a cured film by using the composition, and so an outermost layer having an excellent surface property can be obtained.

In addition, because an outermost layer having high crosslinking density and sufficient mechanical strength can be formed by the use of the specific charge transporting materials (a) as described above, it is not always necessary to add a polyfunctional monomer not having charge transportability, and thickening of an outermost layer can be achieved without causing the reduction of electric characteristics due to the addition of a polyfunctional monomer. As a result, the electrophotographic photoreceptor having the outermost layer can prolong the duration of life and withstands use for long.

The electrophotographic photoreceptor in this embodiment has, as described above, an outermost layer comprising a cured film of the composition containing at least one of specific charge transporting materials (a). It is sufficient for the outermost layer to form the top surface of the electrophotographic photoreceptor itself, and the outermost layer is provided as a layer functioning as a protective layer or a layer functioning as a charge-transporting layer.

Further, when the outermost layer is a layer functioning as a protective layer, it follows that the protective layer has lower layers such as a photosensitive layer comprising a charge-transporting layer and a charge-generating layer, or a monolayer type photosensitive layer (a charge-generating/charge-transporting layer).

When the outermost layer is a layer functioning as a protective layer, the form consisting of a conductive substrate having thereon a photosensitive layer and a protective layer as the outermost layer, wherein the protective layer comprises a cured film of a composition containing at least one of specific charge transporting materials (a) can be exemplified.

On the other hand, when the outermost layer is a layer functioning as a charge-transporting layer, the form consisting of a conductive substrate having thereon a charge-generating layer and a charge transporting layer as the outermost layer, wherein the charge transporting layer comprises a cured film of a composition containing at least one of specific charge transporting materials (a) can be exemplified.

The electrophotographic photoreceptor of this embodiment in the case where the outermost layer is a layer that functions as a protective layer will be described in detail below with reference to the accompanying figures. Incidentally, in the figures, the same or corresponding parts are attached with the same signs and duplicating explanations are omitted.

Figure 2:
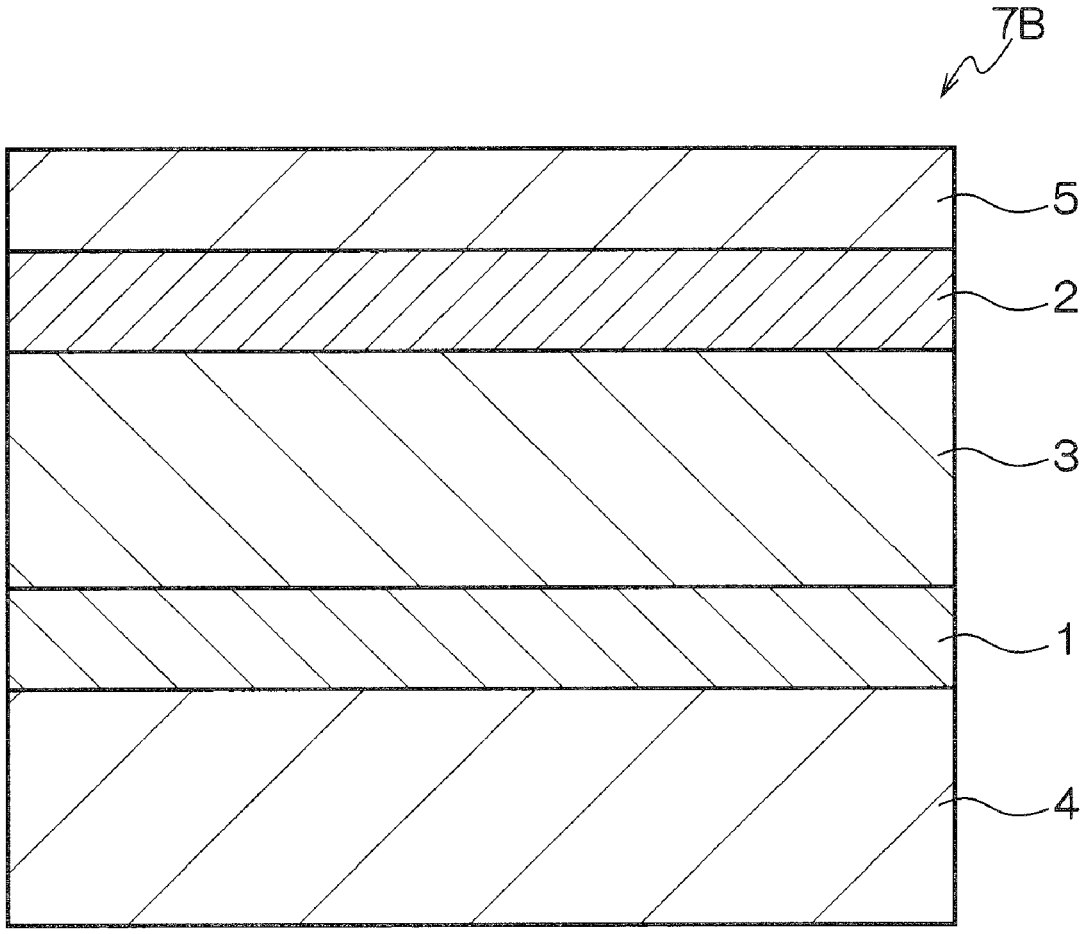
FIG. 2 is a schematic partial cross sectional drawing showing the electrophotographic photoreceptor concerning an aspect of the invention.
Figure 3:
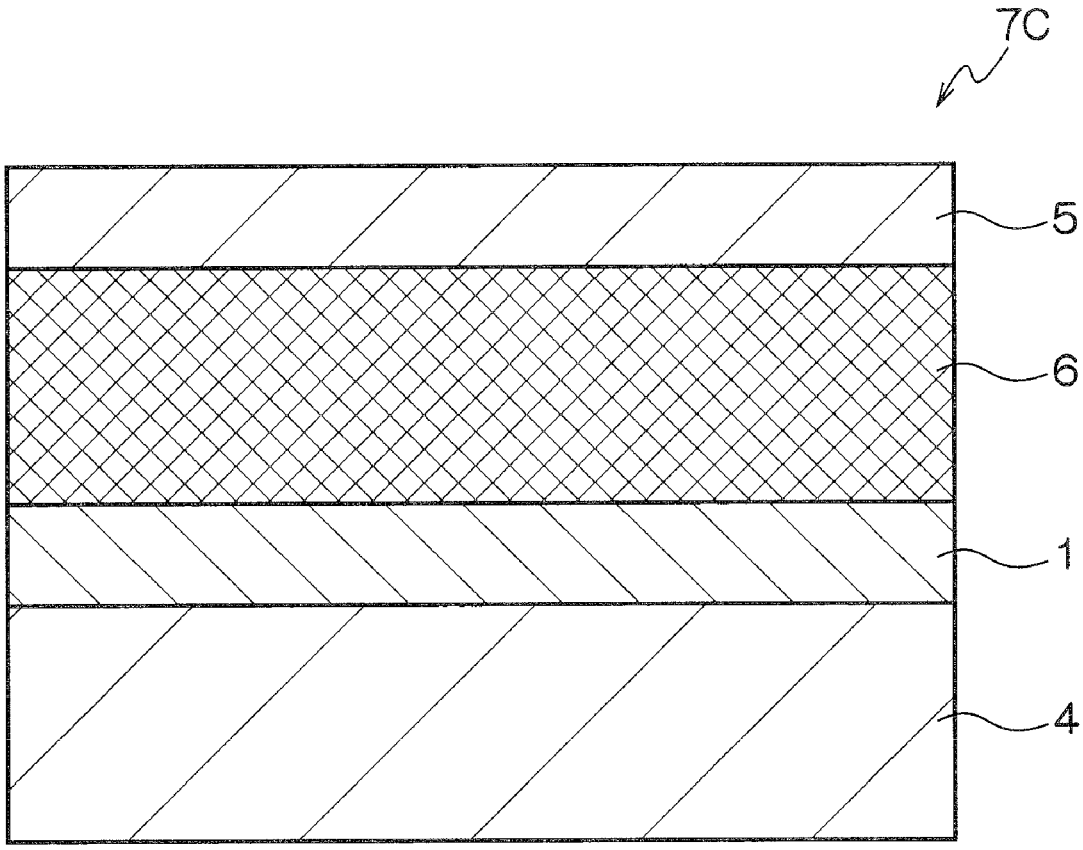
FIG. 3 is a schematic partial cross sectional drawing showing the electrophotographic photoreceptor concerning an aspect of the invention.

FIG. 1 is a typical cross sectional drawing showing a preferred embodiment of the electrophotographic photoreceptor of this embodiment. FIGS. 2 and 3 are typical cross sectional drawings of the electrophotographic photoreceptors of other embodiments.

Electrophotographic photoreceptor 7A shown in FIG. 1 is what is called a function separating type photoreceptor (or a lamination type photoreceptor) having a structure comprising conductive substrate 4 having thereon undercoating layer 1, and having formed thereon charge-generating layer 2, charge transporting layer 3, and protective layer 5 in order. In electrophotographic photoreceptor 7A, a photosensitive layer is comprised of charge generating layer 2 and charge transporting layer 3.

Electrophotographic photoreceptor 7B shown in FIG. 2 is a function separating type photoreceptor similar to electrophotographic photoreceptor 7A shown in FIG. 1, wherein the functions are separated to charge generating layer 2 and charge transporting layer 3. Electrophotographic photoreceptor 7C shown in FIG. 3 is a photoreceptor containing a charge generating material and a charge transporting material in the same layer [monolayer type photosensitive layer 6 (a charge-generating/charge-transporting layer)].

Electrophotographic photoreceptor 7B shown in FIG. 2 has a structure comprising conductive substrate 4 having thereon undercoating layer 1, and having formed thereon charge transporting layer 3, charge generating layer 2, and protective layer 5 in order. In electrophotographic photoreceptor 7B, a photosensitive layer is comprised of charge transporting layer 3 and charge generating layer 2.

Electrophotographic photoreceptor 7C shown in FIG. 3 has a structure comprising conductive substrate 4 having thereon undercoating layer 1 and having formed thereon monolayer type photosensitive layer 6 and protective layer 5 in order.

In electrophotographic photoreceptors 7A to 7C shown in FIGS. 1 to 3, protective layer 5 is the outermost layer arranged farthest from conductive substrate 4, and the outermost layer has the prescribed structure.

In the electrophotographic photoreceptors shown in FIGS. 1 to 3, undercoating layer 1 may be provided or may not be provided.

Each element will be explained below based on electrophotographic photoreceptor 7A shown in FIG. 1 as a representative example.

<Protective Layer>

Protective layer 5 that is the outermost layer in electrophotographic photoreceptor 7A is described first.

Protective layer 5 is the outermost layer in electro-photographic photoreceptor 7A, which is comprised of a cured film of a composition containing at least one of specific charge transporting materials (a).

Specific charge transporting materials (a) will be described below.

(Specific Charge Transporting Materials (a))

Specific charge transporting materials (a) for use in protective layer (outermost layer) 5 are compounds having a triphenylamine structure and four or more methacryloyl groups in one and the same molecule, and any compound can be used so long as the above structural condition is satisfied, but such a structure that one or more carbon atoms intervene between the triphenylamine structure and the methacryloyl group is preferred. That is to say, it is a preferred embodiment for the specific charge transporting materials (a) to have, as a linking group, a carbon chain containing one or more carbon atoms between the triphenylamine structure and the methacryloyl group. It is most preferred that the linking group is an alkylene group.

The reason that the above embodiment is preferred is not necessarily clearly known, but it is presumably due to the following reason.

That is, if electron-attractive methacryloyl groups are present too near to a charge transporting structure (a triphenylamine structure), density of electric charge of the charge transporting structure lowers and ionization potential rises, so that there are cases where injection of carriers from the lower layer does not smoothly advance. Further, when radical polymerizable substituents such as methacryloyl groups are polymerized, if radicals generating at the time of polymerization have a structure easily movable to the charge transporting structure, the generated radicals deteriorate the charge transporting function, which presumably causes degradation of electric characteristics. In addition, in connection with mechanical strength in the outermost layer, when a bulky charge transporting structure and polymerization sites (methacryloyl groups) are near and rigid, the polymerization sites are mutually difficult to move and there is presumably the possibility that probability of reaction lowers.

From these facts, a structure such that a flexible carbon chain intervenes between the triphenylamine structure and the methacryloyl group is preferred.

In such specific charge transporting materials (a) of preferred embodiment, since the molecular weight of the molecule itself increases and the center of gravity becomes difficult to move and the degree of freedom of methacryloyl group is high, an outermost layer obtained with the materials is excellent in electric characteristics and has very high strength.

Further, specific charge transporting materials (a) have an advantage from the structural point of view such that the stability of compounds in synthesis can be secured and production in an industrial scale is possible.

In this embodiment, specific charge transporting materials (a) are preferably compounds represented by the following formula (A) in view of being excellent in charge transportability.

(A)

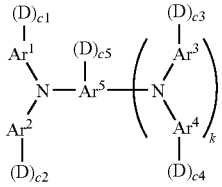

In formula (A), each of $Ar^1$, $Ar^2$, $Ar^3$ and $Ar^4$ independently represents a substituted or unsubstituted aryl group; $Ar^5$ represents a substituted or unsubstituted aryl group or a substituted or unsubstituted arylene group; D represents $—(CH_2)_d—(O—CH_2—CH_2)_e—O—CO—C(CH_3)=CH_2$; each of c1, c2, c3, c4 and c5 independently represents 1 or 2; k represents 0 or 1; d represents an integer of 1 to 5; e represents 0 or 1; and the total number of D is 4 or more.

In formula (A), each of $Ar^1$, $Ar^2$, $Ar^3$ and $Ar^4$ independently represents a substituted or unsubstituted aryl group. Each of $Ar^1$, $Ar^2$, $Ar^3$ and $Ar^4$ may be the same or different.

As the substituents of the substituted aryl group other than D: $—(CH_2)_d—(O—CH_2—CH_2)_e—O—CO—C(CH_3)=CH_2$, an alkyl group and an alkoxy group each having 1 to 4 carbon atoms, and a substituted or unsubstituted aryl group having 6 to 10 carbon atoms are exemplified.

$Ar^1$ to $Ar^4$ are preferably any of the following formulae (1) to (7). In formulae (1) to (7), "$-(D)_{c1}$" to "$-(D)_{c4}$" capable of bonding to each of $Ar^1$ to $Ar^4$ are generally shown as "$-(D)_c$".

(1)

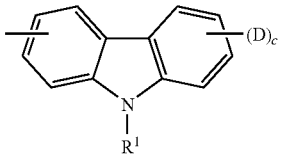

(2)

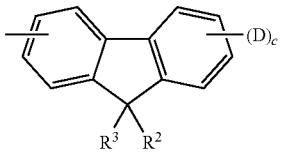

(3)

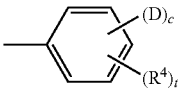

(4)

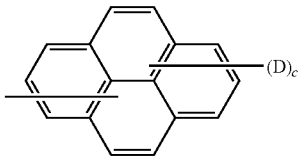

(5)

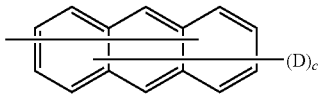

-continued (6)

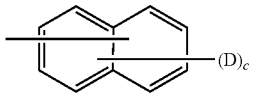

(7)

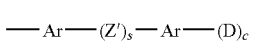

In formulae (1) to (7), $R^1$ represents the one selected from the group consisting of a hydrogen atom, an alkyl group having 1 to 4 carbon atoms, a phenyl group substituted with an alkyl group having 1 to 4 carbon atoms or an alkoxy group having 1 to 4 carbon atoms, an unsubstituted phenyl group, and an aralkyl group having 7 to 10 carbon atoms; each of $R^2$, $R^3$ and $R^4$ independently represents the one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; Ar represents a substituted or unsubstituted arylene group; D represents $—(CH_2)_d—(O—CH_2—CH_2)_e—O—CO—C(CH_3)=CH_2$; c represents 1 or 2; s represents 0 or 1; and t represents an integer of 0 to 3.

Here, Ar in formula (7) is preferably represented by the following formula (8) or (9).

(8)

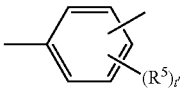

(9)

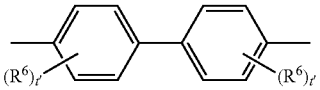

In formulae (8) and (9), each of $R^5$ and $R^6$ independently represents the one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; and each t' represents an integer of 0 to 3.

In formula (7), Z' represents a divalent organic linking group, and preferably represented by any of the following formulae (10) to (17); and s represents 0 or 1.

(10)

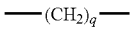

(11)

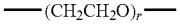

(12)

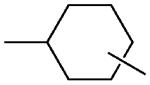

(13)

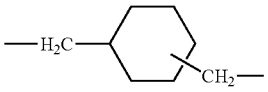

-continued (14)

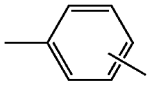

(15)

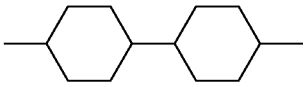

(16)

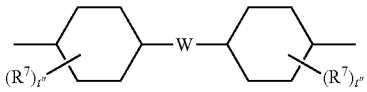

(17)

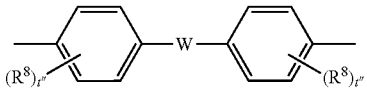

In formulae (10) to (17), each of $R^7$ and $R^8$ independently represents the one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; W represents a divalent group; each of q and r independently represents an integer of 1 to 10; and each of t" represents an integer of 0 to 3.

W in formulae (16) and (17) is preferably any of divalent groups represented by the following formulae (18) to (26). In formula (25), u represents an integer of o to 3.

(18)

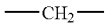

(19)

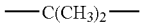

(20)

(21)

(22)

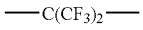

(23)

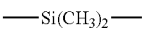

(24)

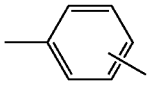

(25)

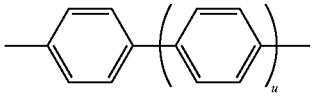

(26)

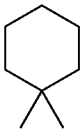

In formula (A), $Ar^5$ represents a substituted or unsubstituted aryl group when k is 0. As the aryl group, the same aryl groups shown in the description of $Ar^1$ to $Ar^4$ are exemplified. $Ar^5$ represents a substituted or unsubstituted arylene group when k is 1, and as the arylene group, arylene groups obtained by subtracting one hydrogen atom at a prescribed position from the aryl groups shown in the description of $Ar^1$ to $Ar^4$ are exemplified.

The specific examples of the compounds represented by formula (A) are shown below. However, the compounds represented by formula (A) are by no means restricted thereto.

No.
A-1
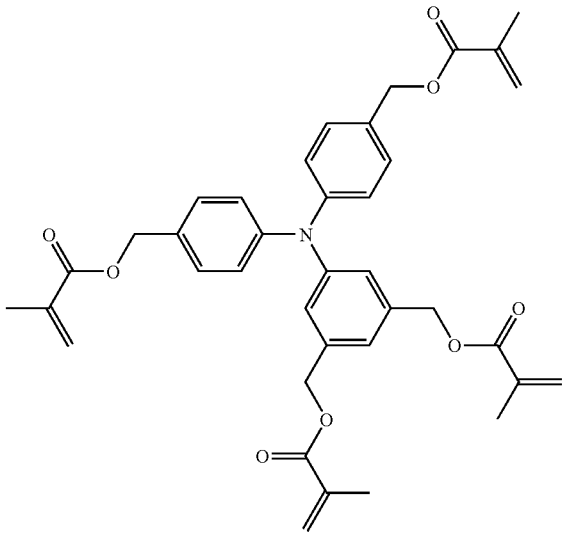
A-2
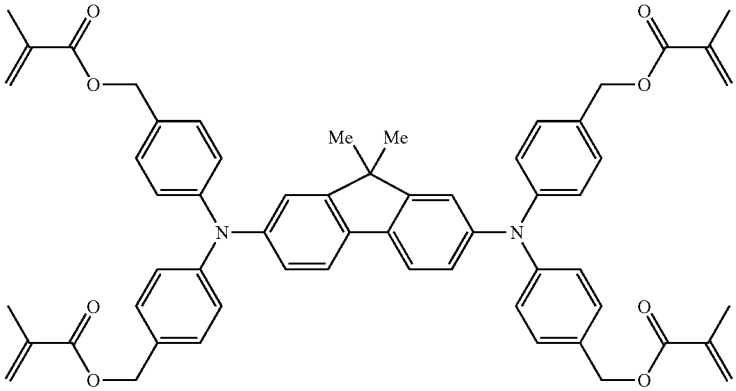
A-3
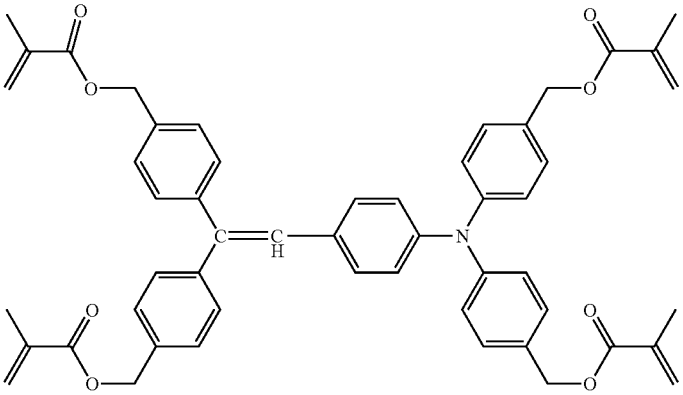

-continued
| No. | |
|---|---|
| A-4 | 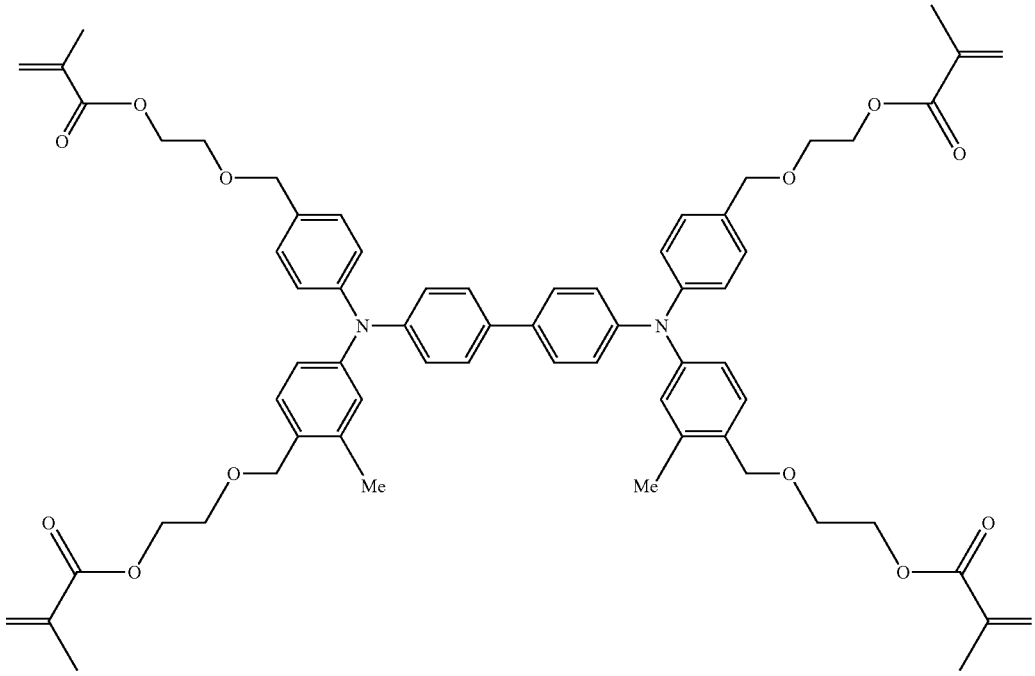 |
| A-5 | 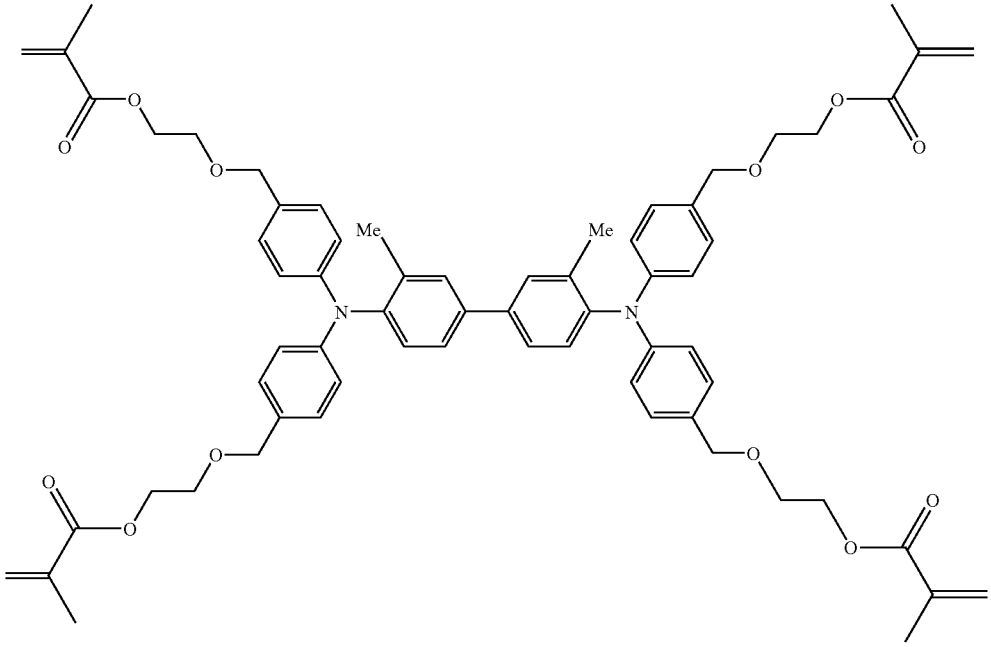 |

-continued
No.
A-6
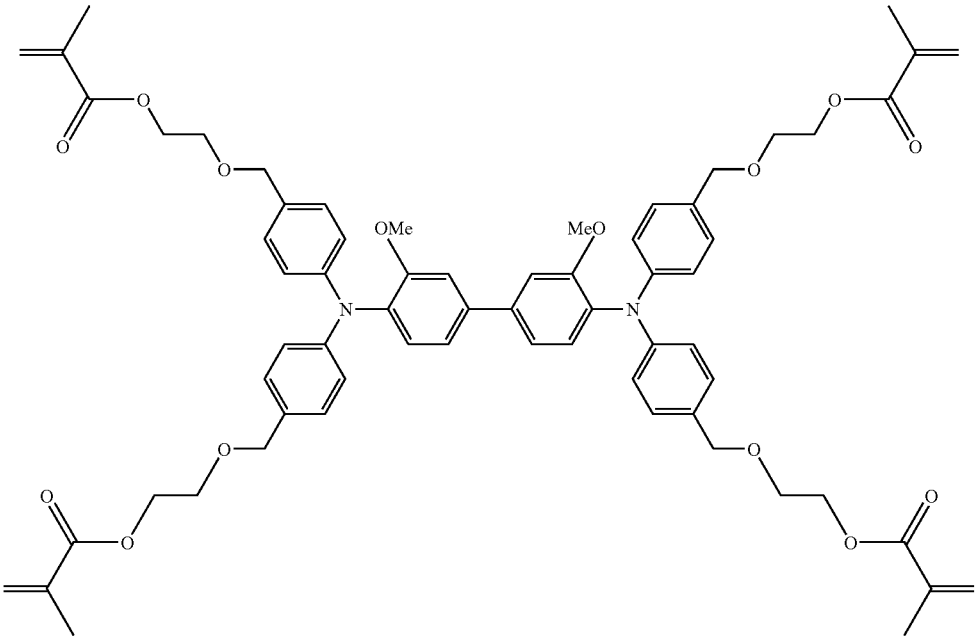
A-7
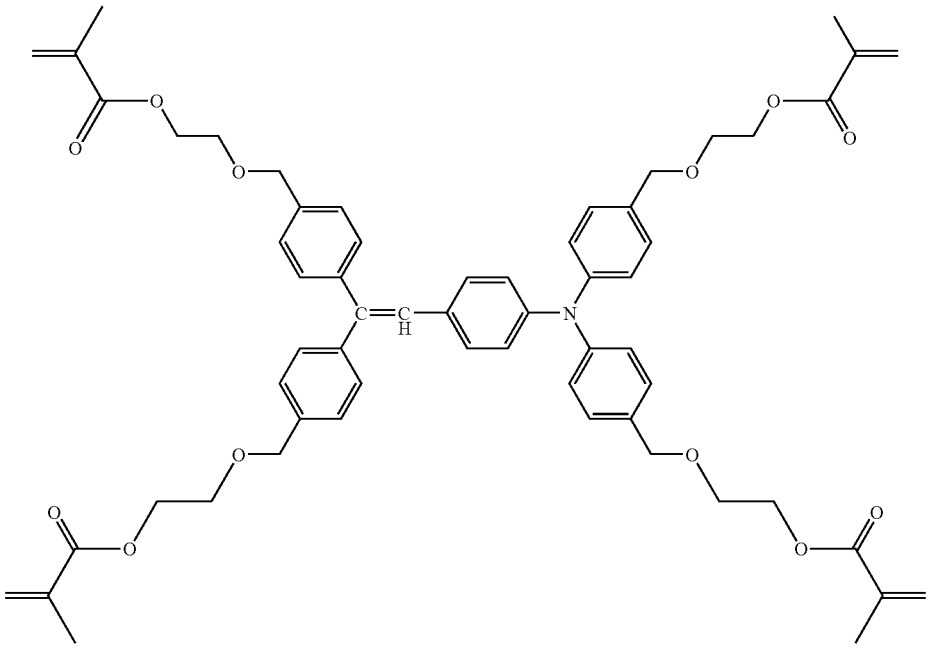

-continued
| No. | |
|---|---|
| A-8 | 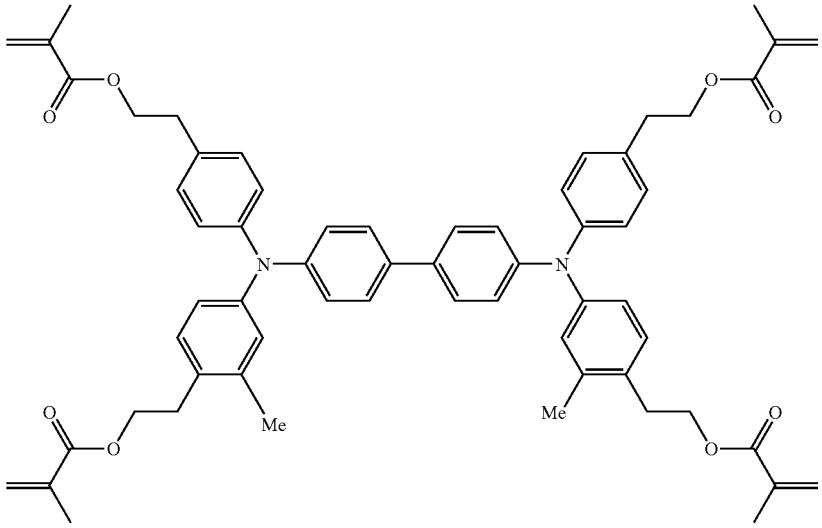 |
| A-9 | 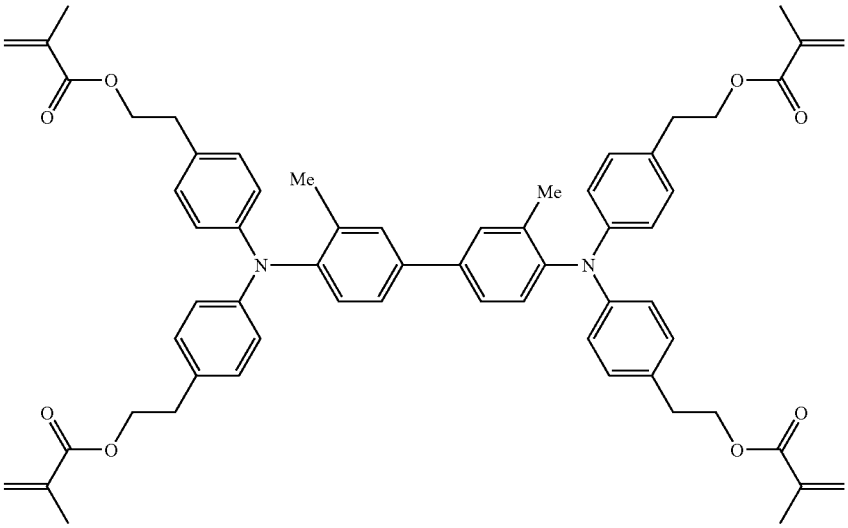 |
| A-10 | 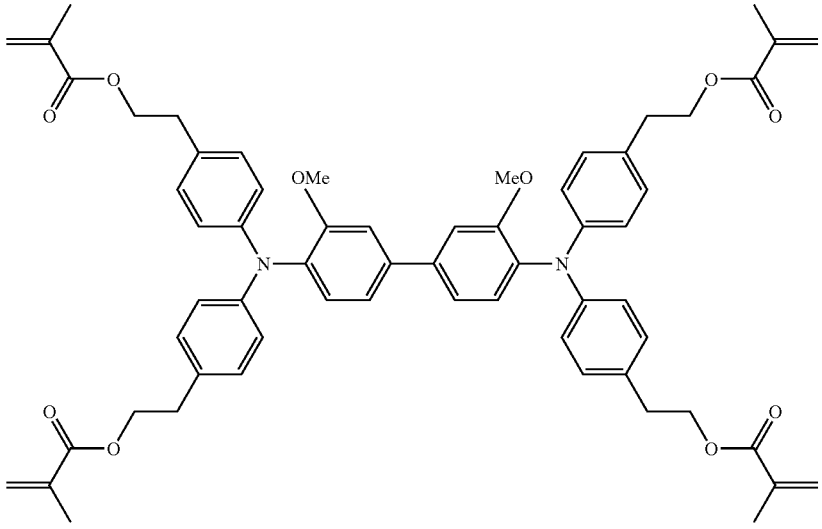 |

-continued
No.
A-11
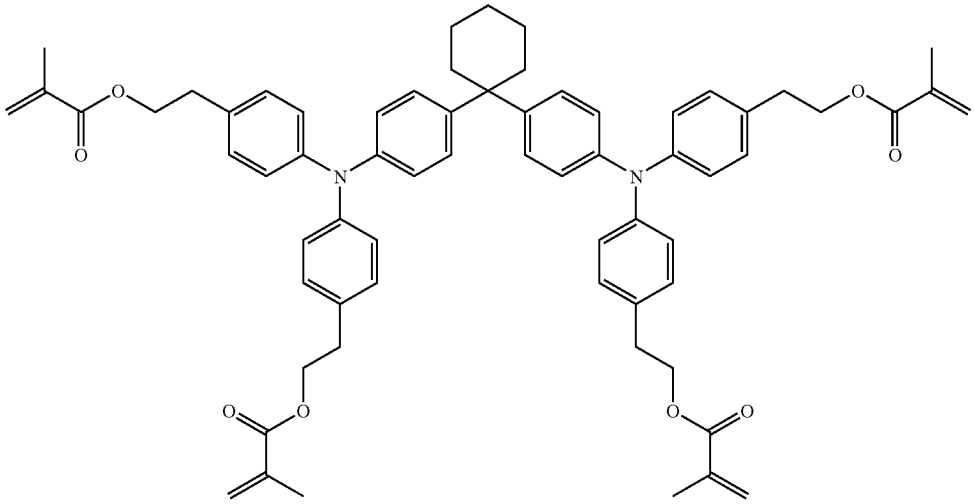
A-12
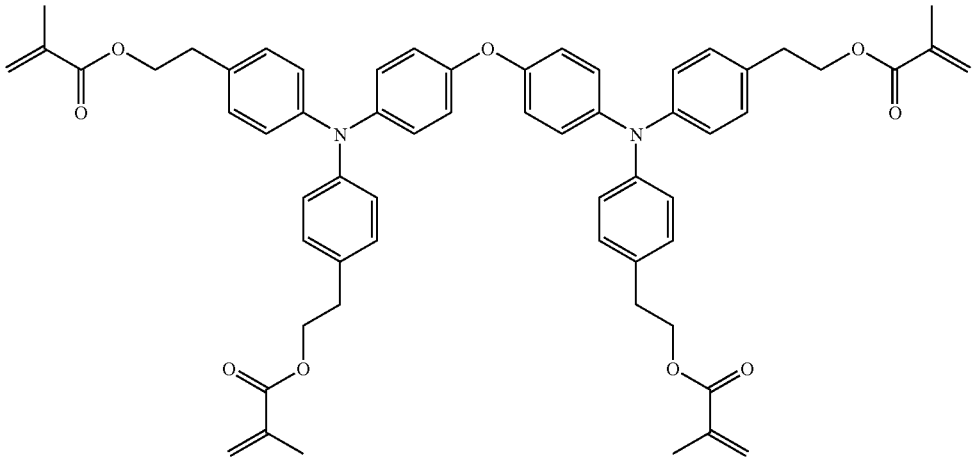
A-13
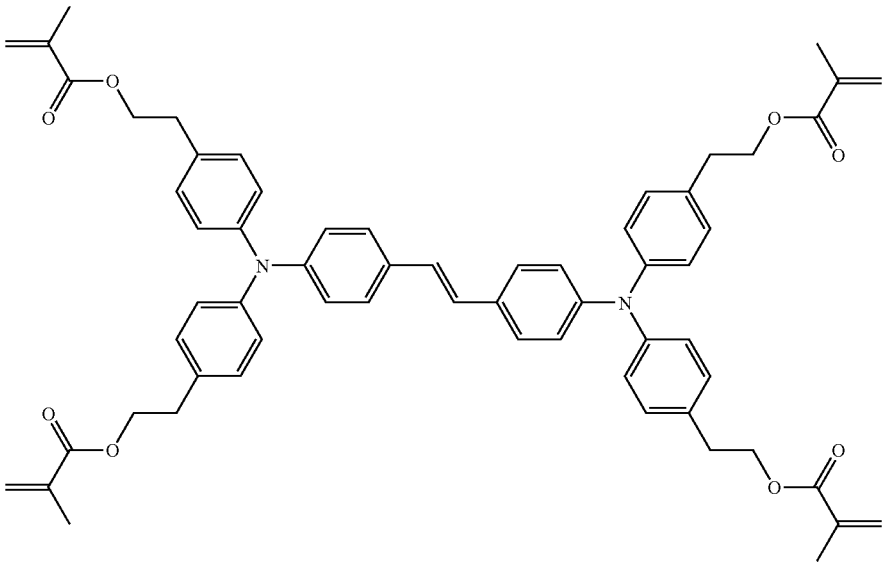

-continued
| No. | |
|---|---|
| A-14 | 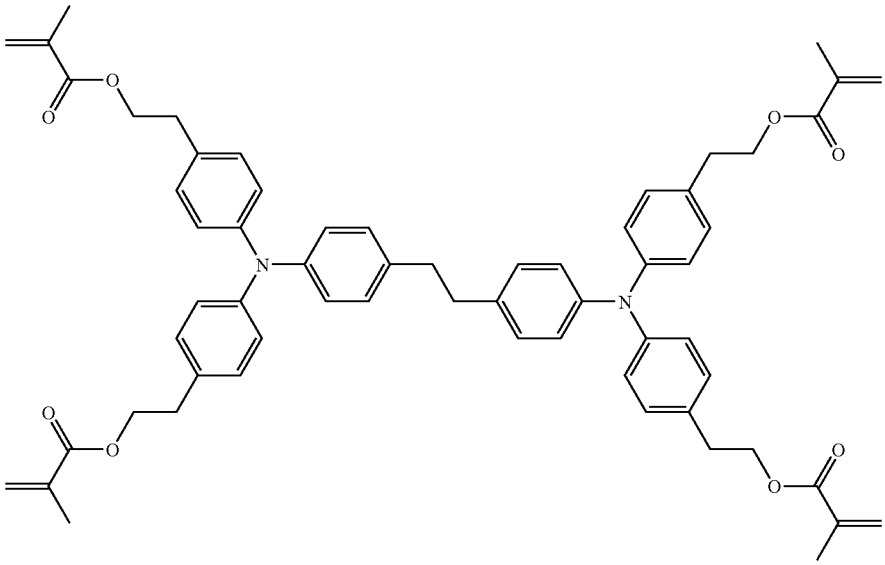 |
| A-15 | 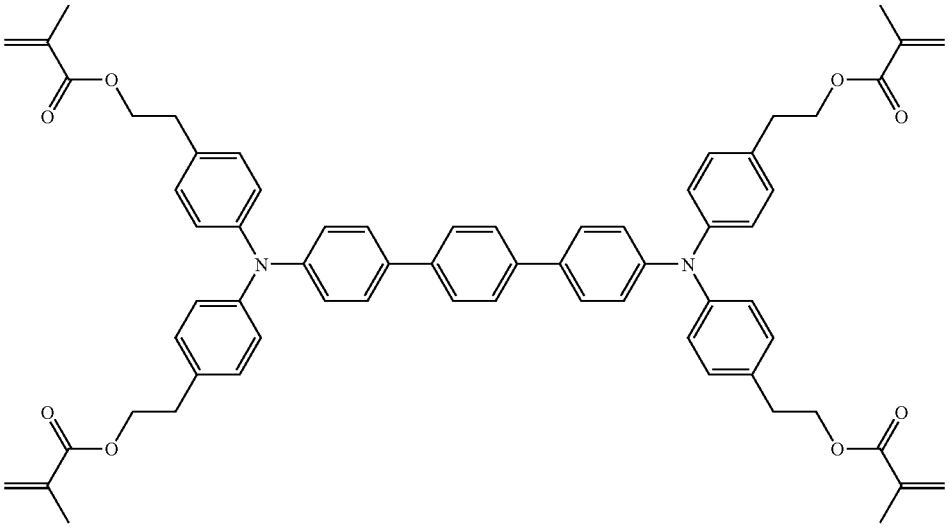 |

-continued
| No. | |
|---|---|
| A-16 | 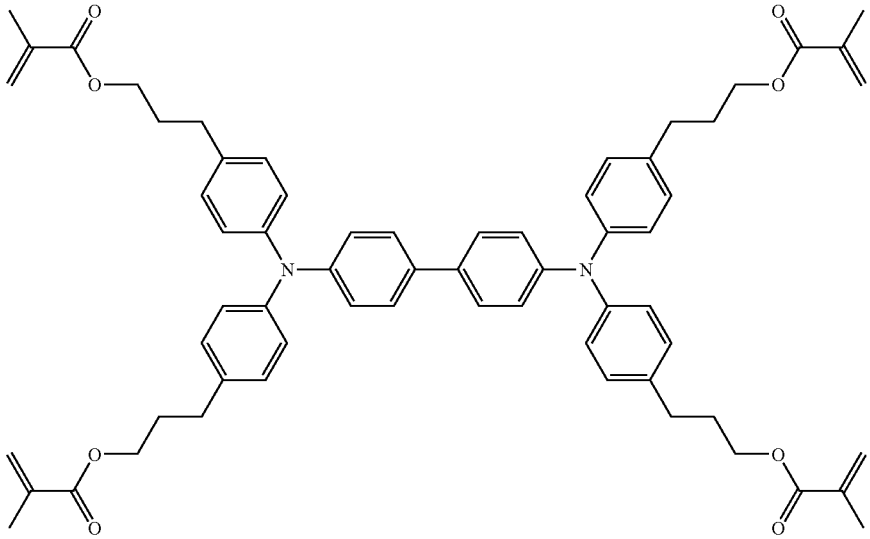 |
| A-17 | 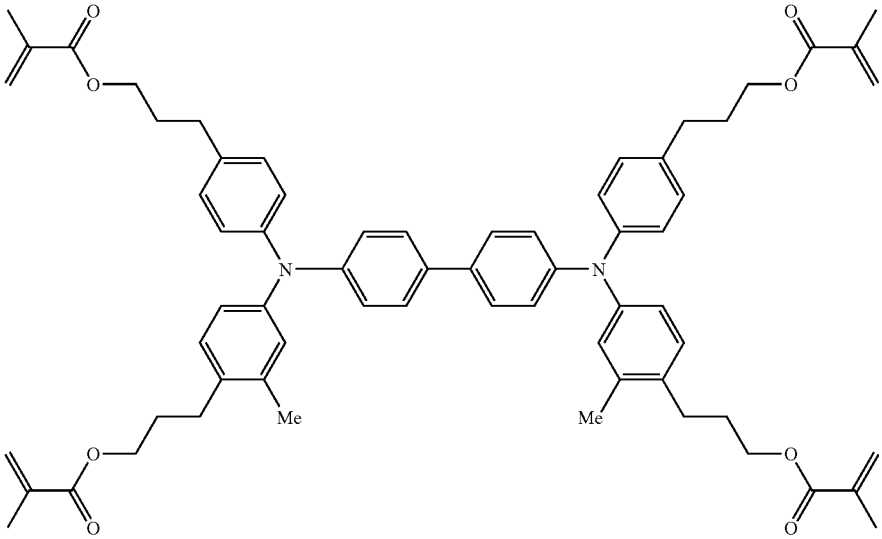 |
| A-18 | 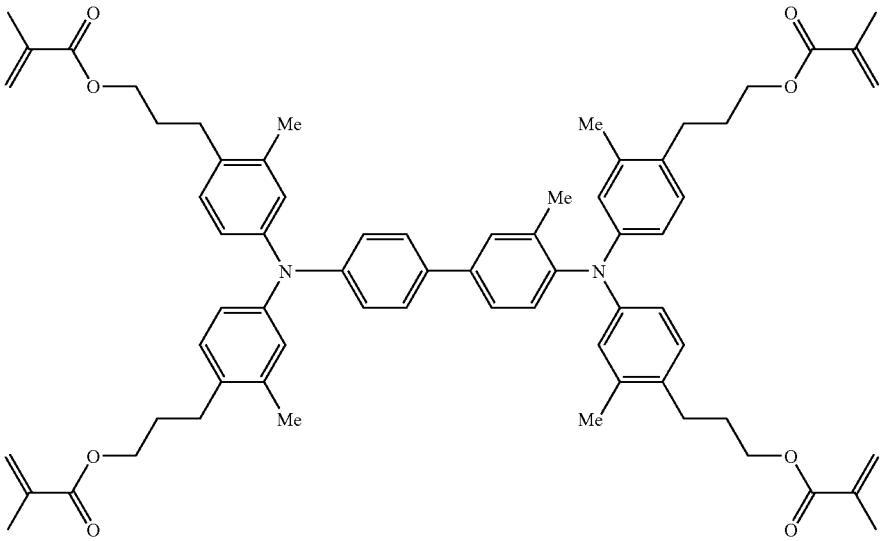 |

-continued
No.
A-19
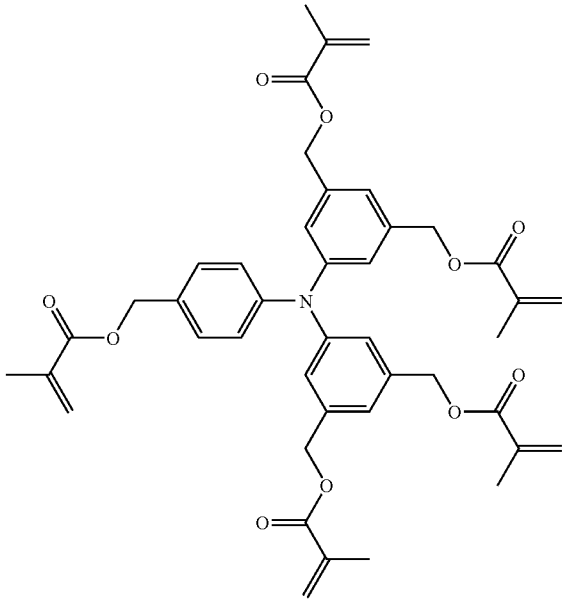
A-20
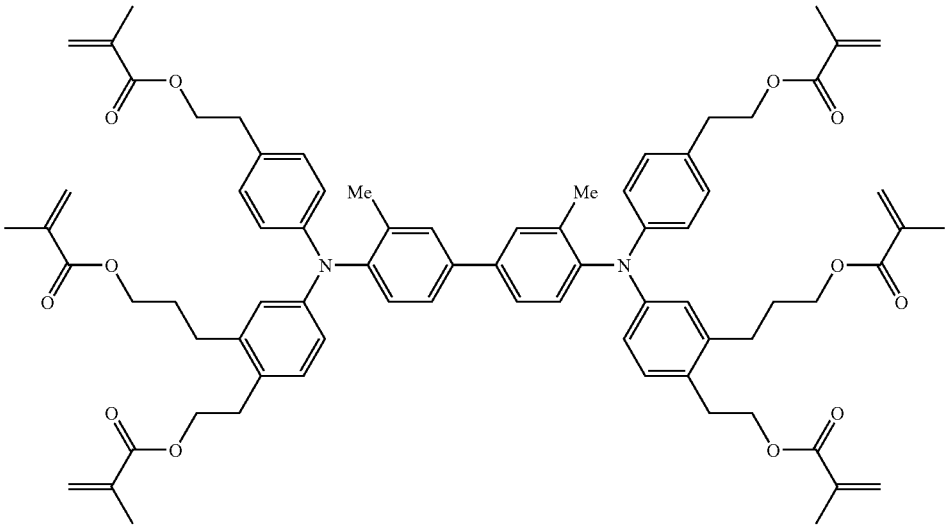

-continued

| No. | |
|---|---|
| A-21 | 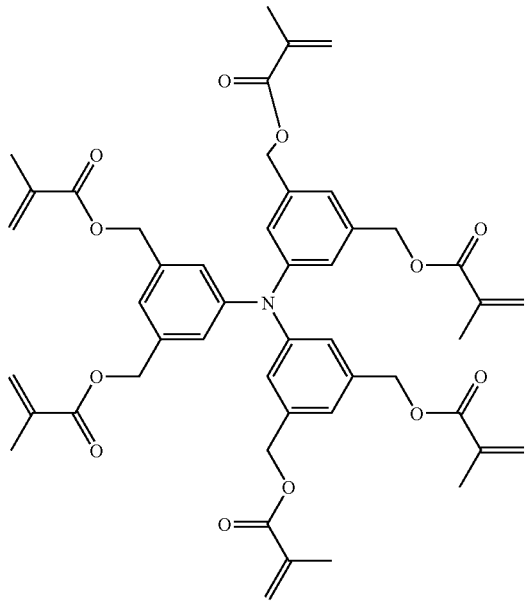 |

The compound represented by formula (A) is synthesized as follows.

That is, the compound represented by formula (A) can be synthesized by the condensation of alcohol of the precursor and corresponding methacrylic acid, or methacrylic acid halide, or when alcohol of the precursor is a benzyl alcohol structure, the compound can be synthesized by dehydration etherification with a methacrylic acid derivative having a hydroxyl group such as hydroxyethyl methacrylate.

The synthesis routes of Compound A-4 and Compound A-17 for use in this embodiment are shown below as examples

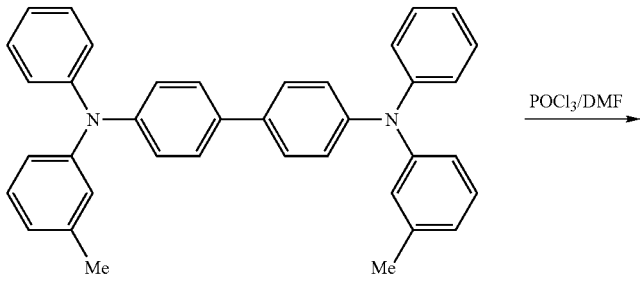

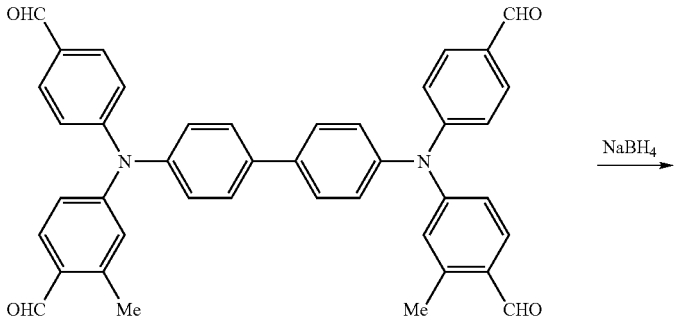

-continued
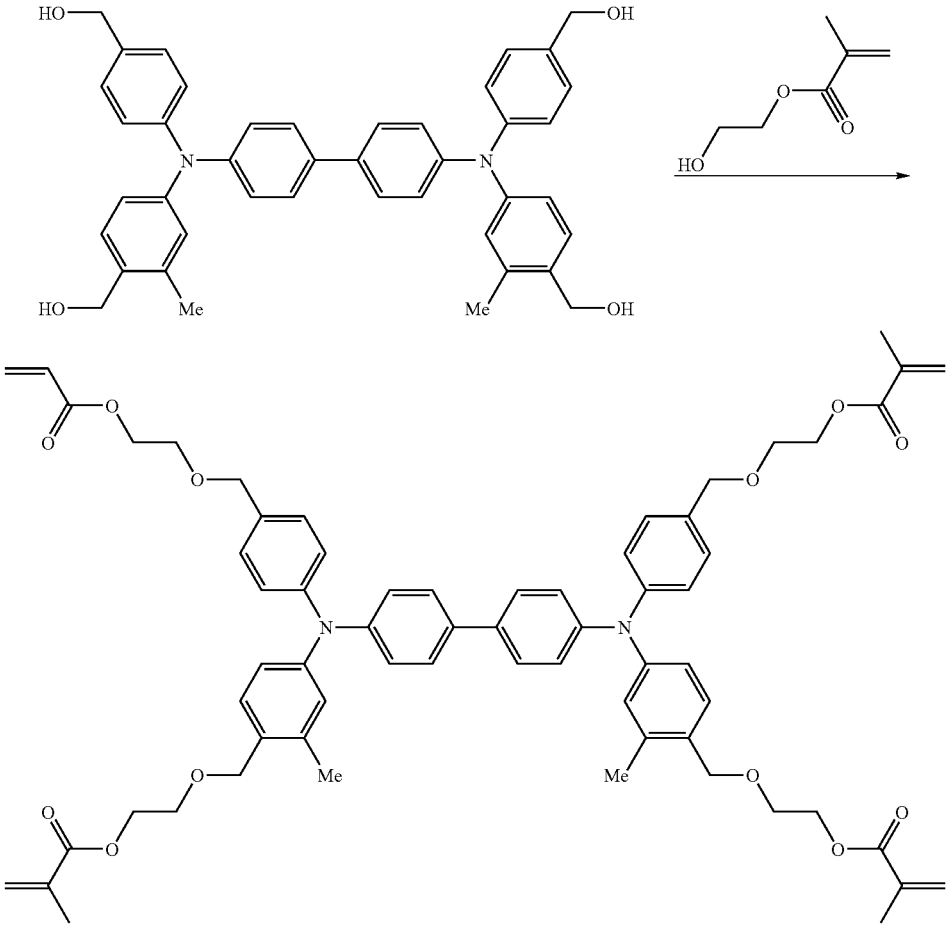
Compound A-4
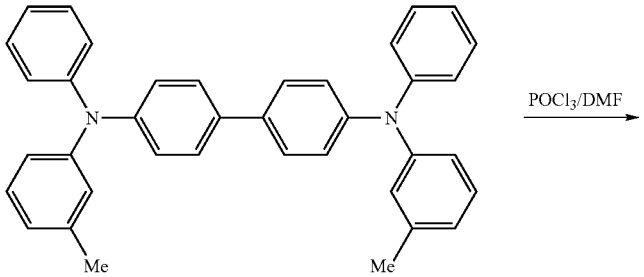
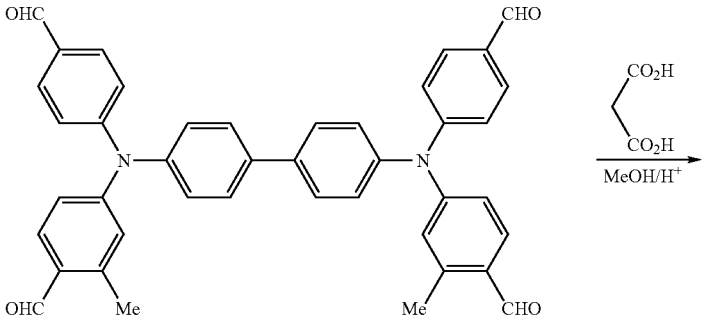

-continued
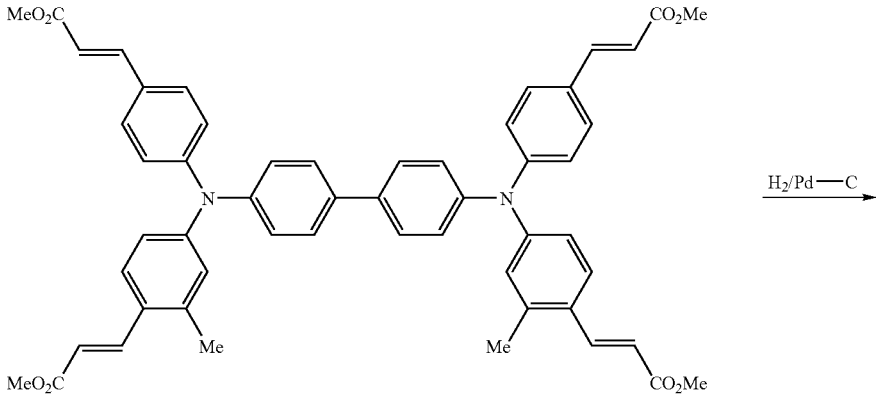
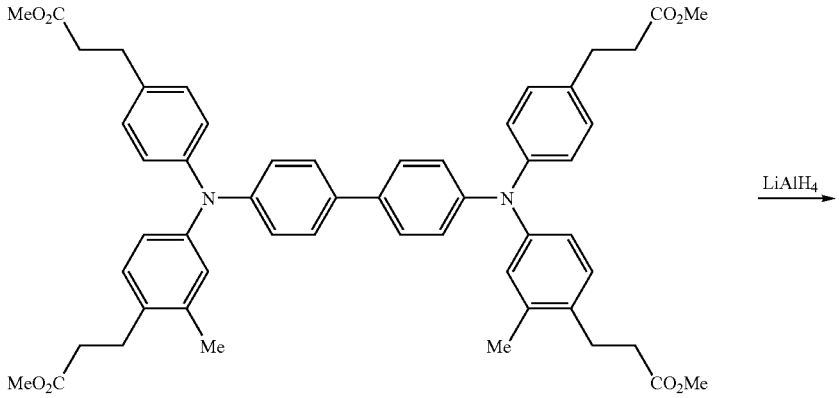
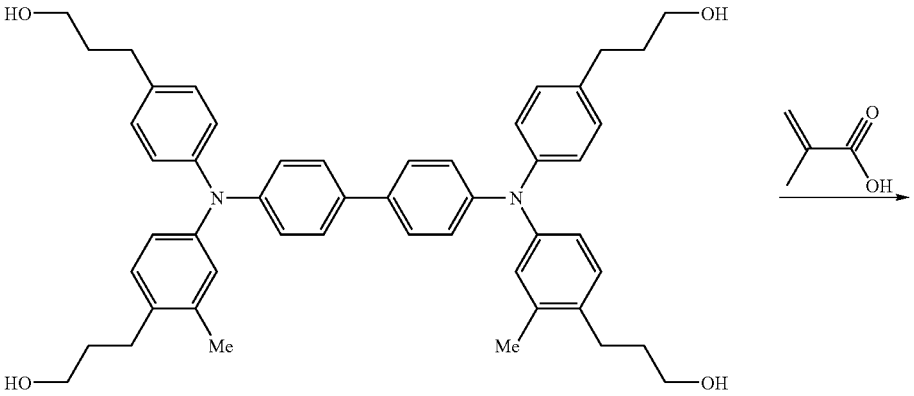

-continued

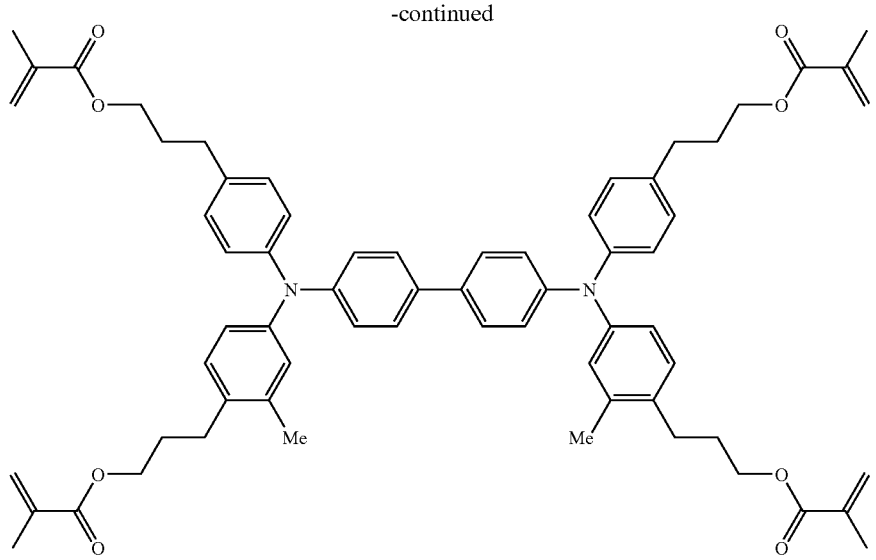

Compound A-17

The total amount of the specific charge transporting materials (a) is preferably 30% by weight or more and 100% by weight or less based on the composition for use in forming protective layer (outermost layer) 5, more preferably 30% by weight or more and 99% by weight or less, and still more preferably 30% by weight or more and 95% by weight or less.

When the total amount is in this range, a cured film (an outermost layer) having excellent electric characteristics can be obtained and thickening of the cured film is possible.

(Other Charge Transporting Materials)

The cured film constituting protective layer (outermost layer) 5 may be a cured film using known charge transporting materials not having a reactive group, and charge transporting materials having 1 to 3 reactive groups in the molecule other than the specific charge transporting materials (a), if necessary. The reactive group here means an acryl group or a methacryl group.

Since known charge transporting materials not having a reactive group do not have a reactive group not functioning charge transporting, when these known charge transporting materials are used in combination, for example, they substantially increase the concentration of the charge transporting components and improve the electric characteristics of the cured film (outermost layer). Further, known charge transporting materials not having a reactive group can contribute to the adjustment of the strength of the cured film (outermost layer). Furthermore, because the specific charge transporting materials (a) have a charge transporting structure and they are excellent in compatibility with known charge transporting materials not having a reactive group, it is possible to further improve electric characteristics by doping of conventional charge transporting materials not having a reactive group.

On the other hand, when charge transporting materials having 1 to 3 reactive groups in the molecule are used in combination, the strength of the cured film (outermost layer) can be regulated while maintaining electric characteristics, since crosslinking density of the specific charge transporting materials (a) having four or more methacryloyl groups (reactive groups) can be lessened without reducing the amount of the charge transporting structures present.

Charge transporting materials usable in combination with the specific charge transporting materials (a) are described below.

As known charge transporting materials not having a reactive group, for example, the materials exemplified later as charge transporting materials constituting charge transporting layer 3 can be used. Of these materials, those having a triphenylamine structure are preferred in view of mobility and compatibility.

As charge transporting materials having 1 to 3 reactive groups in the molecule, materials obtained by introducing 1 to 3 reactive groups to known charge transporting materials are exemplified. Of such materials, compounds having a triphenylamine structure and 1 to 3 acryl groups or methacryloyl groups in one and the same molecule are preferred in view of mobility and compatibility. In particular, compounds represented by formula (A), wherein D represents $—(CH_2)_f—(O—CH_2—CH_2)_g—O—CO—C(R)=CH_2$, f represents an integer of 0 to 5, g represents 0 or 1, R represents a hydrogen atom or a methyl group, and the total number of D is 1 or more and 3 or less are preferred, and compounds in which f in D is an integer of 1 to 5, and R represents a methyl group are especially preferred.

The specific examples of charge transporting materials having 1 to 3 reactive groups in the molecule are shown below.

As the specific examples of the charge transporting materials having one reactive group in the molecule, the following Compounds I-1 to I-12 are exemplified, but the invention is not restricted thereto.

| No. | |
|---|---|
| I-1 | 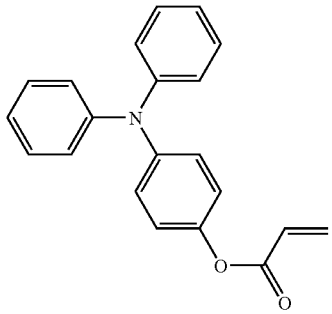 |
| I-2 | 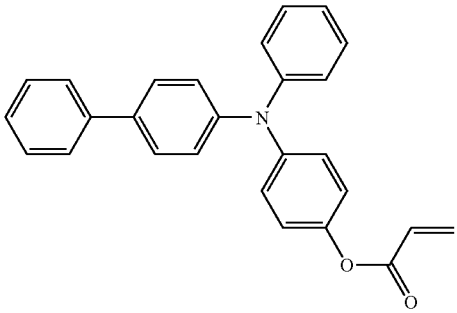 |
| I-3 | 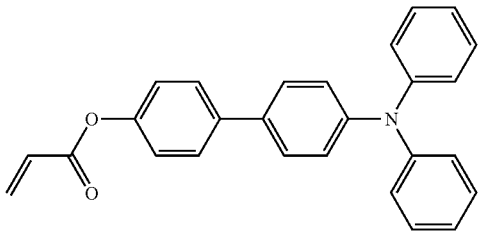 |
| I-4 | 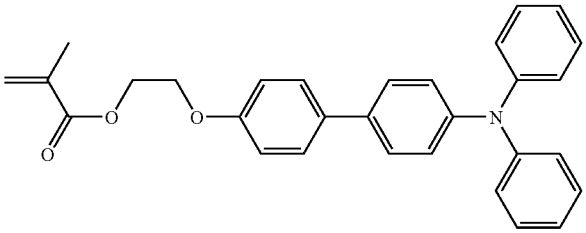 |
| I-5 | 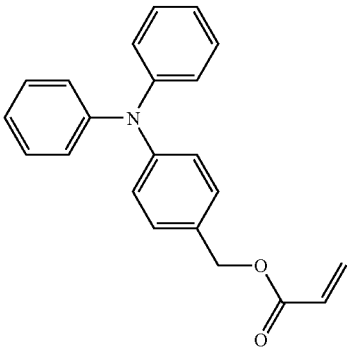 |

-continued
| No. | |
|---|---|
| I-6 | 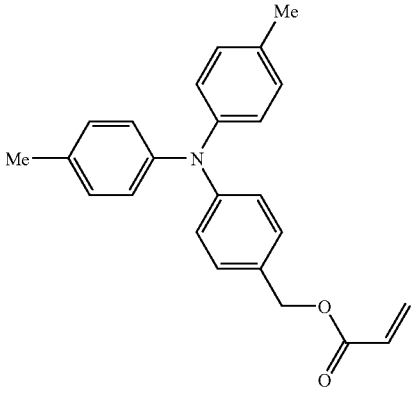 |
| I-7 | 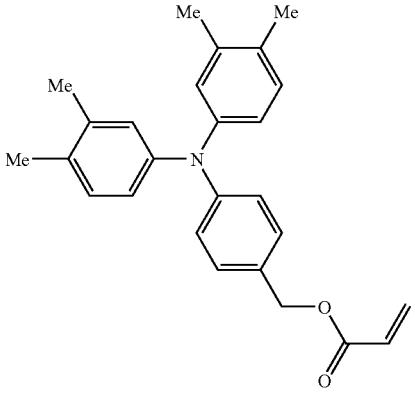 |
| I-8 | 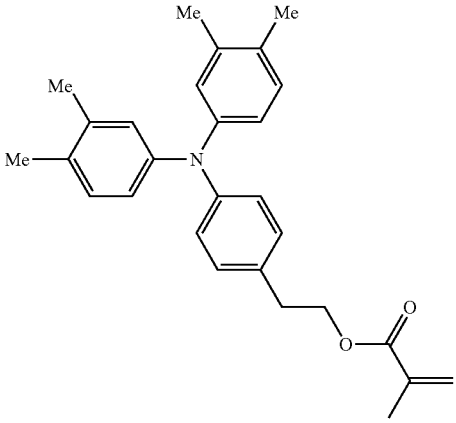 |
| I-9 | 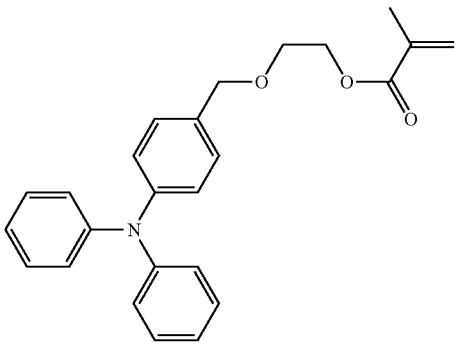 |

-continued
| No. | |
|---|---|
| I-10 | 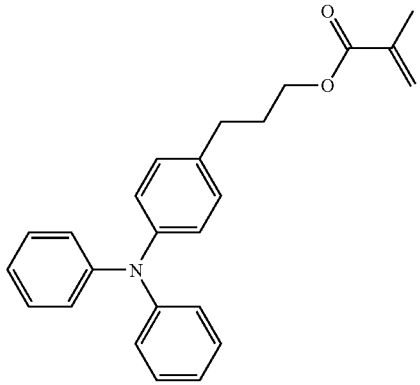 |
| I-11 | 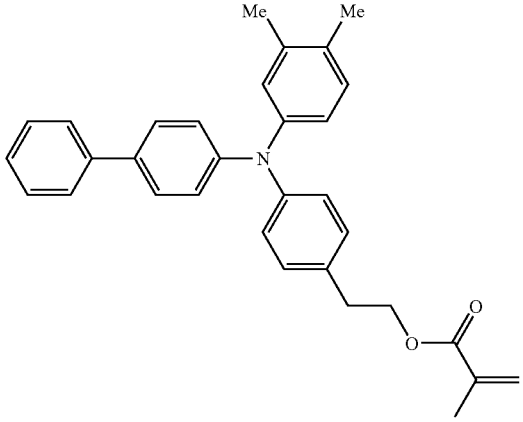 |
| I-12 | 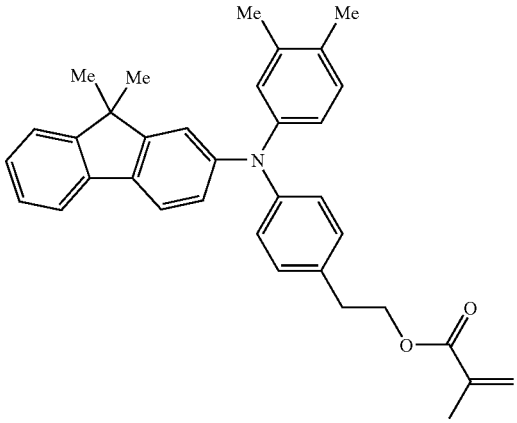 |
As the specific examples of the charge transporting materials having two reactive groups in the molecule, the following Compounds II-1 to II-19 are exemplified, but the invention is not restricted thereto.

| No. | |
|---|---|
| II-1 | 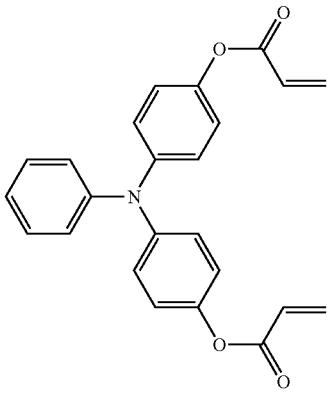 |
| II-2 | 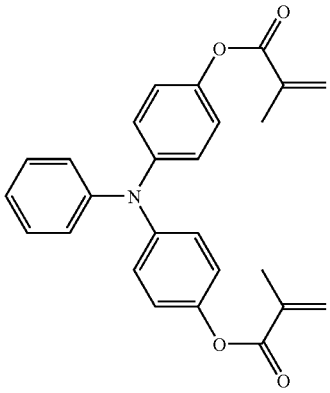 |
| II-3 | 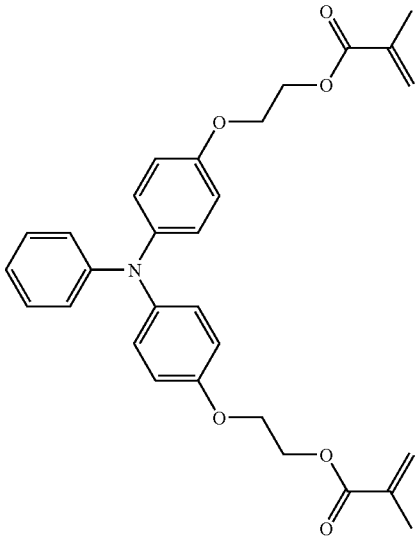 |

-continued
| No. | |
|---|---|
| II-4 | 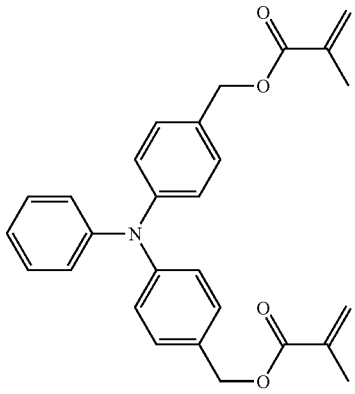 |
| II-5 | 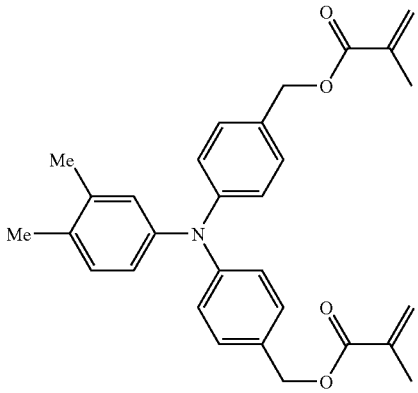 |
| II-6 | 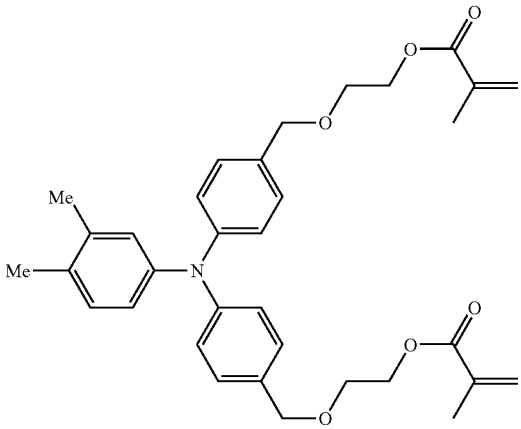 |

-continued
| No. | |
|---|---|
| II-7 | 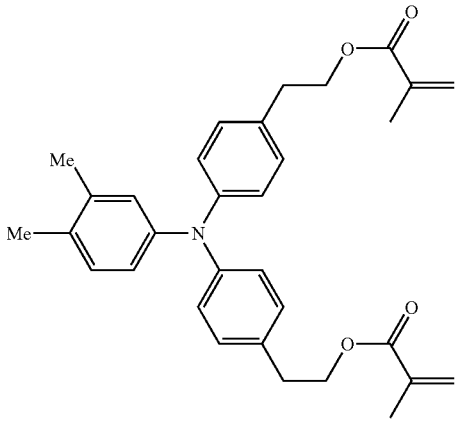 |
| II-8 | 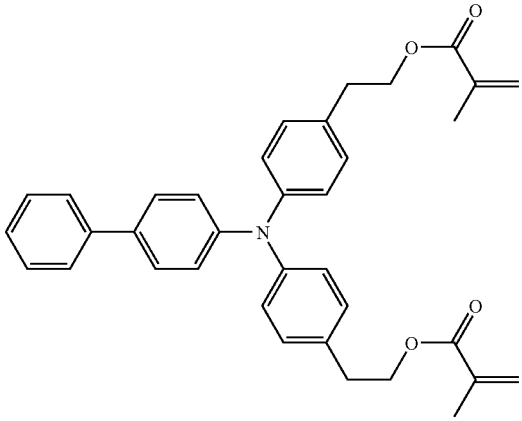 |
| II-9 | 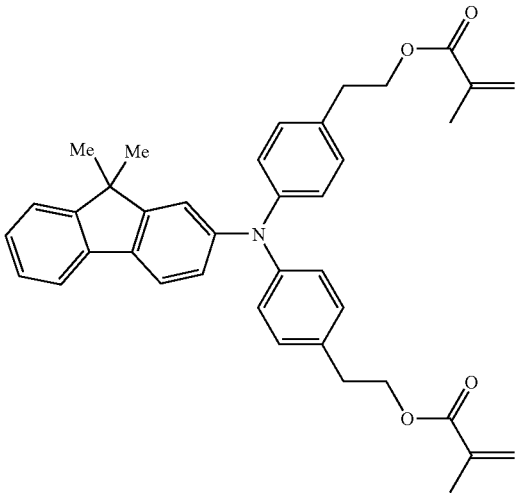 |

-continued
| No. | |
|---|---|
| II-10 | 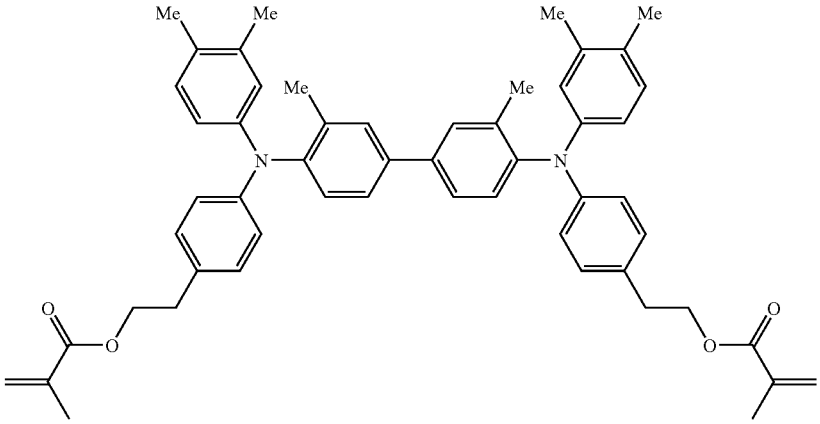 |
| II-11 | 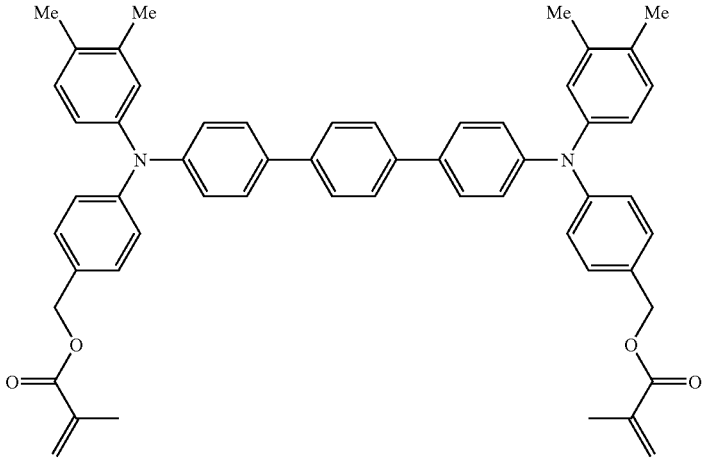 |
| II-12 | 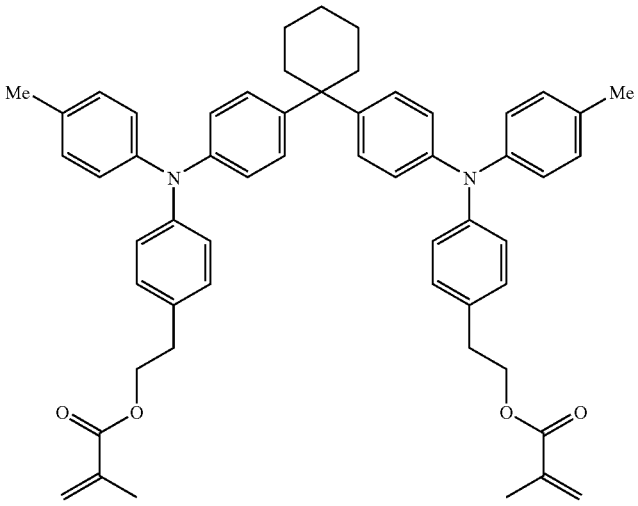 |

-continued
| No. | |
|---|---|
| II-13 | 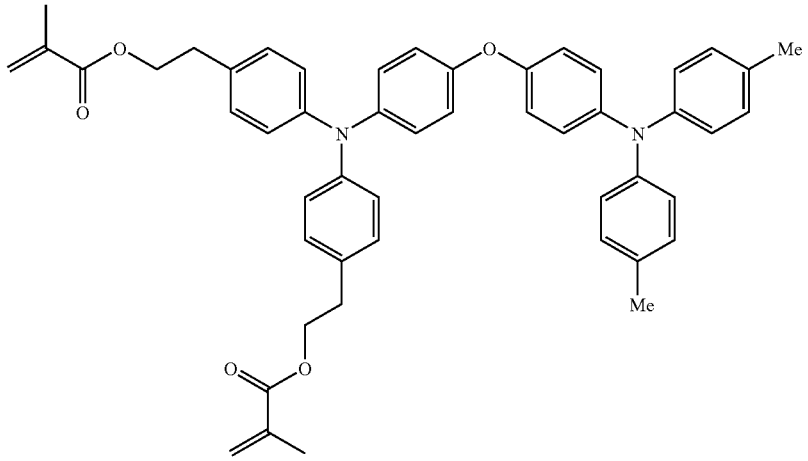 |
| II-14 | 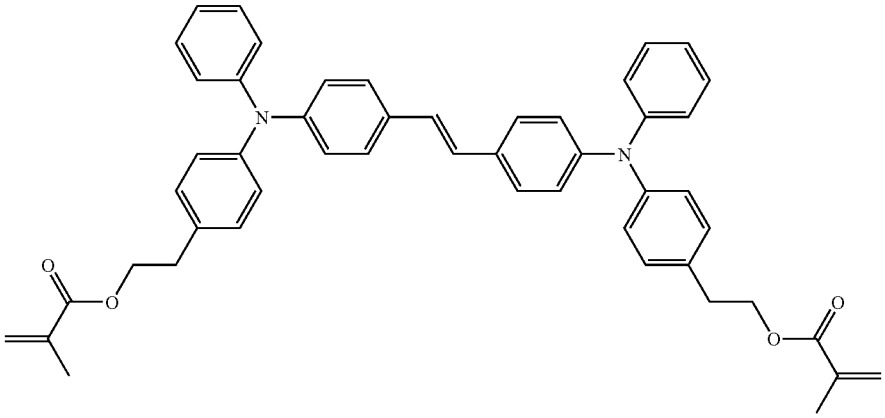 |
| II-15 | 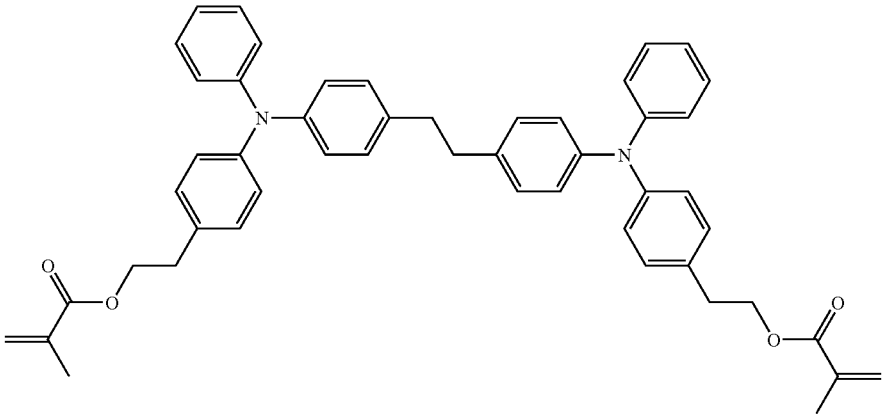 |

-continued
| No. | |
|---|---|
| II-16 | 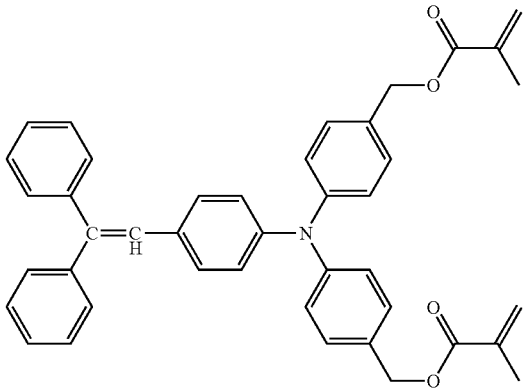 |
| II-17 | 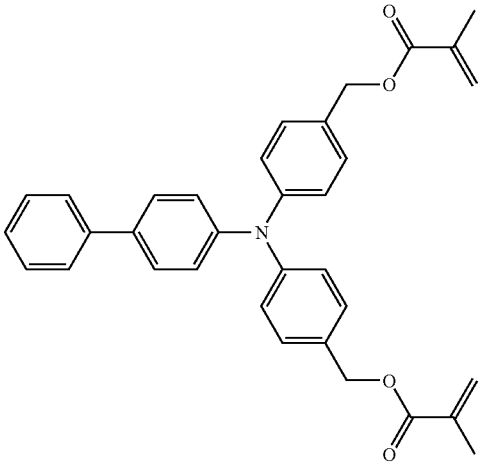 |
| II-18 | 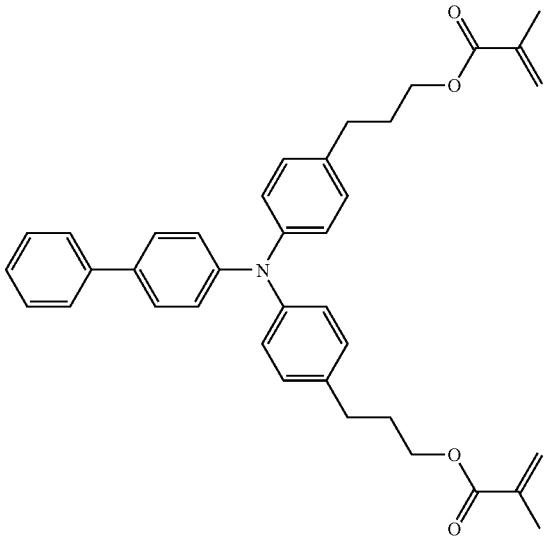 |

-continued
| No. | |
|---|---|
| II-19 | 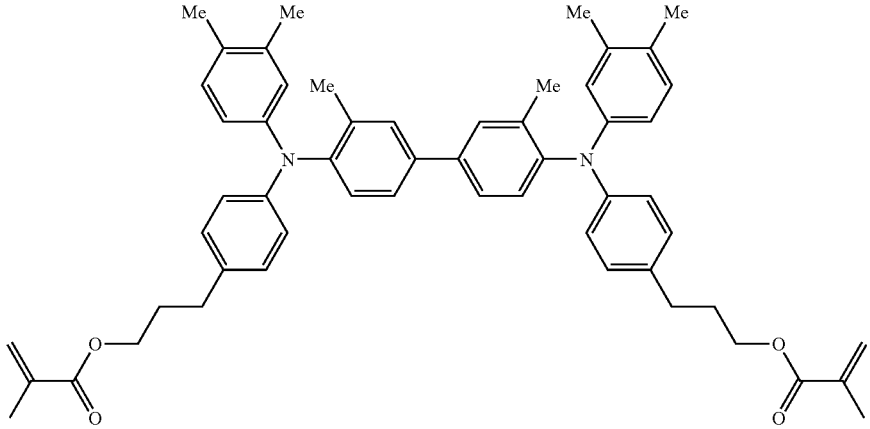 |
As the specific examples of the charge transporting materials having three reactive groups in the molecule, the following Compounds III-I1 to III-11 are exemplified, but the invention is not restricted thereto.
| No. | |
|---|---|
| III-1 | 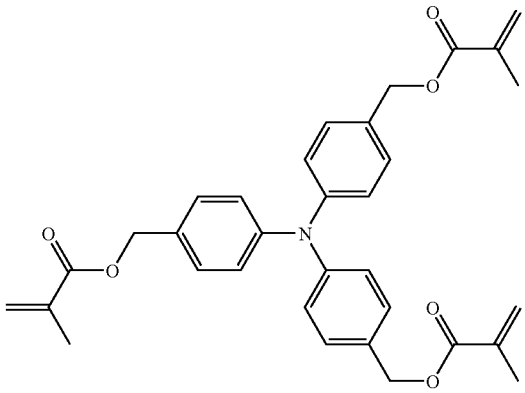 |
| III-2 | 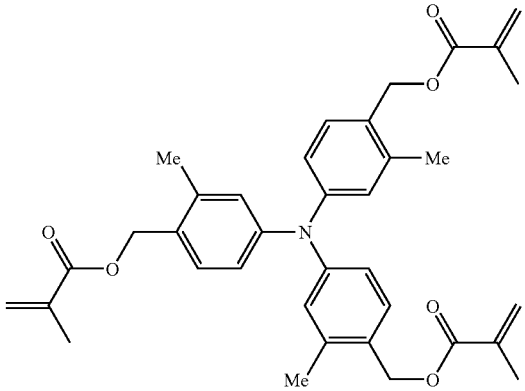 |

-continued
No.
III-3
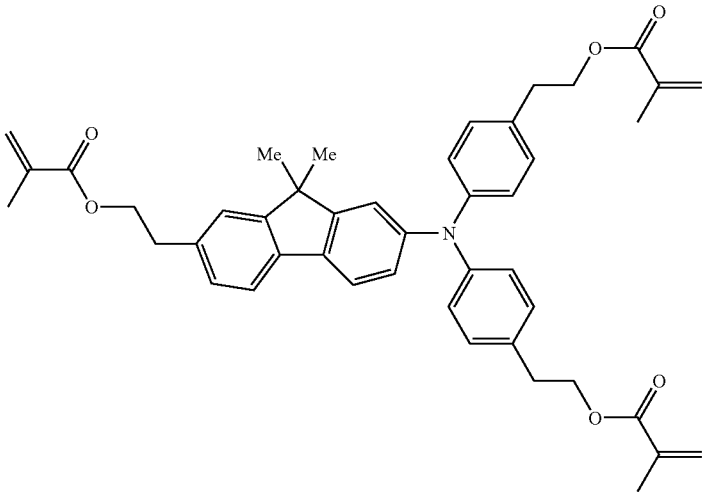
III-4
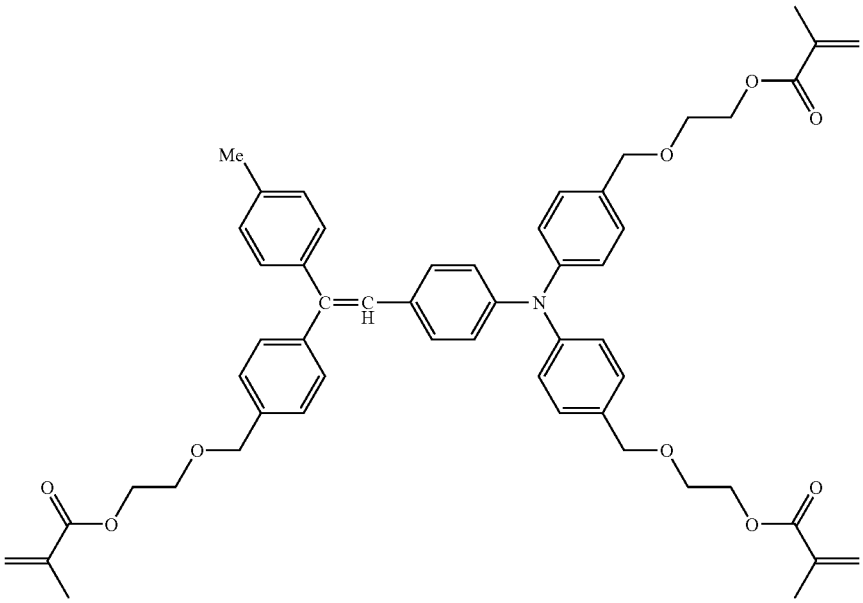
III-5
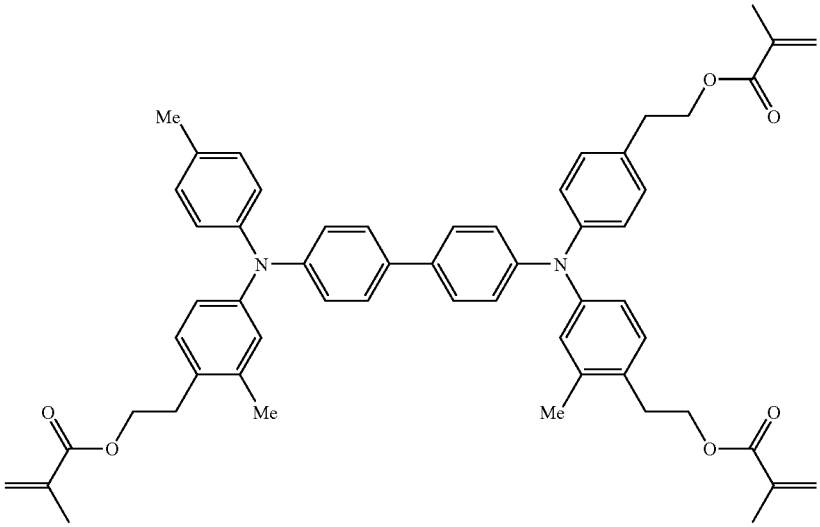

-continued
No.
III-6
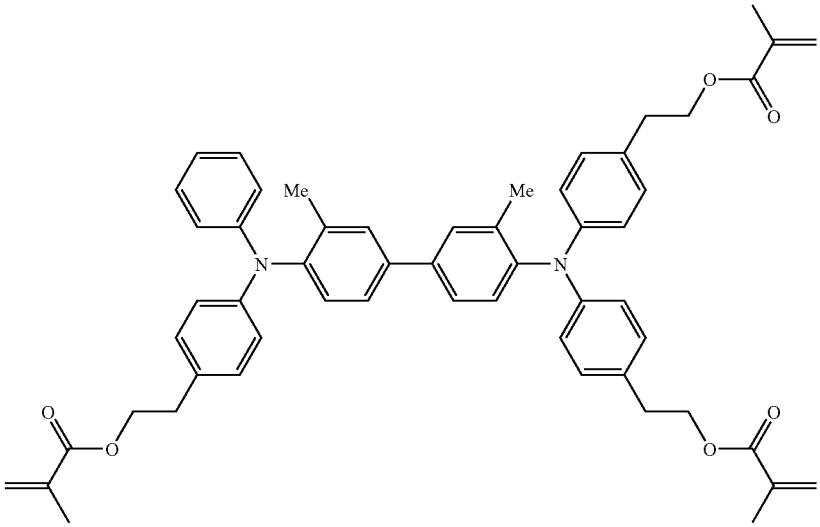
III-7
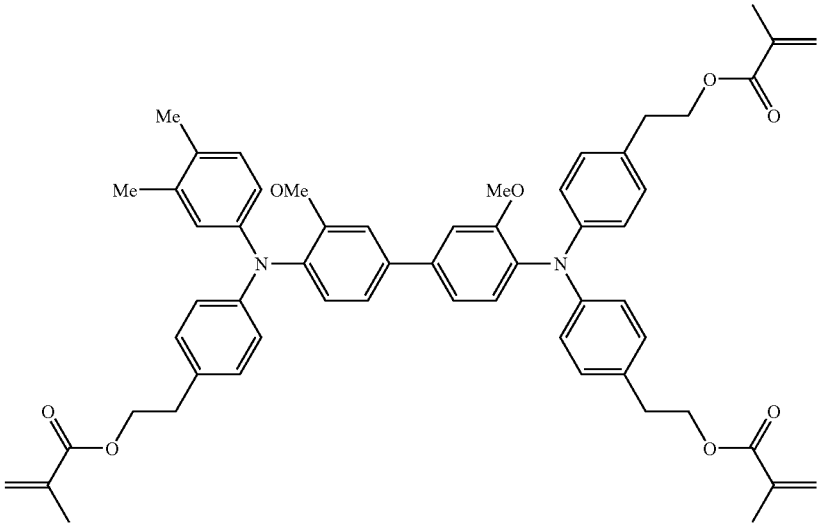
III-8
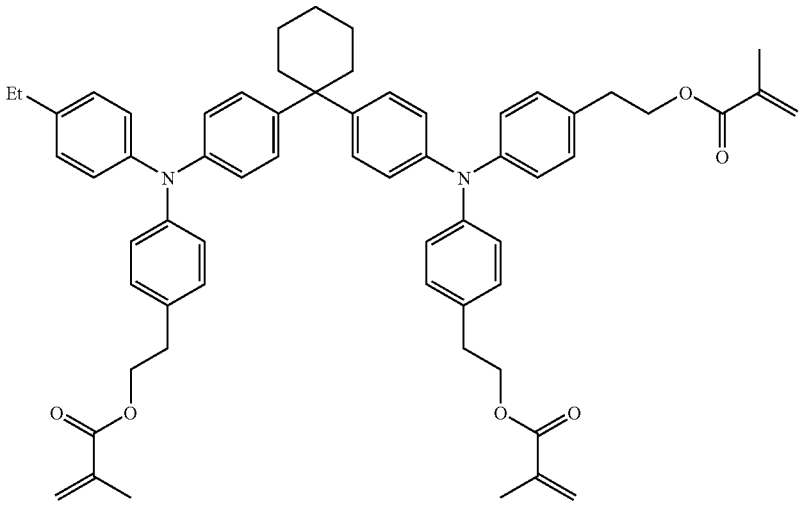

-continued
| No. |
| --- |
| III-9 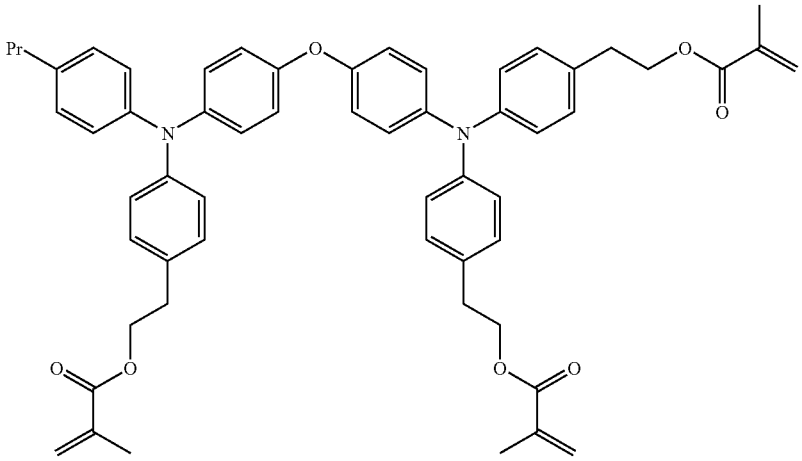 |
| III-10 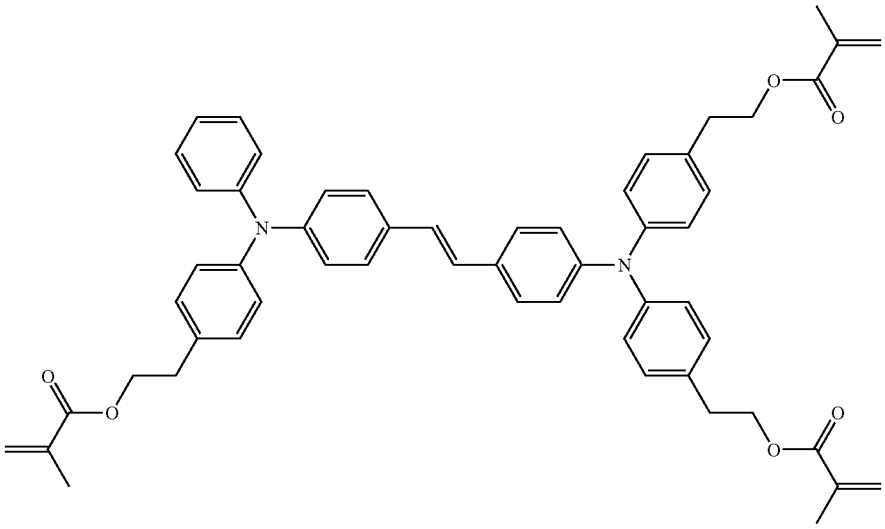 |
| III-11 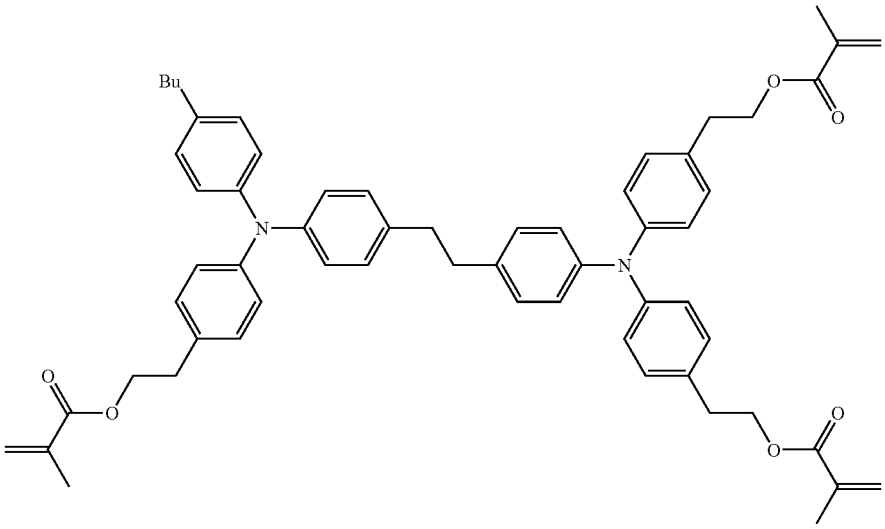 |
Other charge transporting materials as described above are preferably used in an amount of 0% by weight or more and 70% by weight or less based on the specific charge transporting materials (a), more preferably 0% by weight or more and 65% by weight or less, and still more preferably 0% by weight or more and 60% by weight or less.

In this embodiment, when compounds (e) that react with the specific charge transporting materials (a) are used in combination in the composition containing the specific charge transporting materials (a), it is preferred that all the compounds (e) are compounds having charge transportability.

Specifically, when compounds (e) that react with the specific charge transporting materials (a) are contained in the composition containing the specific charge transporting materials (a), it is preferred that all the compounds (e) comprise charge transporting materials having reactive groups as described above, and especially preferably charge transporting materials having 1 to 3 reactive groups.

By this constitution, mechanical strength of protective layer 5 (outermost layer) can be regulated without lowering electric characteristics.

(Catalyst)

The above-described composition containing the specific charge transporting materials (a) is polymerized and cured by light, electron beams or heat. A curing catalyst (a polymerization initiator) may not be used in the polymerization and curing reaction, but reaction efficiently progresses by the use of the curing catalysts as shown below.

As photo-curing catalysts, intramolecular cleavage type and hydrogen drawing type curing catalysts are exemplified.

As the intramolecular cleavage type curing catalysts, benzyl ketal-based, alkylphenone-based, aminoalkylphenone-based, phosphine oxide-based, titanocene-based, and oxime-based curing catalysts are exemplified.

Specifically, as benzyl ketal-based curing catalyst, 2,2-dimethoxy-1,2-diphenylethan-1-one is exemplified.

As alkylphenone-based photo-curing catalysts, 1-hydroxycyclohexyl phenyl ketone, 2-hydroxy-2-methyl-1-phenylpropan-1-one, 1-[4-(2-hydroxyethoxy)phenyl]-2-hydroxy-2-methyl-1-propan-1-one, 2-hydroxy-1-{4-[4-(2-hydroxy-2-methylpropionyl)benzyl]phenyl}-2-methylpropan-1-one, acetophenone, and 2-phenyl-2-(p-toluenesulfonyloxy)-acetophenone are exemplified.

As aminoalkylphenone-based curing catalysts, p-dimethylaminoacetophenone, p-dimethylaminopropiophenone, 2-methyl-1-(4-methylthiophenyl)-2-morpholinopropan-1-one, and 2-benzyl-2-dimethylamino-1-(4-morpholinophenyl)-butanone-1,2-(dimethylamino)-2-[(4-methylphenyl) methyl]-1-[4-(4-morpholinyl)phenyl]-1-butanone are exemplified.

As phosphine oxide-based curing catalysts, 2,4,6-trimethylbenzoyl-diphenyl phosphineoxide, and bis(2,4,6-trimethylbenzoyl)phenyl phosphineoxide are exemplified.

As titanocene-based curing catalyst, bis(η5-2,4-cyclopentadien-1-yl)-bis[2,6-difluoro-3-(1H-pyrrol-1-yl)-phenyl]titanium is exemplified.

As oxime-based curing catalysts 1,2-octanedione, 1-[4-(phenylthio)-, 2-(O-benzoyloxime), ethanone, 1-[9-ethyl-6-(2-methylbenzoyl)-9H-carbazol-3-yl]-, 1(-O-acetyloxime) are exemplified.

As the hydrogen drawing type curing catalysts, benzophenone-based, thioxanthone-based, benzyl-based, and Michler's ketone-based catalysts are exemplified.

As the hydrogen drawing type curing catalysts, specifically as benzophenone-based catalysts, 2-benzoyl benzoic acid, 2-chlorobenzophenone, 4,4'-dichlorobenzo-phenone, 4-benzoyl-4'-methyldiphenyl sulfide, and p,p'-bisdiethylaminobenzophenone are exemplified.

As thioxanthone-based curing catalysts, 2,4-diethylthioxanthen-9-one, 2-chlorothioxanthone, and 2-isopropylthioxanthone are exemplified.

As benzyl-based curing catalysts, benzyl, (±)-camphorquinone, and p-anisyl are exemplified.

As the curing catalysts for use in thermal curing, well-known thermal polymerization initiators can be used and specifically the following shown commercially available curing catalysts (thermal polymerization initiators) are preferably used.

That is, as commercially available thermal polymerization initiators, azo-based initiators, e.g., V-30, V-40, V-59, V601, V65, V-70, VF-096, Vam-110 and Vam-111 (manufactured by Wako Pure Chemical Industries), $OT_{AZO}$-15, $OT_{AZO}$-30, AIBN, AMBN, ADVN and ACVA (manufactured by Otsuka Pharmaceutical Co., Ltd.) are exemplified.

In addition, PERTETRA A, PERHEXA HC, PERHEXA C, PERHEXA V, PERHEXA 22, PERHEXA MC, PERBUTYL H, PERCUMYL H, PERCUMYL P, PERMENTA H, PEROCTA H, PERBUTYL C, PERBUTYL D, PERHEXYL D, PEROYL IB, PEROYL 355, PEROYL L, PEROYL SA, NYPER BW, NYPER BMT-K40/M, PEROYL IPP, PEROYL NPP, PEROYL TCP, PEROYL OPP, PEROYL SBP, PERCUMYL ND, PEROCTA ND, PERHEXYL ND, PERBUTYL ND, PERBUTYL NHP, PERHEXYL PV, PERBUTYL PV, PERHEXA 250, PEROCTA O, PERHEXYL O, PERBUTYL O, PERBUTYL L, PERBUTYL 355, PERHEXYL I, PERBUTYL I, PERBUTYL E, PERHEXA 25Z, PERBUTYL A, PERHEXYL Z, PERBUTYL ZT, and PERBUTYL Z (manufactured by NOF CORPORATION), Kayaketal AM-C55, Trigonox 36-C75, Laurox, Perkadox L-W75, Perkadox CH-50L, Trigonox TMBH, Kayacumene H, Kayabutyl H-70, Perkadox BC-FF, Kayahexa AD, Perkadox 14, Kayabutyl C, Kayabutyl D, Kayahexa YD-E85, Perkadox 12-XL25, Perkadox 12-EB20, Trigonox 22-N70, Trigonox 22-70E, Trigonox D-T50, Trigonox 423-C70, Kayaester CND-C70, Kayaester CND-W50, Trigonox 23-C70, Trigonox 23-W50N, Trigonox 257-C70, Kayaester P-70, Kayaester TMPO-70, Trigonox 121, Kayaester O, Kayaester HTP-65W, Kayaester AN, Trigonox 42, Trigonox F-C50, Kayabutyl B, Kayacarbon EH-C70, Kayacarbon EH-W60, Kayacarbon I-20, Kayacarbon BIC-75, Trigonox 117, and Kayalen 6-70 (manufactured by Kayaku Akzo Corporation), Luperox 610, Luperox 188, Luperox 844, Luperox 259, Luperox 10, Luperox 701, Luperox 11, Luperox 26, Luperox 80, Luperox 7, Luperox 270, Luperox P, Luperox 546, Luperox 554, Luperox 575, Luperox TANPO, Luperox 555, Luperox 570, Luperox TAP, Luperox TBIC, Luperox TBEC, Luperox JW, Luperox TALC, Luperox TAEC, Luperox DC, Luperox 101, Luperox F, Luperox DI, Luperox 130, Luperox 220, Luperox 230, Luperox 233, and Luperox 531 (manufactured by ARKEMA YOSHITOMI, LTD.) are exemplified.

These curing catalysts are added in an amount of preferably 0.2% by weight or more and 10% by weight or less based on all the solids content in the composition containing the specific charge transporting materials (a), more preferably 0.5% by weight or more and 8% by weight or less, and still more preferably 0.7% by weight or more and 5% by weight or less.

The composition containing the specific charge transporting materials (a) of this embodiment may contain reactive compound (b) not having charge transportability. Since protective layer 5 (outermost layer) having sufficient electric characteristics and mechanical strength can be obtained by the use of the specific charge transporting materials (a), the mechanical strength of protective layer 5 (outermost layer) may be adjusted by using the reactive compound (b) not having charge transportability in combination.

The terminology "not having charge transportability" means that transportation of the carrier is not observed by the time of flight method.

As such reactive compounds, monofunctional or polyfunctional polymerizable monomers, oligomers, and polymers, e.g., monomers, oligomers, and polymers of acrylate or methacrylate are exemplified.

Specifically, as monofunctional monomers, e.g., isobutyl acrylate, t-butyl acrylate, isooctyl acrylate, lauryl acrylate, stearyl acrylate, isobornyl acrylate, cyclohexyl acrylate, 2-methoxyethyl acrylate, methoxy triethylene glycol acrylate, 2-ethoxyethyl acrylate, tetrahydrofurfuryl acrylate, benzyl acrylate, ethylcarbitol acrylate, phenoxyethyl acrylate, 2-hydroxy acrylate, 2-hydroxypropyl acrylate, 4-hydroxybutyl acrylate, methoxy polyethylene glycol acrylate, methoxy polyethylene glycol methacrylate, phenoxy polyethylene glycol acrylate, phenoxy polyethylene glycol methacrylate, hydroxyethyl o-phenyl-phenol acrylate, and o-phenylphenol glycidyl ether acrylate are exemplified.

As difunctional monomers, oligomers and polymers, e.g., diethylene glycol di(meth)acrylate, polyethylene glycol di(meth)acrylate, polypropylene glycol di(meth)acrylate, neopentyl glycol di(meth)acrylate, and 1,6-hexanediol di(meth)acrylate are exemplified.

As trifunctional monomers, oligomers and polymers, e.g., trimethylolpropane tri(meth)acrylate, pentaerythritol tri(meth)acrylate, and aliphatic tri(meth)acrylate are exemplified.

As tetrafunctional monomers, oligomers and polymers, e.g., pentaerythritol tetra(meth)acrylate, ditrimethylolpropane tetra(meth)acrylate, and aliphatic tetra(meth)acrylate are exemplified.

As pentafunctional or higher monomers, oligomers and polymers, e.g., dipentaerythritol penta(meth)acrylate, dipentaerythritol hexa(meth)acrylate, in addition, (meth)acrylates having a polyester structure, a urethane structure, and a phosphazen structure are exemplified.

These monomers, oligomers and polymers may be used alone, or two or more kinds as mixture.

These monomers, oligomers and polymers are used in an amount of 100% by weight or less based on all the amounts of the compounds having charge transportability in the composition containing the specific charge transporting materials (the specific charge transporting materials and other charge transporting materials), preferably 50% by weight or less, and more preferably 30% by weight or less.

Further, polymer (c) that reacts with or polymer (d) that does not react with the specific charge transporting materials (a) can be blended with the composition containing the specific charge transporting materials (a) for the purpose of dispersibility of particles, viscosity control, and for the purpose of resistance to discharged gas, mechanical strength, scratch resistance, reduction of torque, control of abrasion loss, and elongation of pot life of the cured film (outermost layer).

In protective layer 5 (outermost layer) comprising the cured film of the composition containing the specific charge transporting materials (a), sufficient electric characteristics and mechanical strength are secured, so that various kinds of polymers may be used in combination as the binder resins. By using these polymers, the viscosity of the composition is heightened and protective layer 5 (outermost layer) having excellent surface properties is formed, in addition, the improvement of a gas barriering property for preventing gas from mixing into the outermost layer is contrived, and adhesion to the lower layer is also heightened.

As the polymers (c) reacting with the specific charge transporting materials (a), polymers having a radical polymerizable unsaturated bond as the reactive group are sufficient. As such polymers, in addition to the above polymers of acrylate and methacrylate, those disclosed in JP-A No. 5-216249, paragraphs [0026] to [0059], JP-A No. 5-323630, paragraphs [0027] to [0029], JP-A No. 11-52603, paragraphs [0089] to [0100], and JP-A No. 2000-264961, paragraphs [0107] to [0128] are exemplified.

As the polymers (d) not reacting with the specific charge transporting materials (a), polymers not having a radical polymerizable unsaturated bond are sufficient. Specifically, well-known resins such as polycarbonate resin, polyester resin, polyallylate resin, methacrylic resin, acrylic resin, polyvinyl chloride resin, polyvinylidene chloride resin, and polystyrene resin are exemplified as such polymers.

These polymers are used in an amount of 100% by weight or less based on the total amount of the compounds having charge transportability in the composition containing the specific charge transporting materials (a) (the specific charge transporting materials (a) and other charge transporting materials), preferably 50% by weight or less, and more preferably 30% by weight or less.

The composition containing the specific charge transporting materials (a) may further contain a coupling agent, a hard coat agent, and a fluorine-containing compound for the purpose of regulating a film-forming property, flexibility, lubricity and an adhesive property. As these additives, various silane coupling agents and commercially available silicone hard coat agents are specifically used.

As the silane coupling agents, vinyl trichlorosilane, vinyl trimethoxysilane, vinyl triethoxysilane, γ-glycidoxy-propylmethyldiethoxysilane, γ-glycidoxypropyltrimethoxy-silane, γ-aminopropyltriethoxysilane, γ-aminopropyl-trimethoxysilane, γ-aminopropylmethyldimethoxysilane, N-β-(aminoethyl)-γ-aminopropyltriethoxysilane, tetramethoxysilane, methyltrimethoxysilane, and dimethyldimethoxysilane are used.

As the commercially available hard coat agents, KP-85, X-40-9740, X-8239 (manufactured by Shin-Etsu Silicones), AY42-440, AY42-441, and AY49-208 (manufactured by Dow Corning Toray Co., Ltd.) are used.

For giving water repellency, fluorine-containing compounds such as (tridecafluoro-1,1,2,2-tetrahydrooctyl)-triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, and 1H,1H,2H,2H-perfluorooctyltriethoxysilane may be added. Further, reactive fluorine-containing compounds disclosed in JP-A No. 2001-166510 may be blended.

Silane coupling agents can be used in an optional amount, but the amount of fluorine-containing compounds is preferably 0.25 times or less by weight to compounds not containing fluorine. If the amount exceeds this range, there are cases where problems arise in a film forming ability of a crosslinked film.

Alcohol-soluble resins may be added to protective layer 5 (outermost layer) for the purpose of resistance to discharged gas, mechanical strength, scratch resistance, reduction of torque, control of abrasion loss, and elongation of pot life of the protective layer (outermost layer).

It is desired to add an antioxidant to protective layer 5 (outermost layer) for the purpose of prevention of deterioration due to oxidizing gas, e.g., ozone and the like, generating in a charging apparatus of the protective layer When mechanical strength of the surface of a photoreceptor is heightened and the photoreceptor has a long duration of life, the photoreceptor comes to be brought into contact with oxidizing gas for a long time, and so oxidation resistance stronger than before is required.

As antioxidants, hindered phenol-based and hindered amine-based antioxidants are preferred, but well-known antioxidants such as organic sulfur-based antioxidants, phosphite-based antioxidants, dithiocarbamate-based antioxidants, thiourea-based antioxidants, and benzimidazole-based antioxidants may also be used. The addition amount of antioxidants is preferably 20% by weight or less based on all the solids content in the coating solution (composition) for forming a protective layer, and more preferably 10% by weight or less.

As the hindered phenol-based antioxidants, "Irganox 1076", "Irganox 1010", "Irganox 1098", "Irganox 245", "Irganox 1330", "Irganox 3114", "Irganox 1076" (manufactured by Ciba Japan KK), and "3,5-di-t-butyl-4-hydroxybiphenyl" are exemplified.

As the hindered amine-based antioxidants, "Sanol LS2626", "Sanol LS765", "Sanol LS770", "Sanol LS744", "Tinuvin 144", "Tinuvin 622LD" (manufactured by Sankyo Lifetech Co., Ltd), "Mark LA57", "Mark LA67", "Mark LA62", "Mark LA68", and "Mark LA63" (manufactured by Adeka Corporation) are exemplified. As the thioether-based antioxidants, "Sumilizer TPS" and "Sumilizer TP-D" (manufactured by Sumitomo Chemical Co., Ltd.) are exemplified. As the phosphite-based antioxidants, "Mark 2112", "Mark PEP-8", "Mark PEP-24G", "Mark PEP-36", "Mark 329K" and "Mark HP-10" (manufactured by Adeka Corporation) are exemplified.

Further, for the purpose of lowering residual potential or improving strength of a protective layer, various particles may be added to protective layer 5 (outermost layer).

As an example of the particles, silicon-containing particles are exemplified. Silicon-containing particles are particles that silicon is contained in the constitutional elements, and specifically colloidal silica and silicone particles are exemplified. Colloidal silica used as silicon-containing particles is selected from acidic or alkaline aqueous dispersion, or dispersion in an organic solvent such as alcohol, ketone or ester, of silica having an average particle size of 1 nm or more and 100 nm or less, preferably 10 nm or more and 30 nm or less, and commercially available products may be used.

The solids content of colloidal silica in protective layer 5 is not especially restricted, but the content is generally 0.1% by weight or more and 50% by weight or less based on all the solids content of protective layer 5 in view of a film-forming property, electric characteristics and strength, and preferably used in the range of 0.1% by weight or more and 30% by weight or less.

Silicone particles used as silicon-containing particles are selected from silicone resin particles, silicone rubber particles, silica particles surface treated with silicone, and commercially available products are generally used. These silicone particles are spherical, and the average particle size is preferably 1 nm or more and 500 nm or less, and more preferably 10 nm or more and 100 nm or less. Silicone particles are minute particles chemically inert and excellent in dispersibility in a resin, and further the content necessary to obtain sufficient characteristics is low, so that the surface property of an electrophotographic photoreceptor is improved without hindering crosslinking reaction. That is, lubricating ability and water repellency of the surface of an electrophotographic photoreceptor are improved, and good abrasion resistance and resistance to adhesion of contaminants are maintained for long in the state of silicone particles being surely taken in without causing unevenness in a tenacious crosslinking structure.

The content of silicone particles in protective layer 5 is preferably 0.1% by weight or more and 30% by weight or less based on all the solids content of protective layer 5, and more preferably 0.5% by weight or more and 10% by weight or less.

The examples of other particles include fluorine-based particles such as particles of ethylene tetrafluoride, ethylene trifluoride, propylene hexafluoride, vinyl fluoride, and vinylidene fluoride, particles comprising a resin obtained by copolymerization of fluorine-containing resin with a monomer having a hydroxyl group as shown in the proceeding of The $8^{th}$ Polymer Material Forum, Lecture, p. 89, and semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, and MgO are exemplified.

Oils such as silicone oil may be added to protective layer 5 (outermost layer) in the same purpose. As the silicone oils, silicone oils such as dimethylpolysiloxane, diphenylpolysiloxane, and phenylmethylsiloxane; reactive silicone oils such as amino-modified polysiloxane, epoxy modified polysiloxane, carboxyl-modified polysiloxane, carbinol-modified polysiloxane, methacryl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexa-siloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopenta-siloxane; cyclic phenylcyclosiloxanes such as hexaphenyl-cyclotrisiloxane; fluorine-containing cyclosiloxanes such as (3,3,3-trifluoropropyl)methylcyclotrisiloxane; hydrosilyl group-containing cyclosiloxanes such as methylhydrosiloxane mixture, pentamethylcyclopentanesiloxane, and phynylhydro-cyclosiloxane; and vinyl group-containing cyclosiloxanes such as pentavinylpentamethylcyclopentasiloxane are exemplified.

Metals, metal oxides and carbon blacks may be added to protective layer 5 (outermost layer). As the metals, aluminum, zinc, copper, chromium, nickel, silver, stainless steel, and plastic particles the surfaces of which are deposited with these metals are exemplified. The examples of the metal oxides include zinc oxide, titanium oxide, tin oxide, antimony oxide, indium oxide, bismuth oxide, indium oxide doped with tin, tin oxide doped with antimony and tantalum, and zirconium oxide doped with antimony. These metals and metal oxides may be used alone, or may be used in combination of two or more kinds. When two or more kinds are used in combination, they may be used as mere mixture, or may be the form of a solid solution or fusion. The average particle size of conductive particles is preferably 0.3 μm or less in view of transparency of the protective layer, and especially preferably 0.1 μm or less.

It is preferred that the composition containing the specific charge transporting materials (a) which is used for forming protective layer 5 is prepared as a coating solution for forming a protective layer.

The coating solution for forming a protective layer may be free of solvents, or the solution is prepared with an aromatic solvent, e.g., toluene or xylene, a ketone solvent, e.g., methyl ethyl ketone, methyl isobutyl ketone, or cyclohexanone, an ester solvent, e.g., ethyl acetate or butyl acetate, an ether solvent, e.g., tetrahydrofuran or dioxane, a cellosolve solvent, e.g., ethylene glycol monomethyl ether, or an alcohol solvent, e.g., isopropyl alcohol or butanol, alone or as a mixed solvent.

When a coating solution is prepared by the reaction of the above components, they may be merely mixed and dissolved, but preferably they are heated on the condition of room temperature or higher and 100° C. or lower, more preferably 30° C. or higher and 80° C. or lower for 10 minutes or longer and 100 hours or shorter, and still more preferably for 1 hour or longer and 50 hours or shorter. At this time, it is also preferred to use ultrasonic wave irradiation.

By the above processing, partial reaction presumably advances in the coating solution, and homogeneity of the coating solution is bettered and a uniform film free from coating defects is liable to be obtained.

The coating solution for forming a protective layer comprising the composition containing the specific charge transporting materials (a) is coated on charge transporting layer 3 forming a coating surface according to an ordinary method, such as a blade coating method, a wire bar coating method, a spray coating method, a dip coating method, a bead coating method, an air knife coating method, or a curtain coating method.

After that, light, electron beam or heat is applied to the obtained film to polymerize and cure the film.

When the film is polymerized and cured by light, a known light source such as a mercury lamp or a metal halide lamp is used.

When the film is polymerized and cured by heat, the heating condition is preferably 50° C. or higher. If the temperature is lower than this temperature, the duration of life of the cured film is shorter and so not preferred. In particular, it is preferred that the heating temperature is 100° C. or higher and 170° C. or lower from the point of reactivity, strength and electric characteristics of the manufactured photoreceptor.

Further, when the film is polymerized and cured by electron beam, an electron beam irradiation apparatus is used. For the acceleration of reaction, heating may also be performed at the same time.

In polymerization and curing reaction as above, the reaction is carried out in vacuum or an inert gas atmosphere of oxygen concentration of preferably 10% or less, more preferably 5% or less, still more preferably 2% or less, and most preferably low oxygen concentration of 500 ppm or lower, so that chain reaction can be performed without deactivation of generated radicals by light, electron beam or heat.

In this embodiment, as described above, a film is cured by radical polymerization caused by the application of heat, light or radiation, but if the reaction advances too rapidly, it is difficult to bring about structural relaxation of the film by crosslinking, and unevenness and wrinkles of the film are liable to occur. Accordingly, it is preferred to use curing by heat to cause radical generation relatively slowly. In particular, the specific charge transporting materials (a) contains a methacryloyl group that is lower in reactivity than an acryloyl group. Structural relaxation of the film is expedited by the combination of the methacryloyl group with curing by heat, and protective layer 5 (outermost layer) excellent in a surface property and uniformity can be obtained.

On the other hand, when the film is cured by light and electron beam, reaction speed is rapid and molecular movement is liable to be congealed in a short time, and functional groups tend to remain. Further, since crosslinking reaction occurs before generation of structural relaxation, the obtained film is liable to be a film with much residual distortion, and insufficient in film uniformity of the surface and internal uniformity of the composition.

The example of a function-separating type photosensitive layer was explained above with reference to electrophotographic photoreceptor 7A shown in FIG. 1. In the case of a monolayer type photosensitive layer 6 (a charge generating/charge transporting layer) of electrophotographic photoreceptor 7C shown in FIG. 3, the following embodiment is preferred.

That is, the content of a charge generating material in monolayer type photosensitive layer 6 is 10% by weight or more and 85% by weight or less or the like, and preferably 20% by weight or more and 50% by weight or less. The content of a charge transporting material is preferably 5% by weight or more and 50% by weight or less. The method of forming the monolayer type photosensitive layer 6 (a charge generating/charge transporting layer) is the same as the forming methods of charge generating layer 2 and charge transporting layer 3. The thickness of monolayer type photosensitive layer 6 (a charge generating/charge transporting layer) is preferably 5 μm or more and 50 μm or less or the like, and more preferably 10 μm or more and 40 μm or less.

In the above, the embodiment in which the outermost layer comprising the cured film of the composition containing the specific charge transporting materials (a) is protective layer 5 is explained, but in the case of the layer constitution where protective layer 5 is not present, the charge transporting layer positioned on the outermost surface in the layer constitution is the outermost layer.

When the outermost layer is a charge transporting layer, the thickness of the layer is preferably 7 μm or more and 60 μm or less, and more preferably 8 μm or more and 55 μm or less.

<Conductive Substrate>

Examples of the conductive substrate 4 include metal plates, metal drums, and metal belts using metals such as aluminum, copper, zinc, stainless steel, chromium, nickel, molybdenum, vanadium, indium, gold, platinum or alloys thereof, and papers, plastic films and belts which are coated, deposited, or laminated with a conductive compound such as a conductive polymer and indium oxide, a metal such as aluminum, palladium and gold, or alloys thereof.

The term "conductive" means that the volume resistivity is less than $10^{13}$ Ωcm.

When the electrophotographic photoreceptor 7A is used in a laser printer the surface of the conductive substrate 4 is preferred to be roughened so as to have a centerline average roughness (Ra) of 0.04 μm to 0.5 μm in order to prevent interference fringes which are formed when irradiated by laser light. If Ra is less than 0.04 μm, the surface is almost a mirror surface and may not exhibit satisfactory effect of interference prevention. If Ra exceeds 0.5 μm, the image quality tends to become rough even if a film is formed. When an incoherent light source is used, surface roughening for preventing interference fringes is not necessary, and occurrence of defects due to the irregular surface of the conductive substrate 4 can be prevented to achieve a longer service life.

Preferred examples of the method for surface roughening include wet honing in which an abrasive suspended in water is blown onto a support, centerless grinding in which a support is continuously ground by pressing the support onto a rotating grind stone, and anodic oxidation.

As another method of surface roughening, a method of surface roughening by forming on the substrate surface a layer of resin in which conductive or semiconductive particles are dispersed in the resin so that the surface roughening is achieved by the particles dispersed in the layer, without roughing the surface of the conductive substrate 4, is also preferably used.

In the surface-roughening treatment by anodic oxidation, an oxide film is formed on an aluminum surface by anodic oxidation in which the aluminum as anode is anodized in an electrolyte solution. Examples of the electrolyte solution include a sulfuric acid solution and an oxalic acid solution.

However, the porous anodic oxide film formed by anodic oxidation without modification is chemically active, easily contaminated and has a large resistance variation depending on the environment. Therefore, it is preferable to conduct a sealing treatment in which fine pores of the anodic oxide film are sealed by cubical expansion caused by a hydration in pressurized water vapor or boiled water (to which a metallic salt such as a nickel salt may be added) to transform the anodic oxide into a more stable hydrated oxide.

The thickness of the anodic oxide film is preferably 0.3 μm to 15 μm. When the thickness of the anodic oxide film is less than 0.3 μm, the barrier property against injection may be low and fail to achieve sufficient effects. If the thickness of the anodic oxide film exceeds 15 μm, the residual potential tends to be increased due to the repeated use.

The conductive substrate 4 may be subjected to a treatment with an acidic aqueous solution or a boehmite treatment. The treatment with an acidic treatment solution comprising phosphoric acid, chromic acid and hydrofluoric acid is carried out as follows: phosphoric acid, chromic acid, and hydrofluoric acid are mixed to prepare an acidic treatment solution preferably in a mixing ratio of 10 to 11% by weight of phosphoric acid, 3 to 5% by weight of chromic acid, and 0.5 to 2% by weight of hydrofluoric acid. The concentration of the total acid components is preferably in the range of 13.5 to 18% by weight.

The treatment temperature is preferably 42 to 48° C., and by keeping the treatment temperature high, a thicker film can be obtained more speedily compared to the case of a treatment temperature that is lower than the above range. The thickness of the film is preferably 0.3 to 15 μm. If the thickness of the film is less than 0.3 μm, the barrier property against injection may be low, and sufficient effects may not be achieved. If the thickness exceeds 15 μm, the residual potential due to repeated use may be increased.

The boehmite treatment is carried out by immersing the substrate in pure water at a temperature of 90 to 100° C. for 5 to 60 minutes, or by bringing it into contact with heated water vapor at a temperature of 90 to 120° C. for 5 to 60 minutes. The film thickness is preferably 0.1 to 5 μm. The film may further be subjected to anodic oxidation using an electrolyte solution which sparingly dissolves the film, such as adipic acid, boric acid, borate salt, phosphate, phthalate, maleate, benzoate, tartrate, and citrate solutions.

<Undercoating Layer>

The undercoating layer 1 comprises, for example, a binding resin containing inorganic particles.

The inorganic particles preferably have powder resistance (volume resistivity) of about $10^2$ to $10^{11}$ Ω·cm so that the undercoating layer 1 can obtain adequate resistance in order to achieve leak resistance and carrier blocking properties. If the resistance value of the inorganic particles is lower than the lower limit of the range, adequate leak resistance may not be achieved, and if higher than the upper limit of the range, increase in residual potential may be caused.

Preferred examples of the inorganic particles having the above resistance value include inorganic particles of tin oxide, titanium oxide, zinc oxide, and zirconium oxide, and most preferred is zinc oxide.

The inorganic particles may be the ones which are subjected to a surface treatment. Particles which are subjected to different surface treatments, or those having different particle diameters, may be used in combination of two or more kinds.

The volume average particle size of inorganic particles is desirably in the range of 50 nm or more and 2,000 nm or less, and more preferably 60 nm or more and 1,000 nm or less.

Inorganic particles having a specific surface area (measured by a BET analysis) of 10 $m^2/g$ or more are preferably used. When the specific surface area thereof is less than 10 $m^2/g$, lowering of the charging properties may easily be caused and the favorable electrophotographic characteristics may not be obtained.

By including inorganic particles and acceptive compounds, the undercoating layer which is superior in long-term stability of electrical characteristics and carrier blocking property can be achieved. Any acceptive compound by which desired characteristics can be obtained may be used, but preferred examples thereof include electron transporting substances such as quinone-based compounds such as chloranil and bromanil, tetracyanoquinodimethane-based compounds, fluorenone compounds such as 2,4,7-trinitrofluorenone and 2,4,5,7-tetranitro-9-fluorenone, oxadiazole-based compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole, xanthone-based compounds, thiophene compounds and diphenoquinone compounds such as 3,3',5,5'-tetra-t-butyldiphenoquinone, and particularly preferable are compounds having an anthraquinone structure. Still more preferred examples are acceptive compounds having an anthraquinone structure such as hydroxyanthraquinone-based compounds, aminoanthraquinone-based compounds, and aminohydroxyanthraquinone-based compounds, and specific examples thereof include anthraquinone, alizarin, quinizarin, anthrarufin, and purpurin.

The content of the acceptive compound may be determined as appropriate within the range where desired characteristics can be achieved, but preferably in the range of 0.01 to 20% by weight relative to inorganic particles, more preferably in the range of 0.05 to 10% by weight in terms of preventing accumulation of charge and aggregation of inorganic particles. The aggregation of the inorganic particles may cause irregular formation of conductive channels, deterioration of maintainability such as increase in residual potential, or image defects such as black points, when repeatedly used.

The acceptor compound may simply be added at the time of application of the undercoating layer, or may be previously attached to the surface of the inorganic particles. There are a dry method and a wet method as the method of attaching the acceptor compound to the surface of the inorganic particles.

When a surface treatment is conducted according to a dry method, the acceptor compound is added dropwise to the inorganic particles or sprayed thereto together with dry air or nitrogen gas, either directly or in the form of a solution in which the acceptor compound is dissolved in an organic solvent, while the inorganic particles are stirred with a mixer or the like having a high shearing force, whereby the particles are treated without causing irregular formation. The addition or spraying is preferably carried out at a temperature lower than the boiling point of the solvent. If the spraying is carried out at a temperature of not less than the boiling point of the solvent, there is a disadvantage in that the solvent may evaporate before the inorganic particles are stirred to prevent variation and the acceptor compound may coagulate locally so that the treatment without causing variation will be difficult to conduct, which is undesirable. After the addition or spraying of the acceptor compound, the inorganic particles may further be subjected to baking at a temperature of 100° C. or higher. The baking may be carried out as appropriate at a temperature and timing by which desired electrophotographic characteristics can be obtained.

When a surface treatment is conducted according to a wet method, the inorganic particles are dispersed in a solvent by means of stirring, ultrasonic wave, a sand mill, an attritor, a ball mill or the like, then the acceptor compound is added and the mixture is further stirred or dispersed, thereafter the solvent is removed, and thereby the particles are surface-treated without causing variation. The solvent is removed by filtration or distillation. After removing the solvent, the particles may be subjected to baking at a temperature of 100° C. or higher. The baking can be carried out at any temperature and timing in which desired electrophotographic characteristics can be obtained. In the wet method, the moisture contained in the inorganic particles can be removed prior to adding the surface treatment agent. The moisture can be removed by, for example, stirring and heating the particles in the solvent used for the surface treatment, or by azeotropic removal with the solvent.

The inorganic particles may be subjected to a surface treatment prior to the addition of the acceptor compound. The surface treatment agent may be any agent by which desired characteristics can be obtained, and can be selected from known materials. Examples thereof include silane coupling agents, titanate-based coupling agents, aluminum-based coupling agents and surfactants. Among these, silane coupling agents are preferably used by which favorable electrophotographic characteristics can be provided, and preferred examples are the silane coupling agents having an amino group that can impart favorable blocking properties to the undercoating layer 1.

The silane coupling agents having amino groups may be any compounds by which desired electrophotographic photoreceptor characteristics can be obtained. Specific examples thereof include γ-aminopropyltriethoxysilane, N-β-(aminoethyl)-γ-aminopropyltrimethoxysilane, N-β-(aminoethyl)-γ-aminopropylmethydilmethoxysilane, and N,N-bis(β-hydroxyethyl)-γ-aminopropyltriethoxysilane, but are not limited thereto.

The silane coupling agent may be used singly or in combination of two or more kinds thereof. Examples of the silane coupling agents which can be used in combination with the above-described silane coupling agents having an amino group include vinyltrimethoxysilane, γ-methacryloxypropyltris-(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane, but are not limited thereto.

The surface treatment method maybe any known dry or wet method. Addition of an acceptor and a surface treatment using a coupling agent or the like can be carried out simultaneously.

The content of the silane coupling agent relative to the inorganic particles contained in the undercoating layer 1 can be determined as appropriate within a range in which the desired electrophotographic characteristics can be obtained, but preferably 0.5% by weight to 10% by weight from the viewpoint of improving dispersibility.

In addition, binding resin may be contained in the undercoating layer 1.

As the binding resin contained in the undercoating layer 1, any known resin that can form a favorable film and achieve desired characteristics may be used. Examples thereof include known polymer resin compounds, e.g. acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins and urethane resins; charge transporting resins having charge transporting groups; and conductive resins such as polyaniline. Particularly preferred examples are resins which are insoluble in the coating solvent for the upper layer, specifically phenolic resins, phenol-formaldehyde resins, melamine resins, urethane resins, epoxy resins and the like. When these resins are used in combination of two or more kinds, the mixing ratio can be appropriately determined according to the circumstances.

The ratio of the inorganic particles imparted acceptor compounds on the surface (metal oxide imparted with the properties as an acceptor) to the binder resin, or the ratio of the inorganic particles to the binder resin, in the coating solution for forming the undercoating layer, can be appropriately determined within a range in which the desired electrophotographic photoreceptor characteristics can be obtained.

Various additives may be used for the undercoating layer 1 to improve electrical characteristics, environmental stability, or image quality. Examples of the additives include known materials such as the polycyclic condensed type or azo-based type of the electron transporting pigments, zirconium chelate compounds, titanium chelate compounds, aluminum chelate compounds, titanium alkoxide compounds, organic titanium compounds, and silane coupling agents. Silane coupling agents, which are used for surface treatment of metal oxides, may also be added to the coating solution as additives.

Specific examples of the silane coupling agents as an additive include vinyltrimethoxysilane, γ-methacryloxypropyltris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane. Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, isostearic acid zirconium, methacrylate zirconium butoxide, stearate zirconium butoxide, and isostearate zirconium butoxide.

Examples of the titanium chelate compounds include tetraisopropyl titanate, tetranormalbutyl titanate, butyl titanate dimer, tetra(2-ethylhexyl) titanate, titanium acetyl acetonate, polytitaniumacetyl acetonate, titanium octylene glycolate, titanium lactate ammonium salt, titanium lactate, titanium lactate ethyl ester, titanium triethanol aminato, and polyhydroxy titanium stearate.

Examples of the aluminum chelate compounds include aluminum isopropylate, monobutoxy aluminum diisopropylate, aluminum butylate, diethylacetoacetate aluminum diisopropylate, and aluminum tris(ethylacetoacetate).

These compounds may be used alone, or as a mixture or a polycondensate of two or more kinds thereof.

The solvent for preparing the coating solution for forming the undercoating layer may appropriately be selected from known organic solvents such as alcohol-based, aromatic, hydrocarbon halide-based, ketone-based, ketone alcohol-based, ether-based, and ester-based solvents. Examples thereof include common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

These solvents used for dispersion may be used alone or as a mixture of two or more kinds thereof. When they are mixed, any mixed solvents which can solve a binder resin can be used.

For dispersing inorganic particles in preparing the coating solution for forming an undercoating layer, well-known methods such as using a roll mill, a ball mill, a vibration ball mill, an attritor, a sand mill, a colloid mill, or a paint shaker are used.

Further, as the coating method in providing undercoating layer 1, ordinary methods such as a blade coating method, a wire bar coating method, a spray coating method, a dip coating method, a bead coating method, an air knife coating method, and a curtain coating method are used.

The undercoating layer 1 is formed on the conductive substrate using the coating solution obtained by the above-described method.

The Vickers hardness of the undercoating layer 1 is preferably 35 or more. The thickness of the undercoating layer 1 can be optionally determined within the range in which the desired characteristics can be obtained, but preferably 15 μm or more, more preferably 15 μm or more and 50 μm or less.

When the thickness of the undercoating layer 1 is less than 15 μm, sufficient antileak properties may not be obtained, while when the thickness of the undercoating layer 1 exceeds 50 μm, residual potential tends to remain during the long-term operation and cause the defects in image concentration.

The surface roughness of the undercoating layer 1 (ten point height of irregularities) is adjusted in the range of from 1/4n to 1/2λ, where λ represents the wavelength of the laser for exposure and n represents a refractive index of the upper layer, in order to prevent a moire image. Particles of a resin or the like may also be added to the undercoating layer for adjusting the surface roughness thereof. Examples of the resin particles include silicone resin particles and crosslinking polymethyl methacrylate resin particles.

The undercoating layer may be subjected to grinding for adjusting the surface roughness thereof. The method such as buffing, a sandblast treatment, a wet honing, a grinding treatment and the like can be used for grinding.

Undercoating layer 1 can be obtained by drying the undercoating layer-forming coating solution coated on conductive substrate 4, and generally drying is performed at a temperature capable of evaporating the solvents and forming a film.

<Charge Generating Layer>

The charge generating layer 2 contains a charge generating material and a binding resin. Examples of the charge generating material include azo pigments such as bisazo and trisazo pigments, condensed aromatic pigments such as dibromoantanthrone, perylene pigments, pyrrolopyrrole pigment, phthalocyanine pigment, zinc oxides, and trigonal selenium. For laser exposure in the near-infrared region, preferred examples of charge generating material are metal or nonmetal phthalocyanine pigments, and more preferred are hydroxy gallium phthalocyanine disclosed in Japanese Patent Application Laid-Open (JP-A) Nos. 5-263007 and 5-279591, chlorogallium phthalocyanine disclosed in JP-A No. 5-98181, dichlorotin phthalocyanine disclosed in JP-A Nos. 5-140472 and 5-140473, and titanyl phthalocyanine disclosed in JP-A No. 4-189873. For laser exposure in the near-ultraviolet region, preferred examples of charge generating material are condensed aromatic pigments such as dibromoantanthrone, thioindigo-based pigments, porphyrazine compounds, zinc oxides, trigonal selenium, and bisazo pigment disclosed in JP-A No. 2005-181992.

The binding resin used in the charge generating layer 2 can be selected from a wide range of insulating resins, and from organic light conductive polymers such as poly-N-vinyl carbazole, polyvinyl anthracene, polyvinyl pyrene, and polysilane. Preferable examples of the binding resin include polyvinyl butyral resins, polyarylate resins (polycondensates of bisphenols and aromatic divalent carboxylic acid or the like), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. These binding resins may be used alone or in combination of two or more kinds thereof. The blending ratio of the charge generating material and binder resin is preferably in the range of 10/1 to 1/10.

The term "insulating" means that the volume resistivity is $10^{13}$ Ωcm or more.

The charge generating layer 2 may be formed using a coating solution in which the above-described charge generating materials and binding resins are dispersed in a given solvent.

Examples of the solvent used for dispersion include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene, which may be used alone or in combination of two or more kinds.

For dispersing the charge generating materials and the binding resins in a solvent, ordinary methods such as ball mill dispersion, attritor dispersion and sand mill dispersion can be used. By these dispersion methods, deformation of crystals of the charge generating material caused by dispersion can be prevented. The average particle diameter of the charge generating material to be dispersed is preferably 0.5 μm or less, more preferably 0.3 μm or less and further preferably 0.15 μm or less.

For forming the charge generating layer 2, conventional methods such as blade coating, Meyer bar coating, spray coating, dip coating, bead coating, air knife coating or curtain coating can be used.

The film thickness of the charge generating layer 2 obtained by the above-described methods is preferably 0.1 μm to 5.0 μm and more preferably 0.2 μm to 2.0 μm.

<Charge Transporting Layer>

The charge transporting layer 3 is formed by including a charge transporting material and a binding resin, or including a high molecular charge transporting material.

Examples of the charge transporting material include electron transporting compounds such as quinone-based compounds such as p-benzoquinone, chloranil, bromanil, and anthraquinone, tetracyanoquinodimethane-based compounds, fluorenone compounds such as 2,4,7-trinitro fluorenone, xanthone-based compounds, benzophenone-based compounds, cyanovinyl-based compounds, and ethylene-based compounds; and hole transporting compounds such as triarylamine-based compounds, benzidine-based compounds, arylalkane-based compounds, aryl substituted ethylene-based compounds, stilbene-based compounds, anthracene-based compounds, and hydrazone-based compounds. These charge transporting materials may be used alone or in combination of two or more kinds thereof, but are not limited thereto.

The charge transporting material is preferably a triaryl amine derivative represented by the following Formula (a-1) and a benzidine derivative represented by the following Formula (a-2) from the viewpoint of charge mobility.

(a-1)

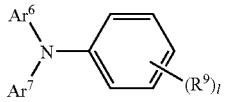

In formula (a-1), $R^9$ represents a hydrogen atom or a methyl group; l represents 1 or 2; each of $Ar^6$ and $Ar^7$ independently represents a substituted or unsubstituted aryl group, $—C_6H_4—C(R^{10})=C(R^{11})(R^{12})$, or $—C_6H_4—CH=CH—CH=C(R^{13})(R^{14})$; and each of $R^{10}$ to $R^{14}$ independently represents a hydrogen atom, a substituted or unsubstituted alkyl group, or a substituted or unsubstituted aryl group.

As the examples of the substituents of each of the above groups, a halogen atom, an alkyl group having 1 to 5 carbon atoms, an alkoxy group having 1 to 5 carbon atoms, and a substituted amino group substituted with an alkyl group having 1 to 3 carbon atoms are exemplified.

(a-2)

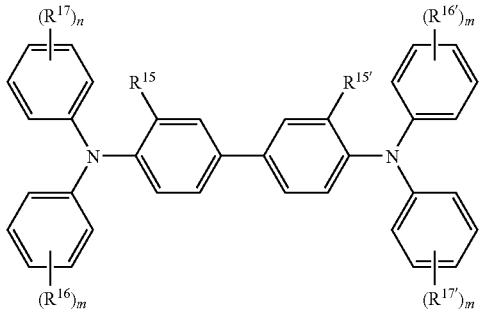

In formula (a-2), each of $R^{15}$ and $R^{15'}$ independently represents a hydrogen atom, a halogen atom, an alkyl group having 1 to 5 carbon atoms, or an alkoxy group having 1 to 5 carbon atoms; each of $R^{16}$, $R^{16'}$, $R^{17}$ and $R^{17'}$ independently represents a hydrogen atom, a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{18})=C(R^{19})(R^{20})$, or $—CH=CH—CH=C(R^{21})(R^{22})$; each of $R^{18}$ to $R^{22}$ independently represents a hydrogen atom, a substituted or unsubstituted alkyl group, or a substituted or unsubstituted aryl group; and each of m and n independently represents an integer of 0 to 2.

Among the triarylamine derivatives represented by the formula (a-1) and the benzidine derivatives represented by the formula (a-2), triarylamine derivatives having "$—C_6H_4—CH=CH—CH=C(R^{13})(R^{14})$" and benzidine derivatives having "$—CH=CH—CH=C(R^{21})(R^{22})$" are particularly preferable because they are excellent in charge mobility, adhesiveness to the protective layer, and prevention of ghost development caused by the residue of the preceding image.

Examples of the binding resin used in the charge transporting layer 3 include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinyl carbazole and polysilane. Among these, polycarbonate resins and polyarylate resins are excellent in charge transportability and compatibility with charge transporting material, and so preferred. These binding resins may be used alone or in combination of two or more kinds thereof. The mixing ratio between the charge transporting material and the binding resin is preferably 10:1 to 1:5 by weight ratio.

For providing a protective layer (outermost layer) comprising a cured film of the composition containing specific charge transporting materials (a) on charge transporting layer 3, it is preferred for the binder resin used in charge transporting layer 3 to have a viscosity average molecular weight of 50,000 or more, and more preferably 55,000 or more. By using the binder resin having such a molecular weight, excellent adhesive property and cracking resistance in forming a protective layer (outermost layer) can be obtained, and so preferred.

Incidentally, the least upper bound of the viscosity average molecular weight of the binder resin for use in charge transporting layer 3 is preferably 100,000 from the aspect of film uniformity (liquid dripping).

The viscosity average molecular weight of the binder resin in this embodiment is a value measured with a capillary viscometer.

From the same reason, when the outermost layer is a charge transporting layer, the viscosity average molecular weight of the binder resin contained in the lower layer thereof is preferably in the above range.

As the charge transporting material, polymer charge transport materials can also be used. As the high molecular charge transporting material, known materials having charge transporting properties such as poly-N-vinyl carbazole and polysilane can be used. Polyester-based high molecular charge transporting materials disclosed in JP-A Nos. 8-176293 and 8-208820, having high charge transporting properties, are particularly preferred. Charge transporting polymer materials can form a film independently, but may also be mixed with the above-described binding resin to form a film.

The charge transporting layer 3 can be formed using the coating solution containing the above-described constituents. Examples of the solvent used for the coating solution for forming the charge transporting layer include ordinary organic solvents such as aromatic hydrocarbons such as benzene, toluene, xylene and chlorobenzene, ketones such as acetone and 2-butanone, aliphatic hydrocarbon halides such as methylene chloride, chloroform and ethylene chloride, cyclic or straight-chained ethers such as tetrahydrofuran and ethyl ether. These solvents may be used alone or in combination of two or more kinds thereof. Known methods can be used for dispersing the above-described constituents.

For applying the coating solution for forming the charge transporting layer onto the charge generating layer 2, ordinary methods such as blade coating, Meyer bar coating, spray coating, dip coating, bead coating, air knife coating and curtain coating can be used.

The film thickness of the charge transporting layer 3 is preferably 5 μm to 50 μm and more preferably 10 μm to 30 μm.

The electrophotographic photoreceptor in another embodiment of an aspect of the invention and the manufacturing method of the same will be described below.

(Electrophotographic Photoreceptor and Manufacturing Method of The Same)

The electrophotographic photoreceptor according to another embodiment (hereinafter also referred to as "this embodiment") is an electrophotographic photoreceptor comprising at least an electrically conductive substrate and a photosensitive layer provided on the conductive substrate, wherein at least one layer provided on the conductive substrate comprises a cured film of a composition containing a charge transporting material represented by the aforementioned formula (A) and not containing a polymerization initiator.

According to the above structure, the electro-photographic photoreceptor of this embodiment is capable of thickening the thickness of a layer provided on a conductive substrate such as a photosensitive layer, restraining electric characteristics and image properties from deteriorating due to repeated use for long, and obtaining stable images.

A method for manufacturing the electro-photographic photoreceptor of this embodiment comprises the above processes of using a composition containing a charge transporting material represented by formula (A) and not containing a polymerization initiator, and applying heat energy and light energy at the same time to harden the composition to obtain an electrophotographic photoreceptor.

When a polymerizable material is polymerized, a polymerization initiator such as a photopolymerization initiator is generally used. However, in an electro-photographic photoreceptor, when a cured product such as a photosensitive layer is formed by optically curing a film comprising a composition containing a photopolymerization initiator and a polymerizable material, thickening of the film is liable to be particularly difficult. The reason for this is probably due to the fact that light is absorbed by the photo-polymerization initiator in the vicinity of the exposure surface of the film and light substantially does not reach the inside of the film, therefore polymerization reaction does not sufficiently advance.

However, the composition containing the charge transporting material represented by formula (A) in this embodiment can be cured even when a polymerization initiator is not contained, originating in the specific structure of the charge transporting material. In forming a photosensitive layer or the like, such curing is carried out by the application of heat energy and light energy at the same time to the composition (film) containing the charge transporting material represented by formula (A) and not containing a polymerization initiator coated on a conductive substrate. Since activation effect can be obtained by not only light energy but also heat energy by this processing, even if light energy reaching the inside of the film is weak, reaction sufficiently advances by heat energy and thickening of the photosensitive layer can be done. Furthermore, it is presumed that light absorption by photopolymerization initiator at the surface of the film is restrained, so that light easily reaches the inside of the film.

In this embodiment, it is desired to use a composition containing a polymerizable monomer having charge transportability such as a charge transporting material represented by formula (A) alone. By using the polymerizable monomer having charge transportability alone, probably charge transferability is secured and electric characteristics of the photoreceptor are excellent. Further, the number of functional groups in a polymerizable monomer having charge transportability is preferably trifunctional, and more preferably tetrafunctional or higher. By the use of a monomer having a tetrafunctional or higher polyfunctional group as a polymerizable monomer having charge transportability, it becomes possible to contrive to obtain high strength and long duration of life.

More specifically, as a charge transporting material represented by formula (A), it is preferred that the total number of D in formula (A) is 4 or more, i.e., the material is preferably a compound having a triphenylamine structure and four or more methacryloyl groups in one and the same molecule.

By the fact that the material is a compound having a triphenylamine structure and four or more methacryloyl groups in one and the same molecule, stability at the time of synthesis can be secured and production on an industrial scale is possible. In addition, when light energy and heat energy are applied at the same time, a double bonding site in the compound is properly activated, so that a photoreceptor reconciling sufficient mechanical strength and electric characteristics is obtained. Since electric characteristics and mechanical strength of the photoreceptor are sufficiently secured, a binder resin and a monomer can be added from the aspect of the improvements of a gas barriering property and an adhesion property. Since the compound having a triphenylamine structure and four or more methacryloyl groups in one and the same molecule has a charge transporting structure unlike polyfunctional monomers not having charge transportability, the compound is excellent in compatibility with conventional charge transporting materials not having a reactive group, and capable of doping conventional charge transporting materials not having a reactive group to contrive further betterment of electric characteristics.

The mechanism that the polymerization reaction of the composition containing a charge transporting material represented by formula (A) of this embodiment advances even when the composition does not contain a polymerization initiator is not clearly known, but it is presumed as follows.

That is, the fundamental structural part of a charge transporting material represented by formula (A) has a characteristic of absorbing light of wavelengths of 300 to 500 nm. Therefore, the fundamental structural part is activated by irradiation with light energy and, the part of (meth)acryl group contained in D in formula (A) via bonding is also activated. It is presumed that in the composition containing a charge transporting material represented by formula (A), polymerization reaction hardly advances by the application of light energy alone, but by the application of heat energy in addition to light energy at the same time, the composition is activated sufficiently to progress polymerization reaction even if a polymerization initiator is not contained, so that polymerization reaction progresses.

In the specification of the invention, the terminology "application of heat energy and light energy at the same time" means that in curing a composition containing a charge transporting material represented by formula (A) and not containing a polymerization initiator, it is sufficient that the period of application of both heat energy and light energy at the same time is present. That is, as to initiation and termination of the application of heat energy or light energy, both of the application of heat energy and light energy may be initiated and terminated at the same time, or may be initiated or terminated either one first and the other later.

In this embodiment, it is a preferred mode to initiate application of heat energy first and then light energy is applied while maintaining the application of heat energy.

In the manufacturing method in this embodiment, a heating method utilizing, for example, an IH system may be used besides a heating method of using infrared in application of heat energy. Specifically, a heater and a high temperature drier are preferably used.

The heating time is preferably 10 seconds or more and 60 minutes or less.

The temperature of the surface of a photoreceptor at the time of curing is preferably 100° C. or more and 180° C. or less. When the temperature of the surface of a photoreceptor is less than 100° C., there is a case where curing does not advance and a photoreceptor having sufficient hardness is not obtained. While when the temperature of the surface of a photoreceptor exceeds 180° C., there is a case where the composition containing a charge transporting material represented by formula (A) is deteriorated due to heat and sufficient hardness cannot be obtained. The temperature of the surface of a photoreceptor at the time of curing is preferably 130° C. or more and 170° C. or less, and more preferably 140° C. or more and 160° C. or less.

In the manufacturing method of this embodiment, application of light is preferably performed with known exposure light sources such as a mercury lamp, a metal halide lamp, an LED, a semiconductor laser, or a deuterium lamp.

The exposure time is preferably 10 seconds or more and 60 minutes or less.

Further, in curing of the composition in this embodiment, the reaction is carried out in vacuum or an inert gas atmosphere of low oxygen concentration of preferably 10% or less, more preferably 5% or less, and still more preferably 2% or less, so that chain reaction can be performed without deactivation of radicals generated.

A layer formed of the composition in this embodiment maybe the outermost layer of a photoreceptor, or may be a layer formed between a conductive substrate and an outermost layer.

For example, as a layer formed of the composition in this embodiment, a layer functioning as a charge transporting layer, a layer functioning as a protective layer, and a layer uniting these functions are exemplified.

Of the compounds represented by formula (A), as the compounds in which the total number of D is 4 or more, the following compounds are exemplified.

IV-1

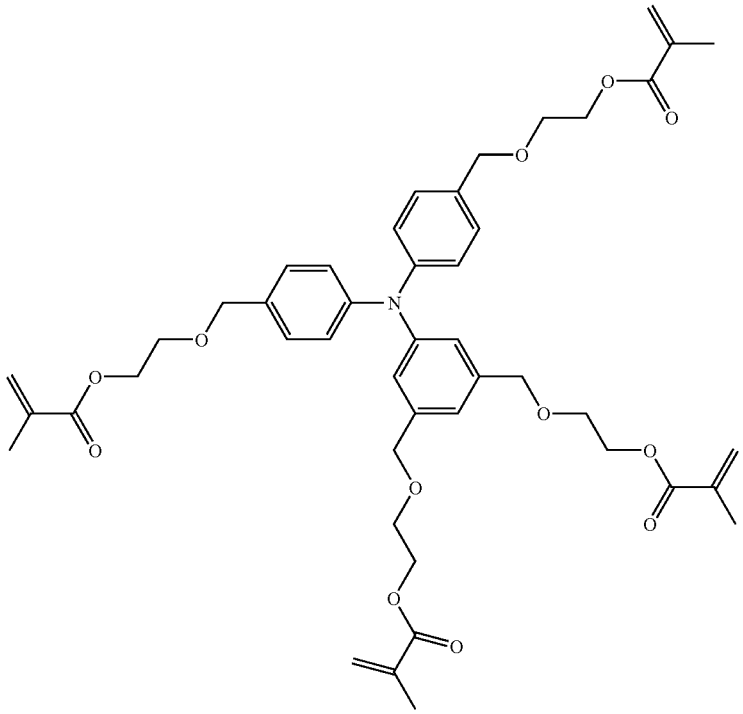

-continued
IV-2
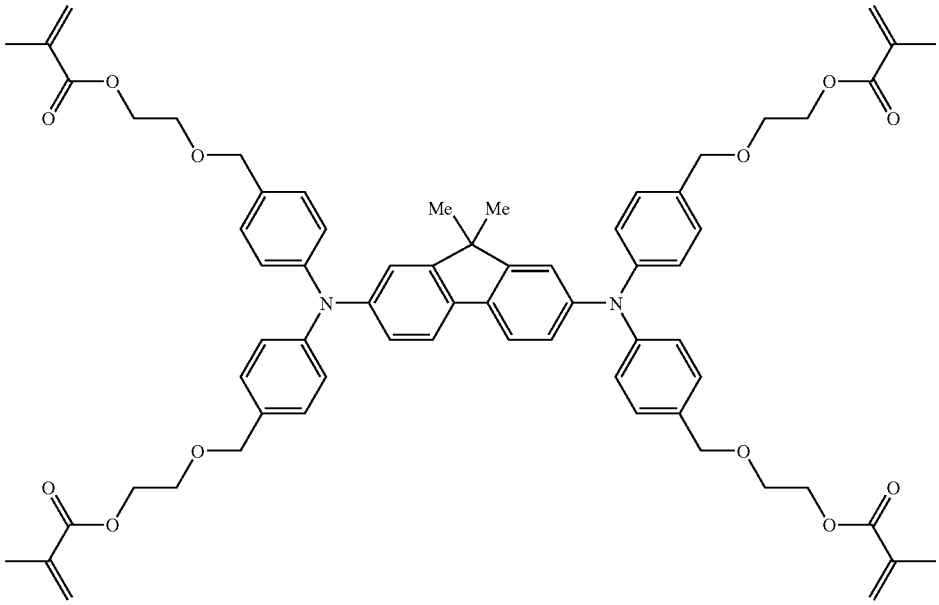
IV-3
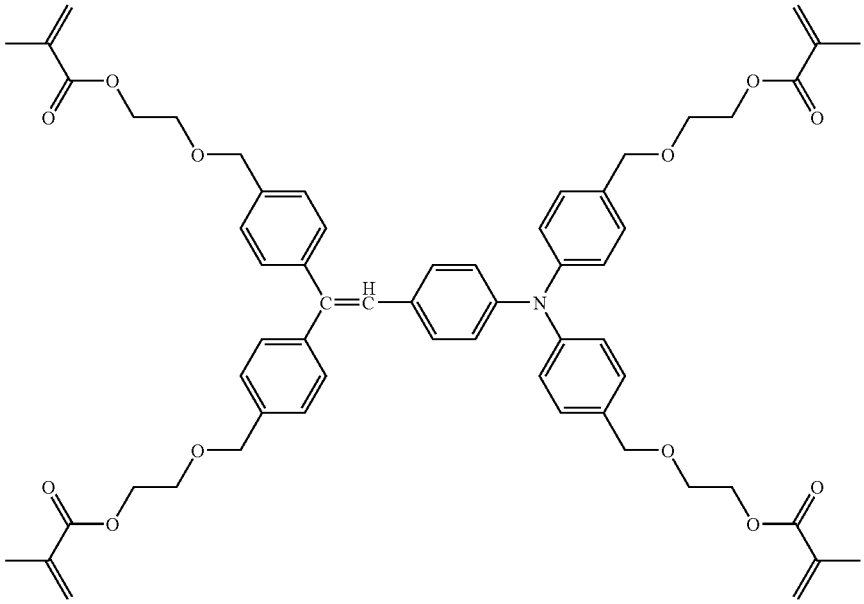

-continued
IV-4
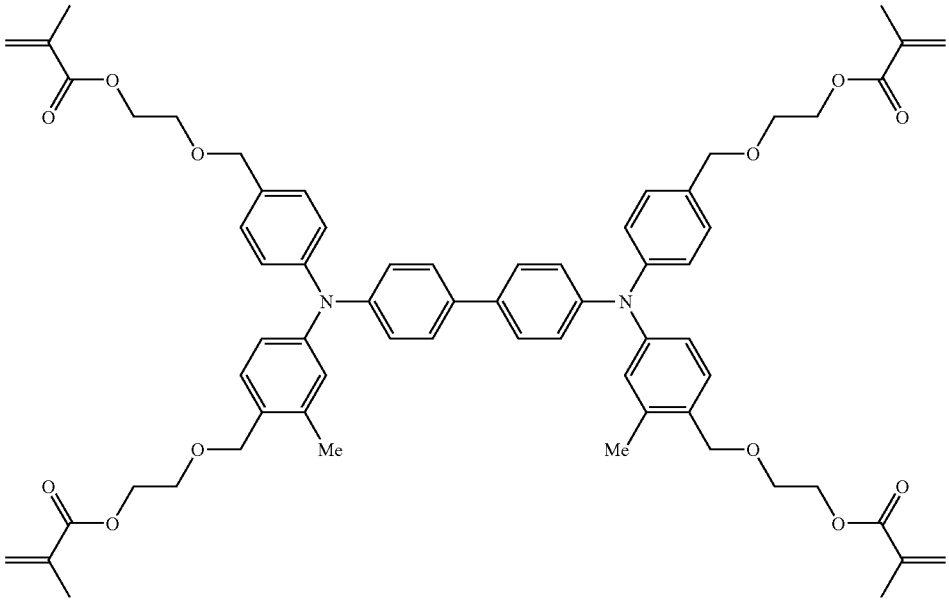
IV-5
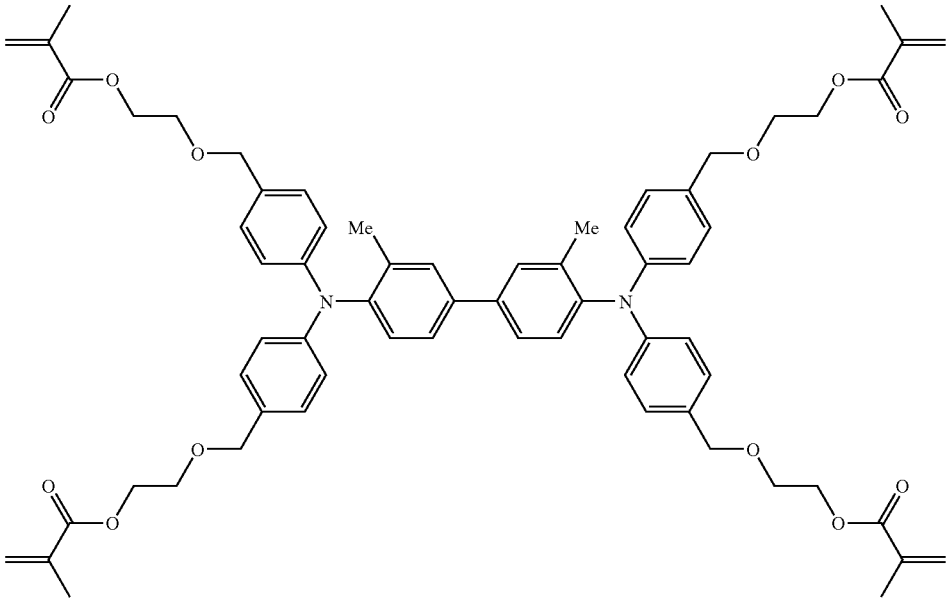

-continued
II-6
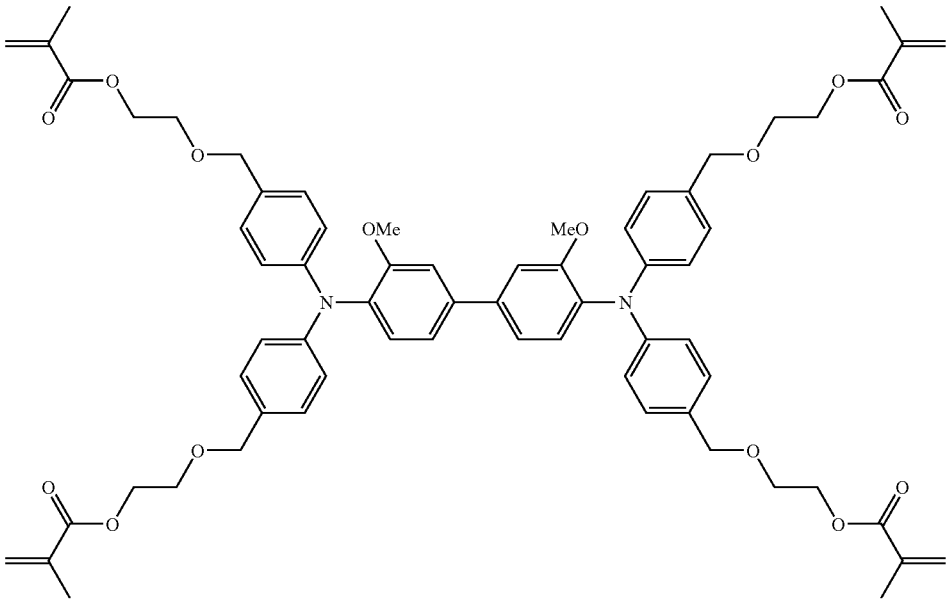
IV-7
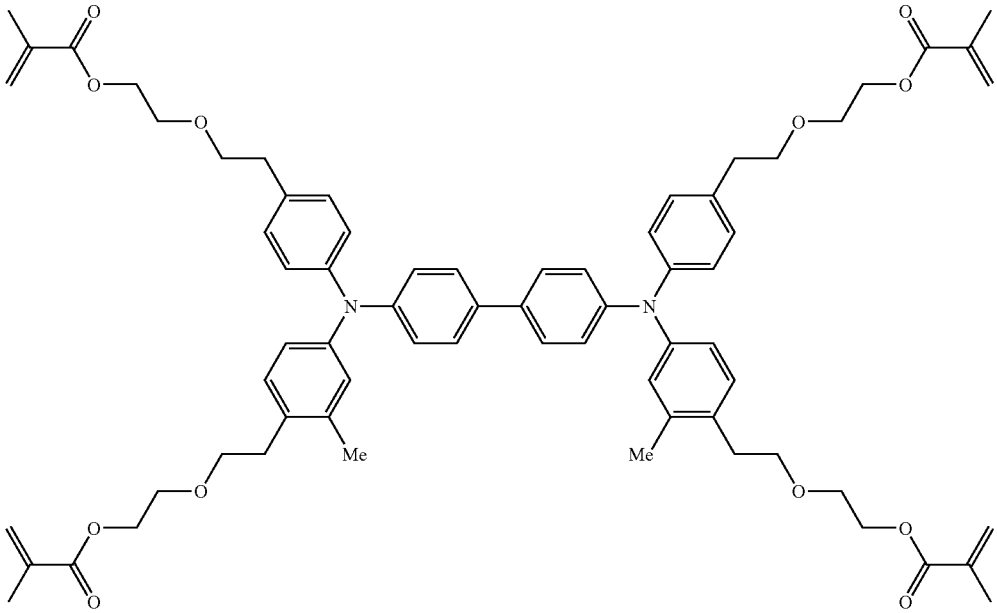

-continued
IV-8
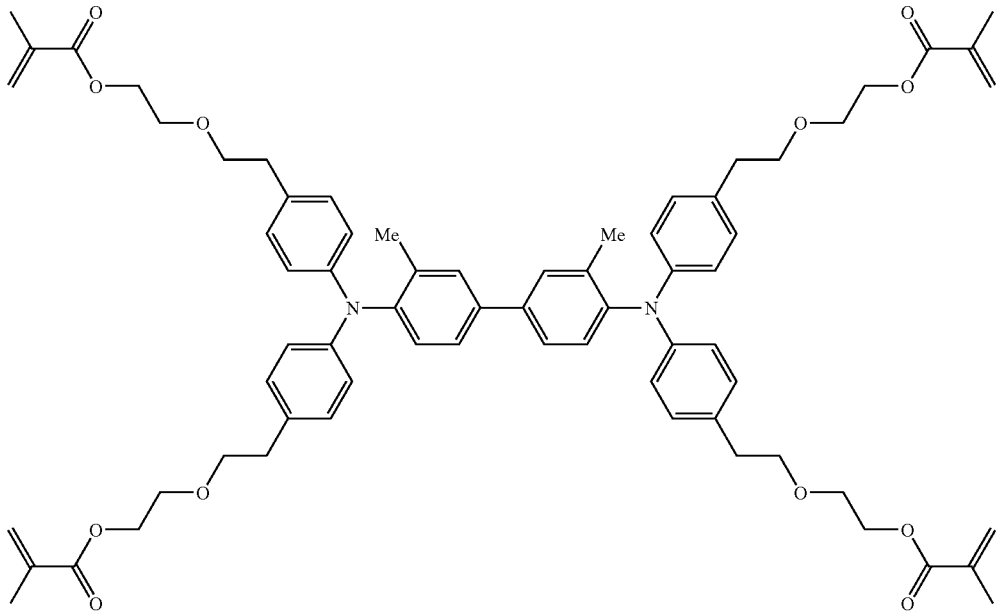
IV-9
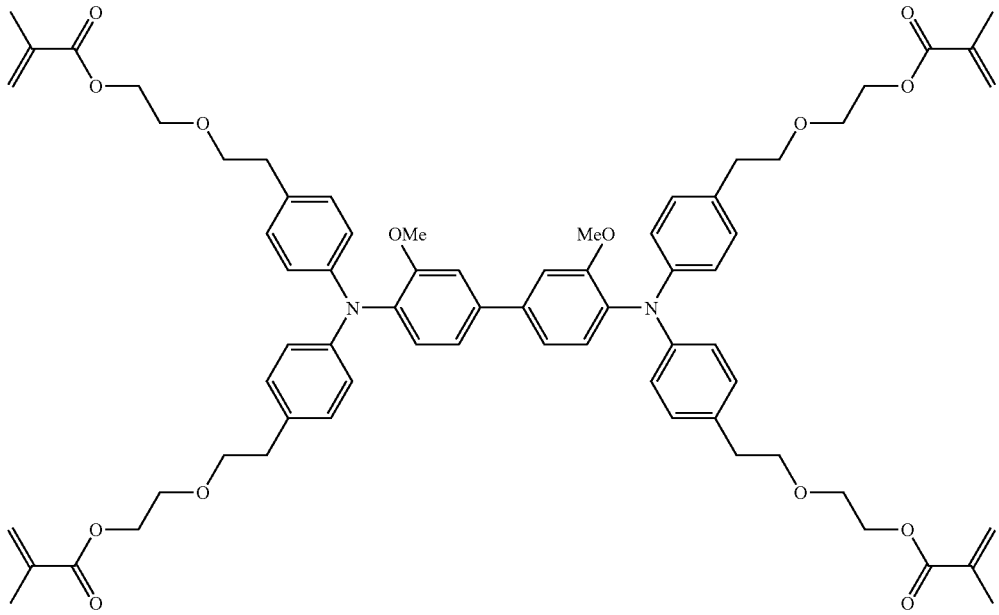

-continued
IV-10
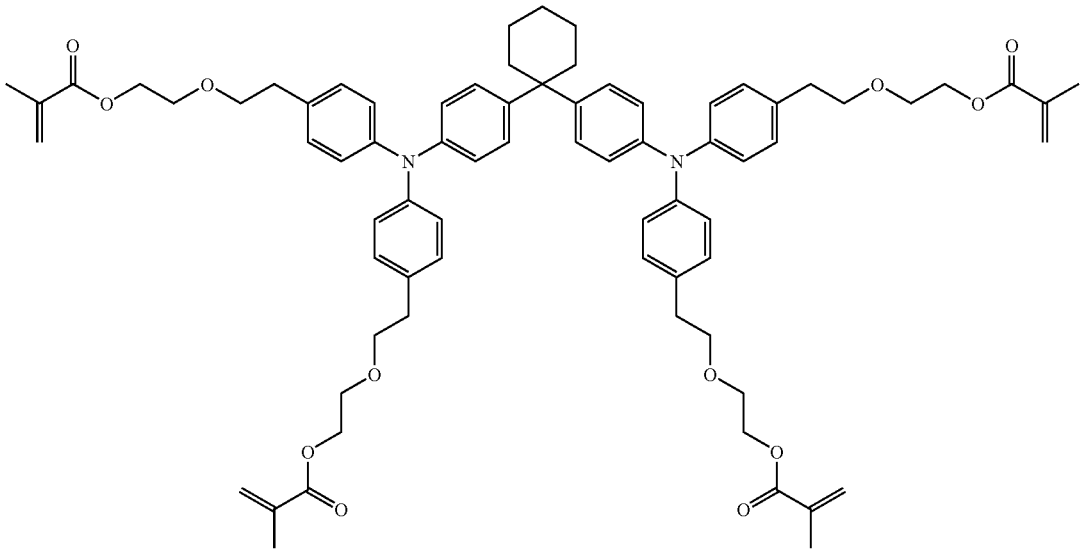
IV-11
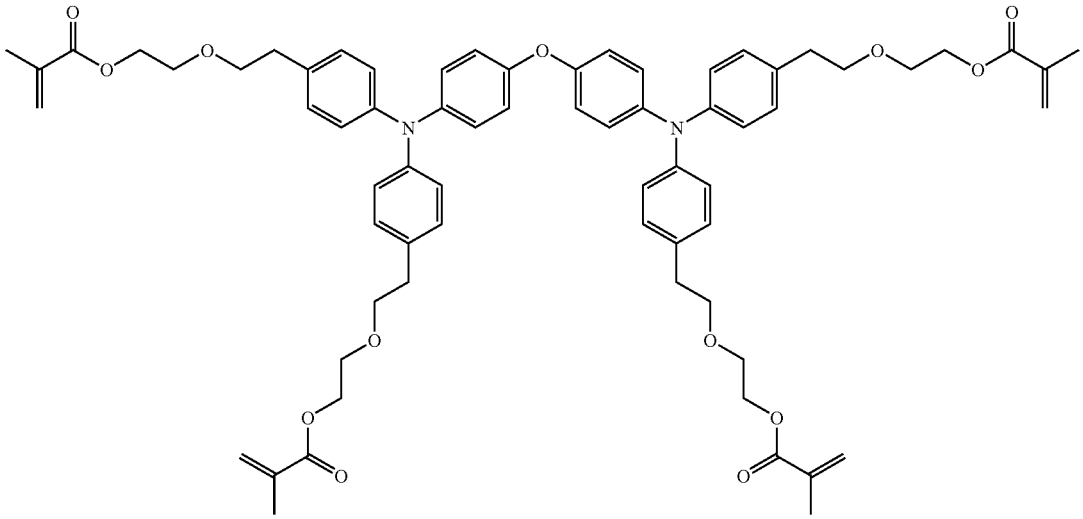

-continued
IV-12
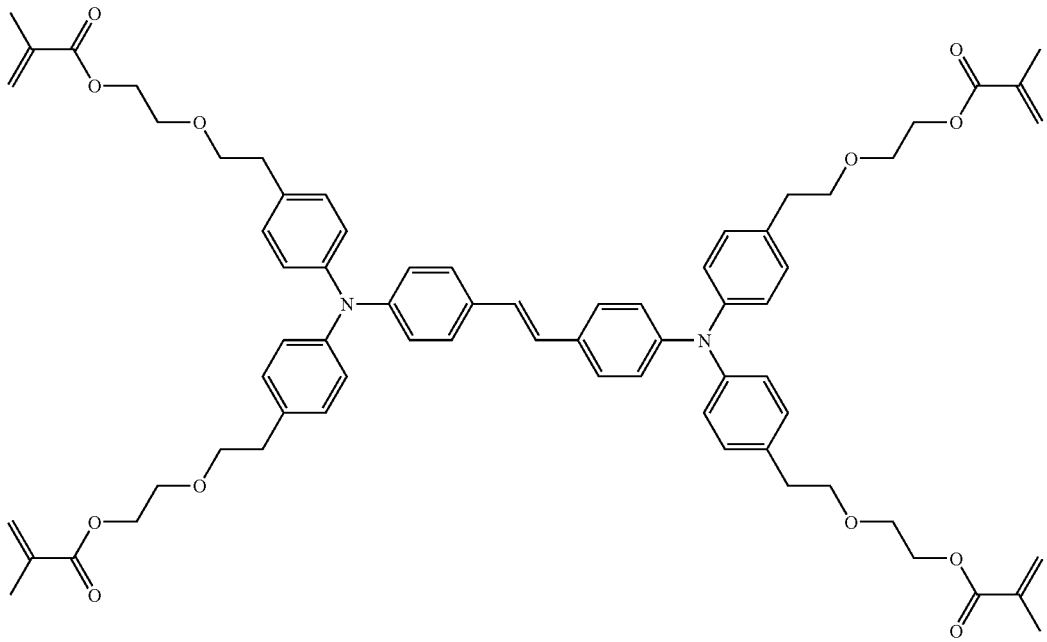
IV-13
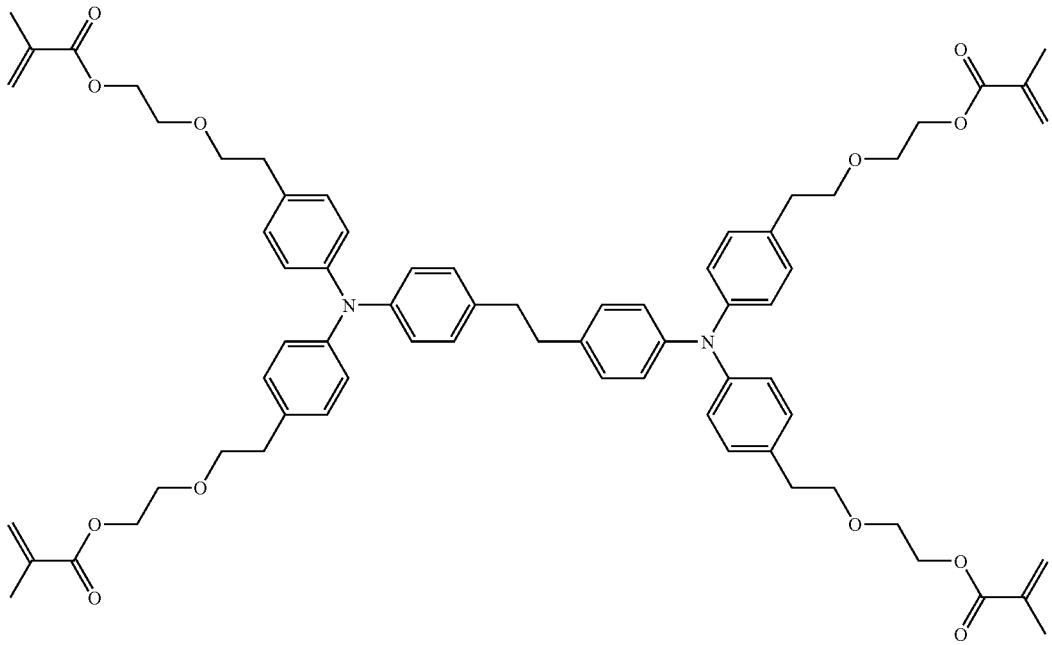

-continued
IV-14
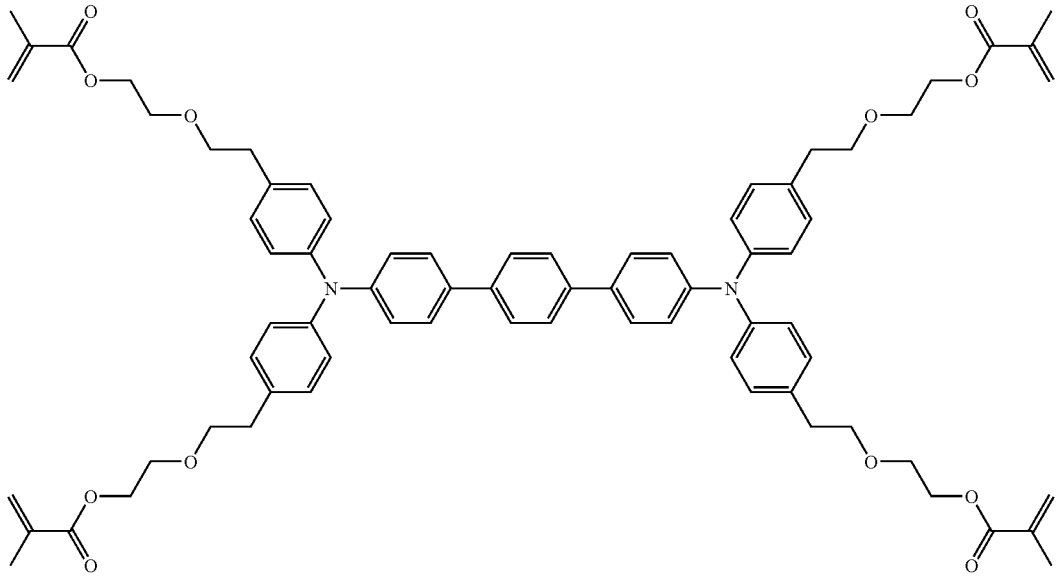
IV-15
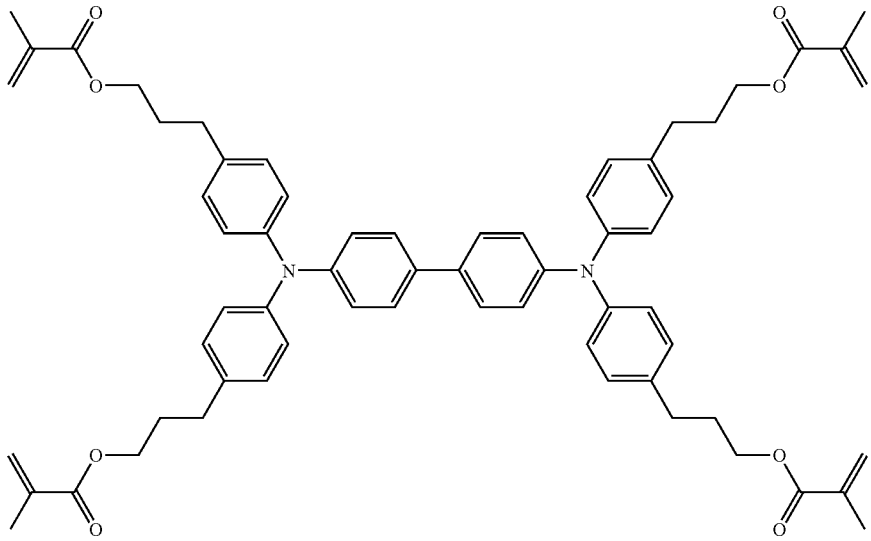
IV-16
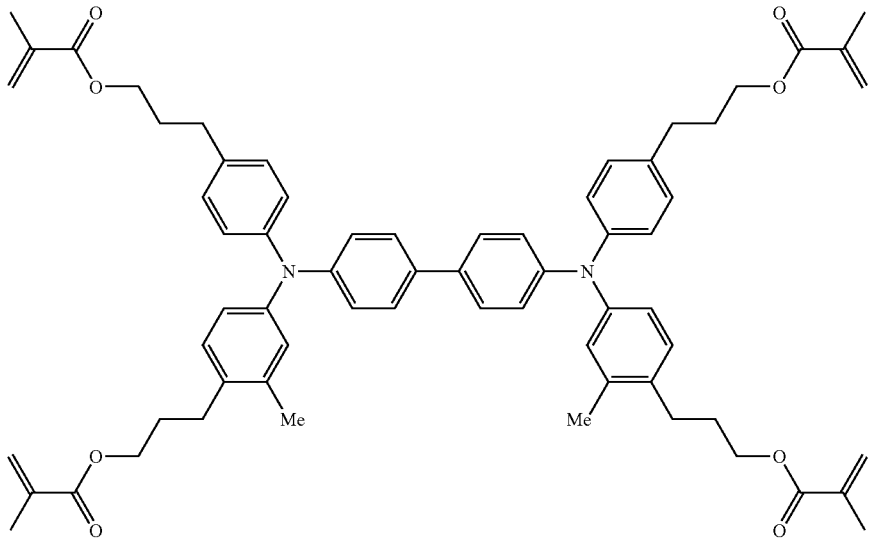

IV-17
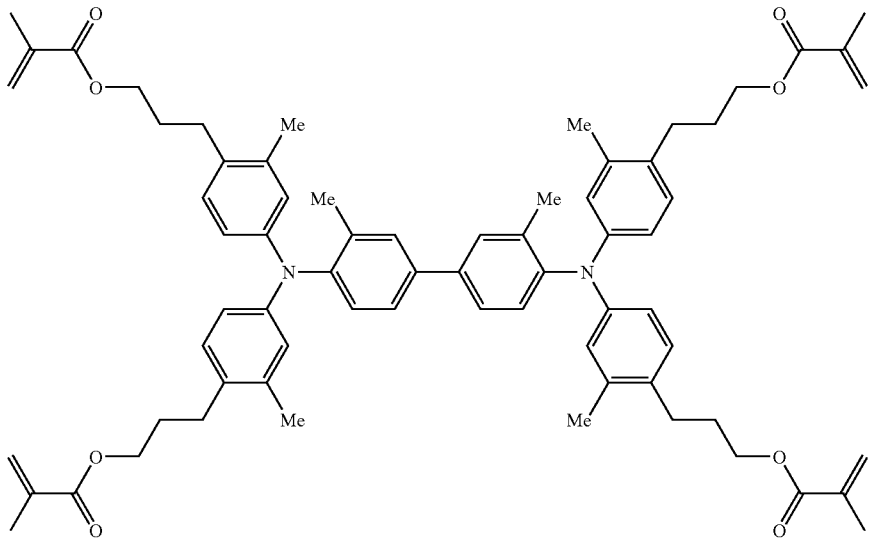
IV-18
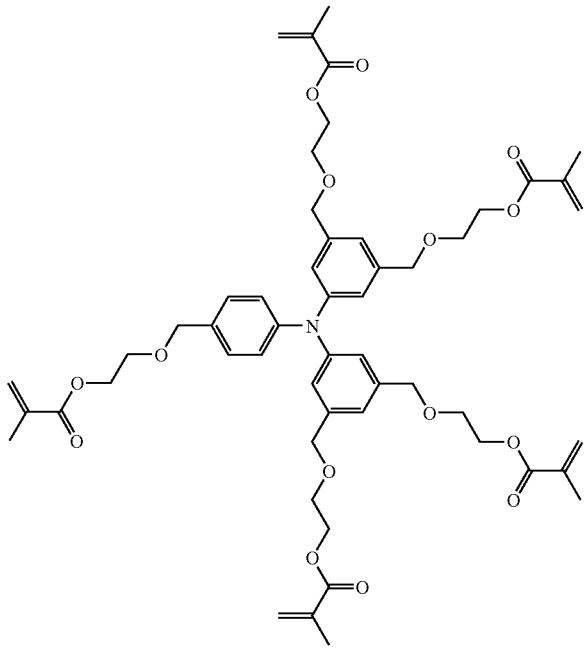

-continued

IV-19

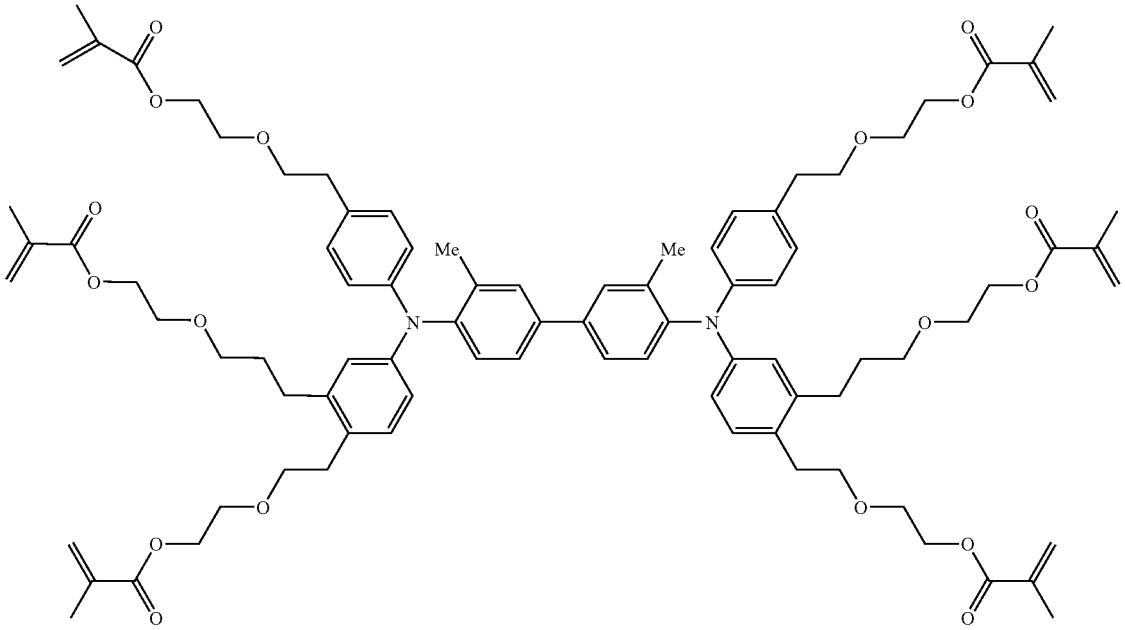

IV-20

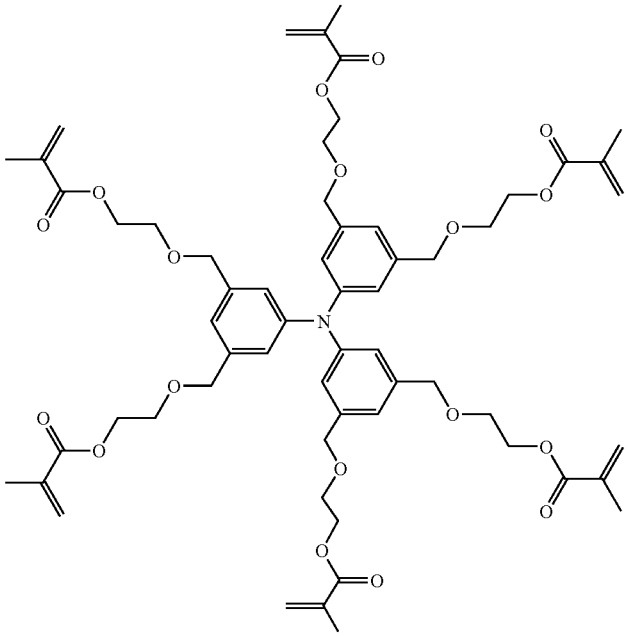

The constitution of the electrophotographic photoreceptor of this embodiment will be described in detail below with reference to the accompanying figures. Incidentally, in the figures, the same or corresponding parts are attached with the same signs and duplicating explanations are omitted.

Figure 10:
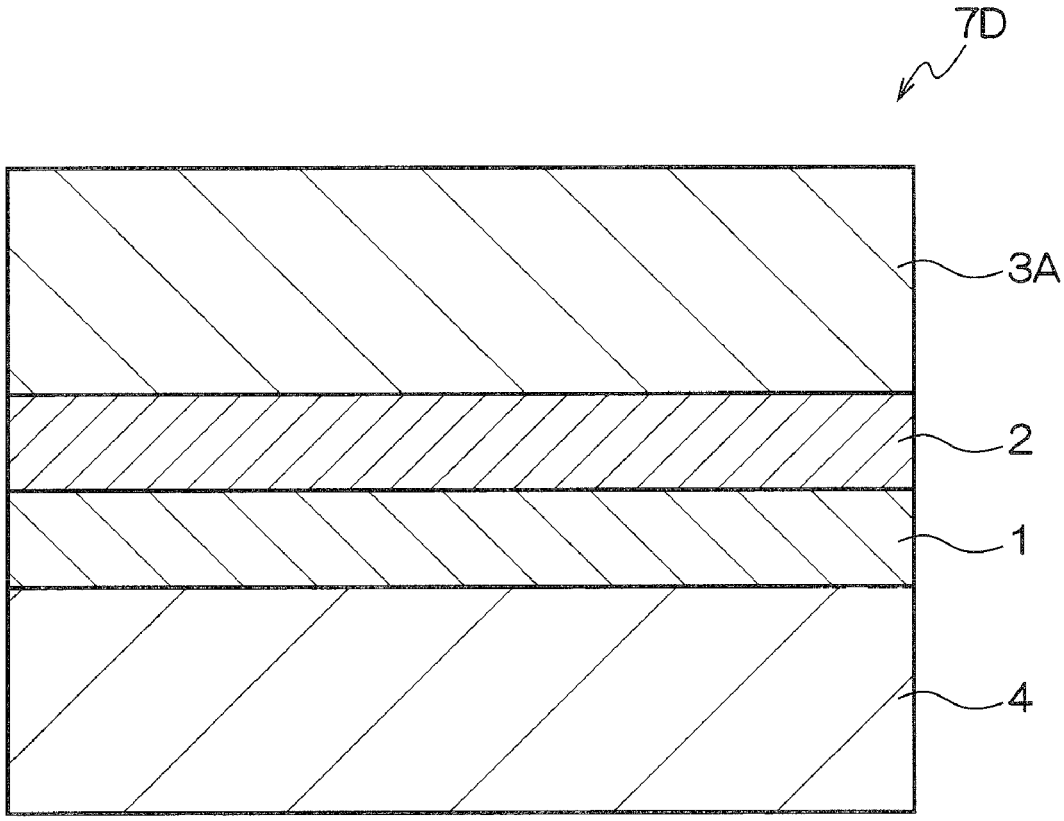
FIG. 10 is a schematic partial cross sectional drawing showing the electrophotographic photoreceptor concerning another embodiment of the aspect of the invention.
Figure 11:
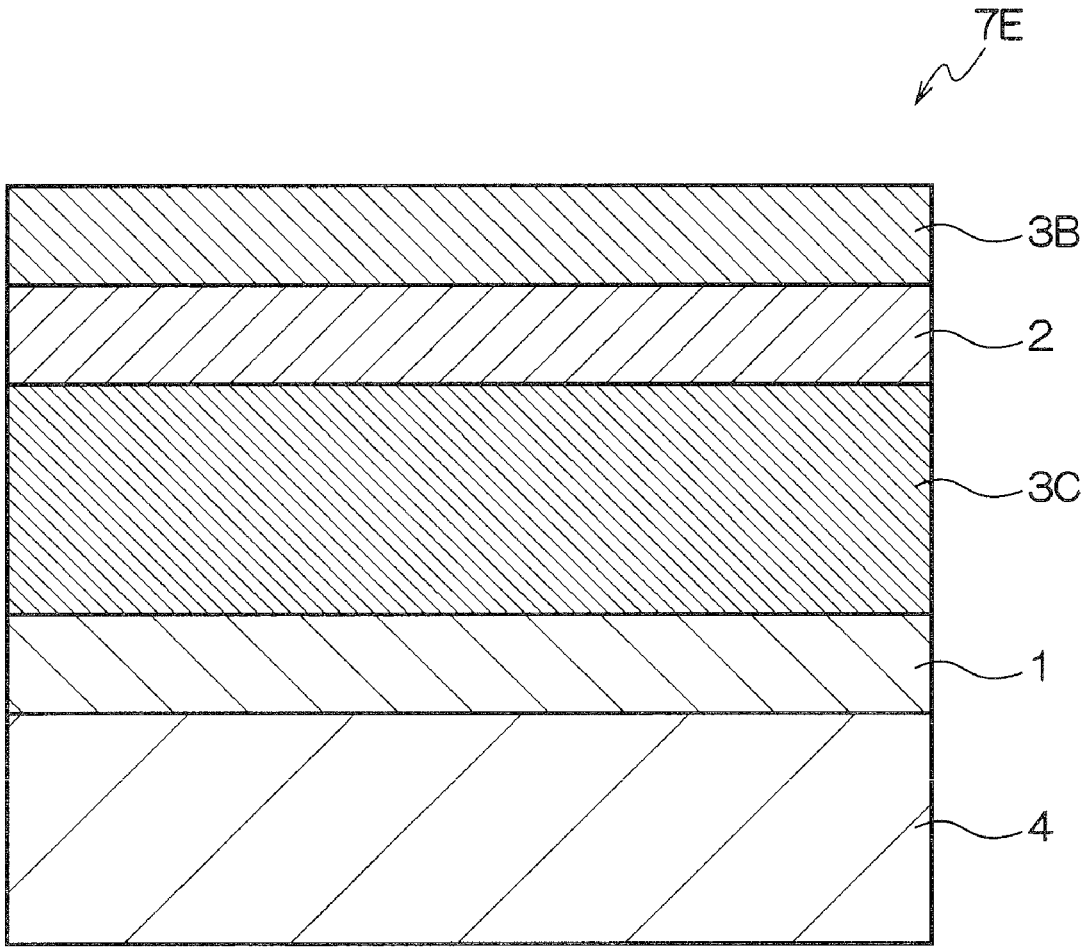
FIG. 11 is a schematic partial cross sectional drawing showing the electrophotographic photoreceptor concerning another embodiment of the aspect of the invention.
Figure 12:
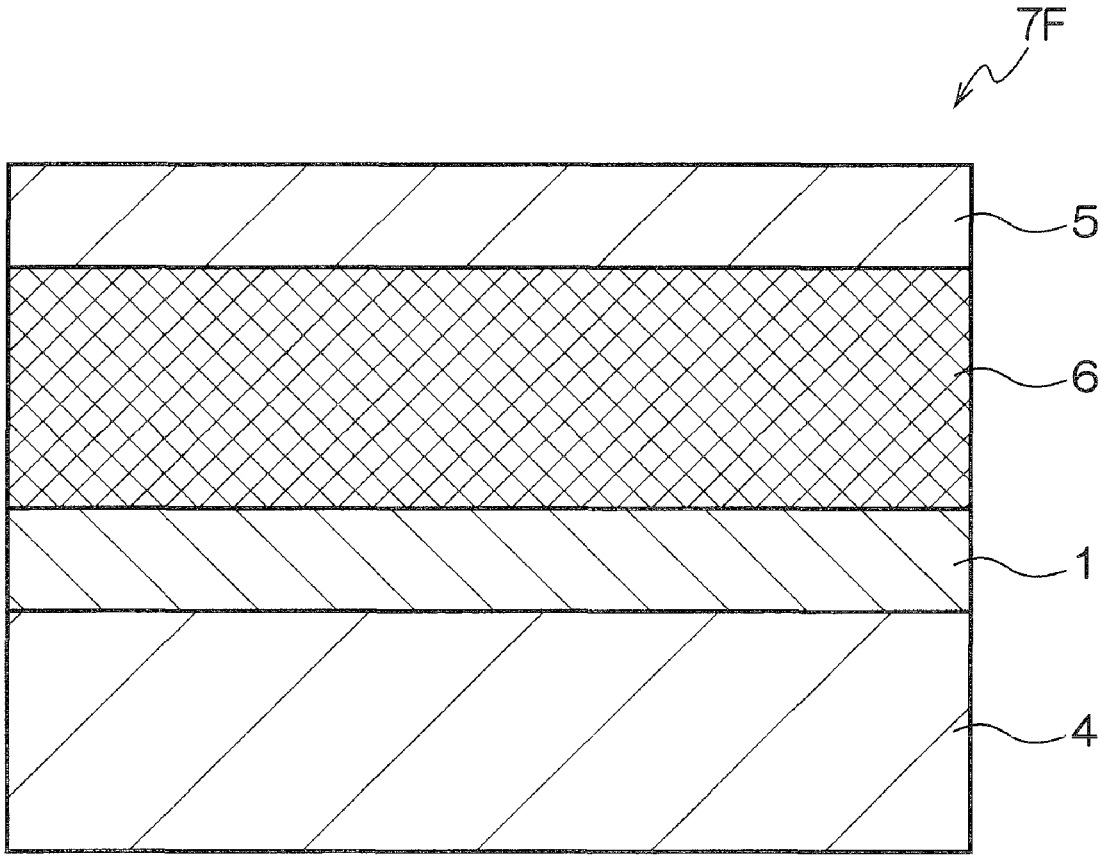
FIG. 12 is a schematic partial cross sectional drawing showing the electrophotographic photoreceptor concerning another embodiment of the aspect of the invention.

FIG. 10 is a typical cross sectional drawing showing a preferred embodiment of the electrophotographic photoreceptor of this embodiment. FIGS. 11 and 12 are typical cross sectional drawings of the electrophotographic photo-receptors of other embodiments.

Electrophotographic photoreceptor 7D shown in FIG. 10 is what is called a function separating type photoreceptor (or a lamination type photoreceptor) having a structure comprising conductive substrate 4 having thereon undercoating layer 1, and having formed thereon charge-generating layer 2, and charge transporting layer 3A in order. In electrophotographic photoreceptor 7D, a photosensitive layer is comprised of charge generating layer 2 and charge transporting layer 3A. Charge transporting layer 3A is provided as "a layer comprising the cured product of the composition containing the charge transporting material represented by formula (A) and not containing a polymerization initiator" of this embodiment.

Electrophotographic photoreceptor 7E shown in FIG. 11 is a function separating type photoreceptor similar to electrophotographic photoreceptor 7D shown in FIG. 10, wherein the functions are separated to charge generating layer 2 and charge transporting layers 3B and 3C having a structure comprising conductive substrate 4 having thereon undercoating layer 1, and having formed thereon non-crosslinking type charge transporting layer 3C, charge-generating layer 2, and crosslinking type charge transporting layer 3B in order. In electrophotographic photoreceptor 7E, the photosensitive layer consists of charge transporting layer 3C, charge generating layer 2, and charge transporting layer 3B. Further, charge transporting layer 3B is provided as "a layer comprising the cured product of the composition containing the charge transporting material represented by formula (A) and not containing a polymerization initiator" of this embodiment.

Electrophotographic photoreceptor 7F shown in FIG. 12 is a function-separating type photoreceptor containing a charge generating material and a charge transporting material in the same layer (a charge-generating/charge-transporting layer 6) having a structure comprising conductive substrate 4 having thereon undercoating layer 1, and having formed thereon charge-generating/charge-transporting layer 6, and protective layer 5 in order In electrophotographic photoreceptor 6F, a monolayer type photosensitive layer comprising charge-generating/charge-transporting layer 6 is constructed. Further, protective layer 5 is provided as "a layer comprising the cured product of the composition containing the charge transporting material represented by formula (A) and not containing a polymerization initiator" of this embodiment.

Charge transporting layer 3A in electro-photographic photoreceptor 7D and charge transporting layer 3B in electrophotographic photoreceptor 7E are respectively layers provided as the outermost layers of the photoreceptors and they are layers also having function of protective layers.

Although not shown in the figure, other layers such as a non-crosslinking type charge transporting layer may be provided between charge-generating layer 2 and charge transporting layer 3A in electrophotographic photoreceptor 7D.

In the electrophotographic photoreceptors shown in FIGS. 10 to 12, undercoating layer 1 may be provided or may not be provided.

Each element will be explained below based on electrophotographic photoreceptor 7D shown in FIG. 10 as a representative example.

Conductive substrate 4, undercoating layer 1, and charge-generating layer 2 in FIG. 10 can be manufactured, used and applied in the same manner as conductive substrate 4, undercoating layer 1, and charge-generating layer 2 in the aspect, and explanation is omitted to avoid duplication.

<Charge Transporting Layer>

Charge transporting layer 3A is a layer formed of a charge transporting material, and in this embodiment, it is a layer formed as a layer comprising the cured product of the composition containing the charge transporting material represented by formula (A) and not containing a polymerization initiator.

In addition to the charge transporting material represented by formula (A), the materials disclosed in the foregoing patents such as JP-A Nos. 5-216249, 2000-206715, 2004-12986, 7-72640, 2004-302450, 2000-206717, 2001-175016 and 2007-86522 may be used in charge transporting layer 3A.

In a coating solution for forming a charge transporting layer, the charge transporting material represented by formula (A) is contained in an amount of 30% by weight or more and 100% by weight or less based on all the solids content in the coating solution, preferably 40% by weight or more and 100% by weight or less, and more preferably 50% by weight or more and 100% by weight or less.

As the charge transporting material represented by formula (A) contained in the coating solution for forming a charge transporting layer, materials having the total number of D of 2 or more, i.e., those having 2 or more methacryloyl groups in one and the same molecule are preferred for heightening mechanical strength.

When a compound having a triphenylamine structure and four or more methacryloyl groups in one and the same molecule is used as the charge transporting material represented by formula (A), it is preferred for the compound to be used in an amount of 5% by weight or more based on all the solids content in the charge transporting layer-forming coating solution in view of strength, more preferably 10% by weight or more, and still more preferably 15% by weight or more.

The charge transporting layer-forming coating solution may contain, in addition to the compound represented by formula (A), a charge transporting material having one reactive group, a well-known charge transporting material not having a reactive group (hereinafter sometimes also referred to as "a non-crosslinking type charge transporting material"), or a reactive material not having charge transportability, according to necessity. Since such a material does not have a reactive group not having charge transportability, to use such a material is to substantially heighten the concentration of the charge transporting component in the photoreceptor, accordingly, it is effective to further improve electric characteristics. To use a reactive material not having charge transportability is also effective in regulating strength.

As the charge transporting materials having one reactive group, the following compounds are exemplified, but the invention is not restricted thereto.

I'-1

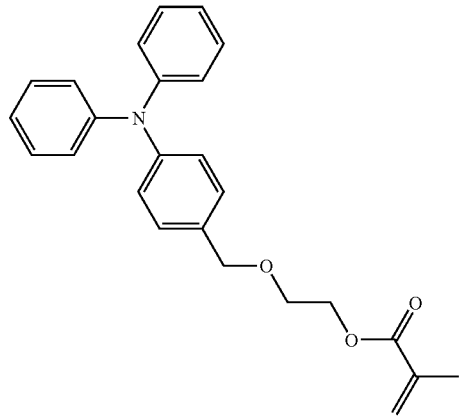

-continued
I'-2
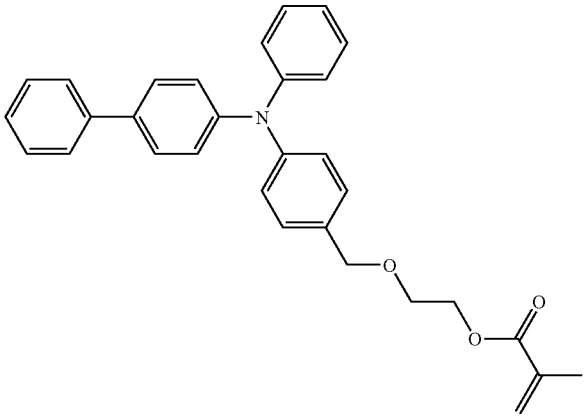
I'-3
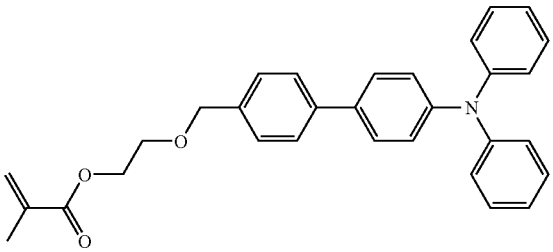
I'-4
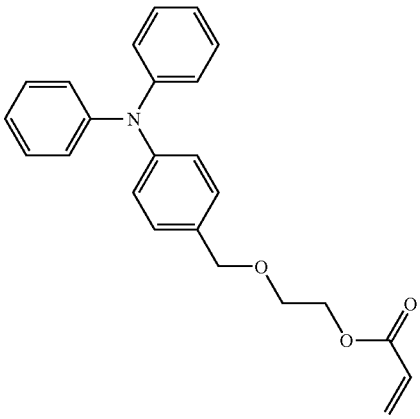
I'-5
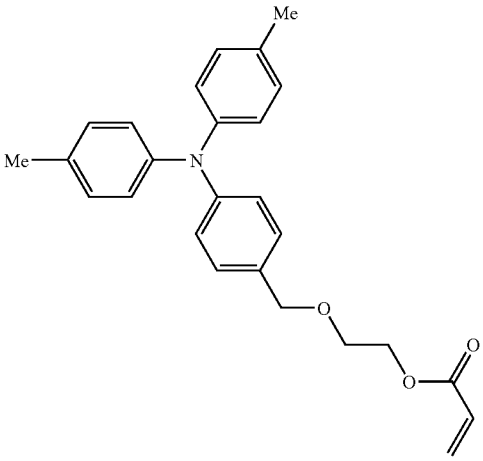

-continued
I'-6
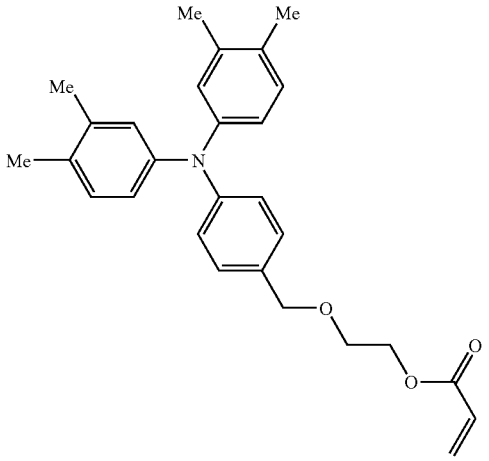
I'-7
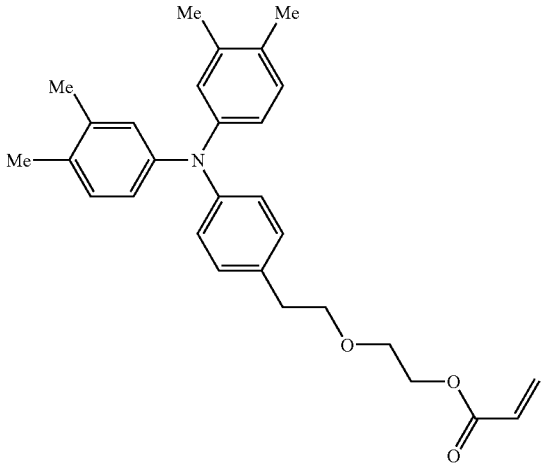
I'-9
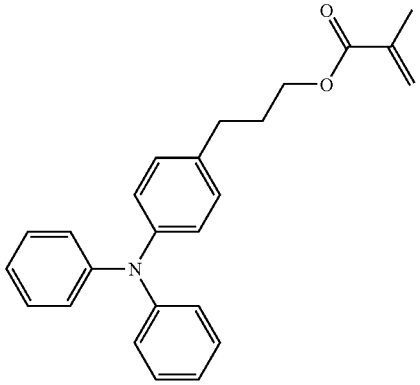

-continued

I'-10

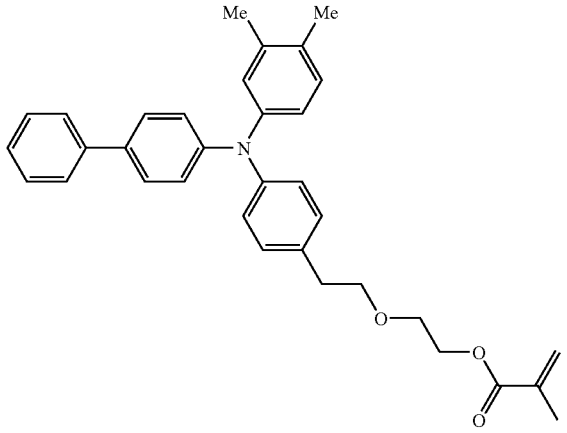

I'-11

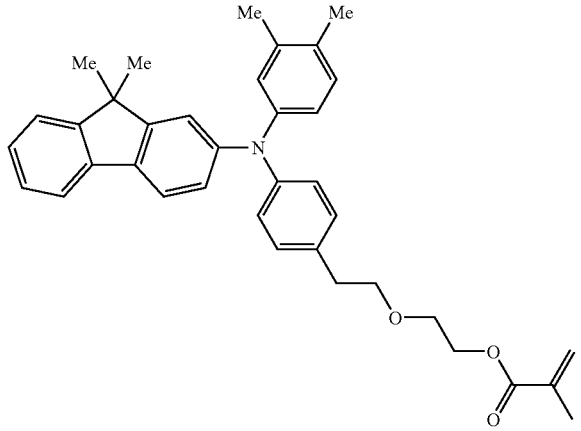

As the reactive materials not having charge transportability, monomers, oligomers and polymers of acrylate or methacrylate can be used, and specifically the following compounds can be exemplified.

As monofunctional monomers, e.g., isobutyl acrylate, t-butyl acrylate, isooctyl acrylate, lauryl acrylate, stearyl acrylate, isobornyl acrylate, cyclohexyl acrylate, 2-methoxyethyl acrylate, methoxy triethylene glycol acrylate, 2-ethoxyethyl acrylate, tetrahydrofurfuryl acrylate, benzyl acrylate, ethylcarbitol acrylate, phenoxyethyl acrylate, 2-hydroxy acrylate, 2-hydroxypropyl acrylate, 4-hydroxybutyl acrylate, methoxy polyethylene glycol acrylate, methoxy polyethylene glycol methacrylate, phenoxy polyethylene glycol acrylate, phenoxy polyethylene glycol methacrylate, hydroxyethyl o-phenylphenol acrylate, and o-phenylphenol glycidyl ether acrylate are exemplified.

As difunctional monomers, oligomers and polymers, e.g., diethylene glycol di(meth)acrylate, polyethylene glycol di(meth)acrylate, polypropylene glycol di(meth)acrylate, neopentyl glycol di(meth)acrylate, and 1,6-hexanediol di(meth)acrylate are exemplified.

As trifunctional monomers, oligomers and polymers, e.g., trimethylolpropane tri(meth)acrylate, pentaerythritol tri(meth)acrylate, and aliphatic tri(meth)acrylate are exemplified.

As tetrafunctional monomers, oligomers and polymers, e.g., pentaerythritol tetra(meth)acrylate, ditrimethylolpropane tetra(meth)acrylate, and aliphatic tetra(meth)acrylate are exemplified.

As pentafunctional or higher monomers, oligomers and polymers, e.g., dipentaerythritol penta(meth)acrylate, dipentaerythritol hexa(meth)acrylate, and in addition, (meth)acrylates having a polyester structure, a urethane structure, and a phosphazen structure can be used.

These difunctional or higher monomers, oligomers and polymers can be used alone, or two or more kinds are used as mixture.

These monomers, oligomers and polymers are used in an amount of 100% by weight or less based on all the amounts of the compounds having charge transportability contained in the charge transporting layer-forming coating solution, preferably 50% by weight or less, and more preferably 30% by weight or less.

Further, polymers capable of reacting with or incapable of reacting with the compound represented by formula (A) may be blended with the charge transporting layer-forming coating solution for the purpose of resistance to discharged gas, mechanical strength, scratch resistance, dispersibility of particles, viscosity control, reduction of torque, control of abrasion loss, and elongation of pot life.

As the polymers capable of reacting with the compound represented by formula (A), for example, the polymers disclosed in JP-A No. 5-216249, JP-A No. 5-323630, JP-A No. 11-52603, and JP-A No. 2000-264961 are exemplified. As the polymers incapable of reaction, well-known resins such as polycarbonate resins, polyester resins, polyallylate resins, methacrylic resins, acrylic resins, polyvinyl chloride resins, polyvinylidene chloride resins, and polystyrene resins are exemplified.

These polymers are used in an amount of preferably 100% by weight or less based on all the amounts of the compounds having charge transportability contained in the charge transporting layer-forming coating solution, more preferably 50% by weight or less, and still more preferably 30% by weight or less.

As well-known charge transporting materials not having a reactive group (non-crosslinking type charge transporting materials), electron transporting compounds such as quinone-based compounds, e.g., p-benzoquinone, chloranil, bromanil, and anthraquinone, tetracyanoquinodimethane-based compounds, fluorenone compounds, e.g., 2,4,7-trinitro-fluorenone, xanthone-based compounds, benzophenone-based compounds, cyanovinyl-based compounds, and ethylene-based compounds, and hole-transporting compounds such as triarylamine-based compounds, benzidine-based compounds, arylalkane-based compounds, aryl-substituted ethylene-based compounds, stilbene-based compounds, anthracene-based compounds, and hydrazone-based compounds are exemplified.

These non-crosslinking type charge-transporting materials are used by one kind alone, or two or more kinds as mixture, but the invention is by no means restricted thereto.

As the non-crosslinking type charge-transporting material, from the viewpoint of the mobility of charge, a triarylamine derivative represented by the following formula (a-1), and a benzidine derivative represented by the following formula (a-2) are preferred.

(a-1)

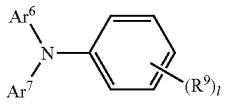

In formula (a-1), $R^9$ represents a hydrogen atom or a methyl group; l is 1 or 2; each of $Ar^6$ and $Ar^7$ independently represents a substituted or unsubstituted aryl group, $—C_6H_4—C(R^{10})=C(R^{11})(R^{12})$, or $—C_6H_4—CH=CH—CH=C(R^{13})(R^{14})$; and each of $R^{10}$ to $R^{14}$ independently represents a hydrogen atom, a substituted or unsubstituted alkyl group, or a substituted or unsubstituted aryl group.

As the examples of the substituents of above each group, a halogen atom, an alkyl group having 1 to 5 carbon atoms, an alkoxy group having 1 to 5 carbon atoms, and a substituted amino group substituted with an alkyl group having 1 to 3 carbon atoms are exemplified.

(a-2)

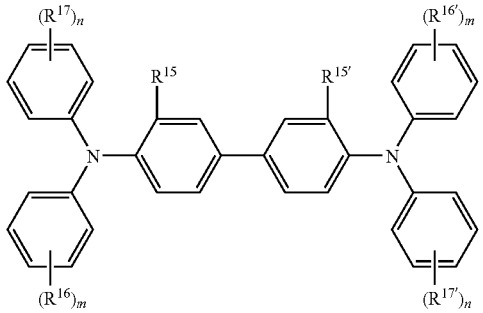

In formula (a-2), each of $R^{15}$ and $R^{15'}$ independently represents a hydrogen atom, a halogen atom, an alkyl group having 1 to 5 carbon atoms, or an alkoxy group having 1 to 5 carbon atoms; each of $R^{16}$, $R^{16'}$, $R^{17}$ and $R^{17'}$ independently represents a hydrogen atom, a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{18})=C(R^{19})(R^{20})$, or $—CH=CH—CH=C(R^{21})(R^{22})$; each of $R^{18}$ to $R^{22}$ independently represents a hydrogen atom, a substituted or unsubstituted alkyl group, or a substituted or unsubstituted aryl group; and each of m and n independently represents an integer of 0 to 2.

Here, of the triarylamine derivatives represented by formula (a-1) and the benzidine derivatives represented by formula (a-2), a triarylamine derivative having "$—C_6H_4—CH=CH—CH=C(R^{13})(R^{14})$" and a benzidine derivative having "$—CH=CH—CH=C(R^{21})(R^{22})$" are excellent in the aspects of mobility of charge, adhesion to a protective layer, and after image resulting from the residual hysteresis of the prior image (hereinafter sometimes referred to as "ghost"), and so preferred.

Charge transporting layer 3A may contain a binder resin.

The examples of the binder resins for use in charge transporting layer 3A include polycarbonate resins, polyester resins, polyallylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. These binder resins are used by one kind alone, or two or more kinds as mixture. The blending ratio of the charge transporting material and binder resin is preferably 10/1 to 1/5 by weight.

The binder resins are not especially restricted, but at least one of polycarbonate resins having a viscosity average molecular weight of 50,000 or more and 80,000 or less, and polyallylate resins having a viscosity average molecular weight of 50,000 or more and 80,000 or less are preferred for capable of easily obtaining good film-forming property.

High molecular charge transporting materials may be used as a charge transporting material. As the high molecular charge transporting materials, known compounds having charge transportability such as poly-N-vinylcarbazole and polysilane are used. In particular, polyester-based high molecular charge transporting materials disclosed in JP-A No. 8-176293 and JP-A No. 8-208820 have high charge transportability as compared with other kinds of materials and especially preferred. A film can be formed with high molecular charge transporting material alone but the above binder resins may be blended for forming a film.

Charge transporting layer 3A is formed with a charge transporting layer-forming coating solution containing the foregoing constituting materials.

The examples of the solvents for use in a charge transporting layer-forming coating solution include ordinary organic solvents, such as aromatic hydrocarbons, e.g., benzene, toluene, xylene, and chlorobenzene, ketones, e.g., acetone and 2-butanone, aliphatic hydrocarbon halides, e.g., methylene chloride, chloroform, and ethylene chloride, and cyclic or straight chain ethers, e.g., tetrahydrofuran and ethyl ether, and these solvents are used by one kind alone, or two or more as mixture. Further, well-known methods are used as the dispersing method of the constituting materials.

As the coating method in coating a charge transporting layer-forming coating solution on charge generating layer 2, ordinary methods, such as a blade coating method, a mayer bar coating method, a spray coating method, a dip coating method, a bead coating method, an air knife coating method, or a curtain coating method are used.

The film thickness of charge transporting layer 3A is preferably 5 μm or more and 50 μm or less, and more preferably 5 μm or more and 30 μm or less.

The charge transporting layer 3A of the invention may further include other coupling agents or fluorine compounds for controlling the properties such as film-forming ability, flexibility, lubricity, and adhesiveness of the film. Examples of such compounds include various silane coupling agents, and commercially available silicone-based hard coating agents.

Examples of the silane coupling agents include vinyltrichlorosilane, vinyltrimethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β(aminoethyl)-γ-aminopropyltriethoxysilane, tetramethoxysilane, methyltrimethoxysilane and dimethyldimethoxysilane. Examples of the commercially available hard coating agent include KP-85, X-40-9740, X-8239 (manufactured by Shin-Etsu Chemical Co., Ltd.), AY42-440, AY42-441, and AY49-208 (manufactured by Toray Dow Corning Silicone Co. Ltd.). In order to impart water repellency, fluorine-containing compounds such as (tridecafluoro-1,1,2,2-tetrahydrooctyl)triethoxysilane, (3,3,3-trifluoropropyl)trimethoxysilane, 3-(heptafluoroisopropoxy) propyltriethoxysilane, 1H,1H,2H,2H-perfluoroalkyltriethoxysilane, 1H,1H,2H,2H-perfluorodecyltriethoxysilane, and 1H,1H,2H,2H-perfluorooctyltriethoxysilane may be added. The amount of the silane coupling agent may be determined as appropriate. However, the amount of the fluorine-containing compound is preferably 0.25 times by weight or lower, with respect to the fluorine-free compounds. If the amount of the fluorine-containing compound exceeds the above range, the film-forming ability of the crosslinked film may be impaired.

The reactive fluorine compounds disclosed in JP-A No. 2001-166510 may further be added.

Resins that are soluble in alcohols may also be added to the charge transporting layer 3A for the purposes such as controlling of the discharge gas resistance, mechanical strength, scratch resistance, particle dispersibility and viscosity; reduction of the torque; controlling of the abrasive wear; extending a pot life; and others.

When a charge transporting layer-forming coating solution is prepared by reacting the above components, the components may be merely mixed and dissolved, but they may be heated on the condition of room temperature or higher and 100° C. or lower, preferably 30° C. or higher and 80° C. or lower for 10 minutes or longer and 100 hours or shorter, and more preferably 1 hour or longer and 50 hours or shorter. At this time, it is also preferred to use ultrasonic wave irradiation. By the above processing, partial reaction presumably advances, and homogeneity of the coating solution is bettered and a uniform film free from coating defects is liable to be obtained.

In order to prevent the deterioration of the charge transporting layer 3A caused by oxidizing gas such as ozone that is generated by the charging device, it is preferable to add an antioxidant to the charge transporting layer 3A. Higher resistance to oxidization than ever is required for a photoreceptor having enhanced surface mechanical strength and longer operating life, since the photoreceptor tends to be exposed to oxidizing gas for the longer period of time. Preferable examples of the antioxidants include hindered phenol-based or hindered amine-based antioxidants, and known antioxidants such as organic sulfur-based antioxidant, phosphite-based antioxidants, dithiocarbamate-based antioxidants, thiourea-based antioxidants and benzimidazole-based antioxidants also may be used. The content of the antioxidant is preferably 20% by weight or less, more preferably 10% by weight or less.

As the hindered phenol-based antioxidants, "Irganox 1076", "Irganox 1010", "Irganox 1098", "Irganox 245", "Irganox 1330", "Irganox 3114", "Irganox 1076" (manufactured by Ciba Japan KK), and "3,5-di-t-butyl-4-hydroxybiphenyl" are exemplified.

As the hindered amine-based antioxidants, "Sanol LS2626", "Sanol LS765", "Sanol LS770", "Sanol LS744", "Tinuvin 144", "Tinuvin 622LD" (manufactured by Sankyo Lifetech Co., Ltd), "Mark LA57", "Mark LA67", "Mark LA62", "Mark LA68", and "Mark LA63" (manufactured by Adeka Corporation) are exemplified. As the thioether-based antioxidants, "Sumilizer TPS" and "Sumilizer TP-D" (manufactured by Sumitomo Chemical Co., Ltd.) are exemplified. As the phosphite-based antioxidants, "Mark 2112", "Mark PEP-8", "Mark PEP-24G", "Mark PEP-36", "Mark 329K" and "Mark HP-10" (manufactured by Adeka Corporation) are exemplified.

In order to decrease the residual potential or improve the strength, the charge transporting layer 3A may include various particles such as conductive particles and inorganic particles. An example of the particles is silicon-containing particles. The silicon-containing particles include silicon as the constituent element, and specific examples thereof include colloidal silica and silicone particles.

The colloidal silica used as silicon-containing particles is a dispersion of silica having an average particle diameter of 1 nm or more and 100 nm or less, preferably 10 nm or more and 30 nm or less in an acidic or alkaline aqueous dispersion, or an organic solvent such as alcohol, ketone, or ester, and may be commercially available one. The solid content of the colloidal silica in the charge transporting layer 3A is not particularly limited, but preferably 0.1% by weight or more and 50% by weight or less, preferably 0.1% by weight or more and 30% by weight with or less respect to the total solid content of the charge transporting layer 3A from the viewpoints of film-forming ability, electrical characteristics, and strength.

The silicone particles used as the silicon-containing particles may be selected from the common commercially available products of silicone resin particles, silicone rubber particles and silicone surface-treated silica particles. These silicone particles are spherical, and preferably have an average particle diameter of 1 nm to 500 nm, more preferably 10 nm to 100 nm. By using the silicone particles, the surface properties of an electrophotographic photoreceptor can be improved without inhibiting the crosslinking reaction, since the particles can exhibit an excellent dispersibility to resin because of being small in diameter and chemically inactive, and further, the content of the silicone particles required to achieve desirable characteristics is small. More specifically, the particles are incorporated into the strong crosslinking structure without causing variation, and thereby enhancing the lubricity and water repellency of the surface of the electrophotographic photoreceptor, and maintaining the favorable abrasion resistance and stain resistance over the long time.

When charge transporting layer 3A contains silicone particles, the content of the silicone particles in the charge transporting layer 3A is preferably 0.1 to 30% by weight, more preferably 0.5 to 10% by weight relative to the total solid content in the charge transporting layer 3A.

Other examples of the particles include: fluorine particles such as ethylene tetrafluoride, ethylene trifluoride, propylene hexafluoride, vinyl fluoride, and vinylidene fluoride; the particles as described in the proceeding of the 8th Polymer Material Forum Lecture, p. 89, the particles composed of a resin prepared by copolymerization of a fluorocarbon resin with a hydroxy group-containing monomer; and semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, and MgO. For the same purpose, an oil such as a silicone oil may be added. Examples of the silicone oil include: silicone oils such as dimethylpolysiloxane, diphenylpolysiloxane, and phenylmethylsiloxane; reactive silicone oils such as amino-modified polysiloxane, epoxy-modified polysiloxane, carboxyl-modified polysiloxane, carbinol-modified polysiloxane, methacryl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as (3,3,3-trifluoropropyl)methylcyclotrisiloxane; hydrosilyl group-containing cyclosiloxanes such as a methylhydrosiloxane mixture, pentamethylcyclopentasiloxane, and phenylhydrocyclosiloxane; and vinyl group-containing cyclosiloxanes such as pentavinylpentamethylcyclopentasiloxane.

The charge transporting layer 3A may further include a metal, a metal oxide, and carbon black. Examples of the metal include aluminum, zinc, copper, chromium, nickel, silver and stainless steel, and metal-evaporated plastic particles plated with these metals. Examples of the metal oxide include zinc oxide, titanium oxide, tin oxide, antimony oxide, indium oxide, bismuth oxide, tin-doped indium oxide, antimony-doped or tantalum-doped tin oxide, and antimony-doped zirconium oxide. These metals, metal oxides and carbon black may be used alone or as a mixture of two or more kinds thereof. When two or more kinds thereof are combined, they may be simply mixed or made into a solid solution or a fusion. The average particle diameter of the conductive particles is preferably 0.3 μm or less, particularly preferably 0.1 μm or less from the viewpoint of transparency of the protective layer.

In the form having a monolayer type photosensitive layer (charge-generating/charge-transporting layer 6) as electrophotographic photoreceptor 7F shown in FIG. 12, the content of the charge transporting material represented by formula (A) contained in the charge-generating/charge-transporting layer-forming coating solution is preferably 5% by weight or more based on all the solids content in the coating solution from the aspect of strength, more preferably 10% by weight or more, and still more preferably 15% by weight or more.

The total content of the charge transporting material in the charge-generating/charge-transporting layer-forming coating solution is preferably 5 to 50% by weight. The content of the charge generating material in the charge-generating/charge-transporting layer-forming coating solution is about 10 to 85% by weight based on all the solids content in the coating solution, and preferably 20 to 50% by weight. The single-layer photosensitive layer 6 (charge generating/charge transporting layer) is formed in the same manner as the charge generating layer 2 and the charge transporting layer 3A. The thickness of the single-layer photosensitive layer (charge generating/charge transporting layer) 6 is preferably about 5 μm to 50 μm, more preferably 10 μm to 40 μm.

Protective layer 6 provided in electro-photographic photoreceptor 7F has functions of preventing chemical decomposition of the charge-transporting layer at the time of charging of the photosensitive layer and at the same time maintaining the mechanical strength of the photosensitive layer. As the binder resins for use in the protective layer, well-known resins, for example, polyamide resin, polyurethane resin, polyester resin, epoxy resin, polyketone resin, polycarbonate resin, polyvinyl ketone resin, polystyrene resin, polyacrylamide resin, polyimide resin, polyamideimide resin, and polyether imide resin can be used. It is also possible to add conductive materials to the protective layer. As the conductive materials, materials such as metallocene compounds, e.g., N,N'-dimethylferrocene, aromatic amine compounds, e.g., N,N'-diphenyl-N,N'-bis(3-methylphenyl)-[1,1'-biphenyl]-4,4'-diamine, and metal oxides, e.g., antimony oxide, tin oxide, titanium oxide, indium oxide, and tin oxide-antimony oxide can be used.

It is desired to constitute the protective layer to have electrical resistance of $10^9$ Ω·cm or higher and $10^{14}$ Ω·cm or lower. When the electrical resistance exceeds $10^{14}$ Ω·cm, residual potential increases and the resulting duplicate is foggy, while when it is less than $10^9$ Ω·cm, blur of image and reduction of resolution occur. Further, the protective layer has to be constituted so as not to substantially hinder the transmission of light used as exposure light.

The thickness of the protective layer is in the range of 0.5 μm or more and 20 μm or less, and preferably 1 μm or more and 10 μm or less.

As the coating method to form the protective layer, well-known methods such as a blade coating method, a mayer bar coating method, a spray coating method, a dip coating method, a bead coating method, an air knife coating method, or a curtain coating method can be used.

The image-forming apparatus and processing cartridge according to an aspect of the invention will be described below with reference to FIGS. 4 and 5.

(Image Forming Apparatus/Processing Cartridge)

Figure 4:
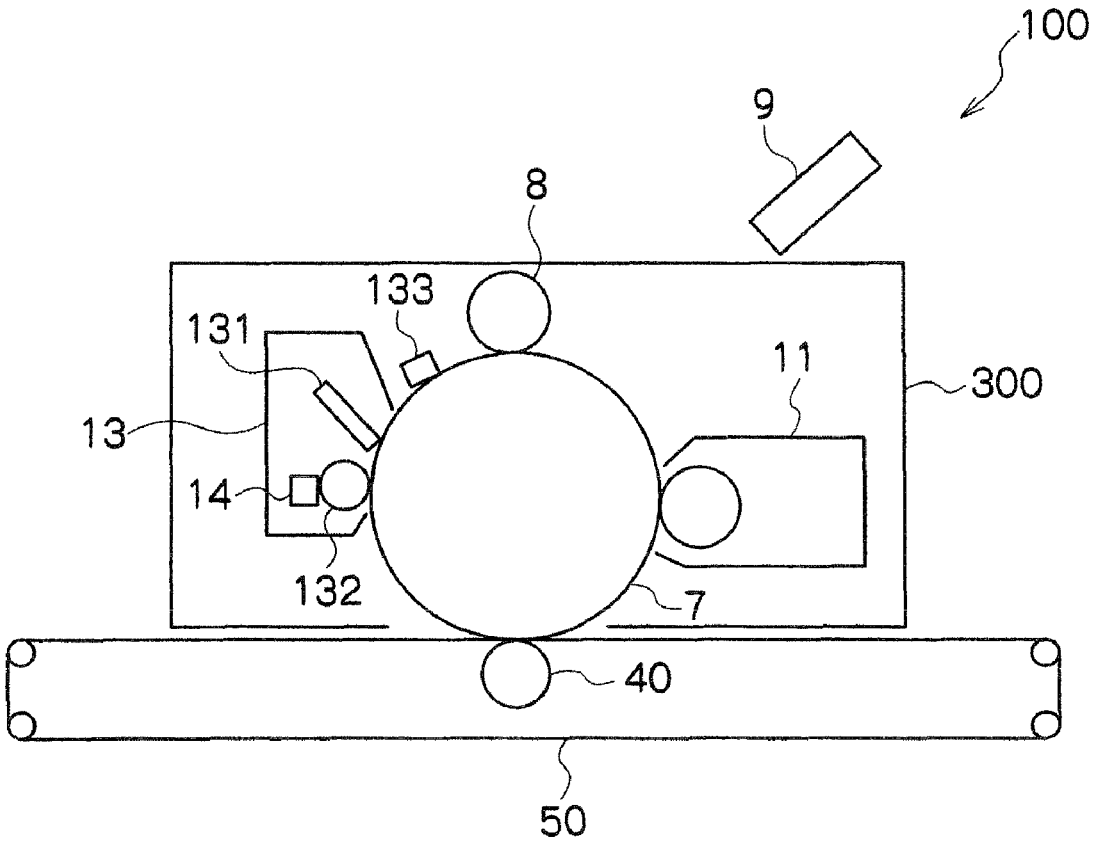
FIG. 4 is a schematic block diagram showing the image forming apparatus concerning an aspect of the invention.

FIG. 4 is a schematic block diagram showing an image forming apparatus 100 according to an exemplary embodiment of the invention. As shown in FIG. 4, the image forming apparatus 100 includes a processing cartridge 300 equipped with electrophotographic photoreceptor 7, an exposure device (electrostatic latent image forming unit) 9, a transfer device (transfer unit) 40, and an intermediate transfer medium 50. In the image forming apparatus 100, the exposure device 9 is arranged so as to irradiate the electrophotographic photoreceptor 7 through the opening of the processing cartridge 300, the transfer device 40 is arranged so as to oppose the electrophotographic photoreceptor 7 via the intermediate transfer medium 50, and the intermediate transfer medium 50 is arranged so as to partially contact with the electrophotographic photoreceptor 7.

The processing cartridge 300 in FIG. 4 integrally supports the electrophotographic photoreceptor 7, the charging device (charging unit) 8, a developing device (developing unit) 11 and a cleaning device 13, in a housing. The cleaning device 13 has a cleaning blade 131 (cleaning member). The cleaning blade 131 is disposed so as to contact the surface of the electrophotographic photoreceptor 7.

Incidentally, the cleaning member may be a conducting or insulating fibrous member, not the embodiment of cleaning blade 131, which may be used alone, or may be used in combination with the blade.

In FIG. 4, an example as cleaning device 13 is shown, which is equipped with fibrous member 132 (in the form of a roll) feeding lubricant 14 to the surface of photoreceptor 7, and using fibrous member 133 (in the form of a flat brush) as cleaning assist, and these members are used according to necessity.

As the charging device 8, for example, a contact type charging device using a conductive or semiconductive charging roller, a charging brush, a charging film, a charging rubber blade, a charging tube or the like can be used. Known charging devices such as a non-contact type roller charging device using a charging roller, and scorotron or corotron charging devices utilizing corona discharge can also be used.

Although not shown, in order to improve stability of the image, a photoreceptor heating member may be provided around the electrophotographic photoreceptor 7 thereby increasing the temperature of the electrophotographic photoreceptor 7 and reducing the relative temperature.

Examples of the exposure device 9 include optical instruments which can expose the surface of the photoreceptor 7 so that a desired image is formed by using light of a semiconductor laser, an LED, a liquid-crystal shutter light or the like. The wavelength of light sources to be used is in the range of the spectral sensitivity region of the photoreceptor. As the semiconductor laser light, near-infrared light having an oscillation wavelength in the vicinity of 780 nm is predominantly used. However, the wavelength of the light source is not limited to the above-described wavelength, and lasers having an oscillation wavelength on the order of 600 nm and blue lasers having an oscillation wavelength in the vicinity of 400 to 450 nm can also be used. Surface-emitting type laser light sources which are capable of multi-beam output are effective to form a color image.

As the developing device 11, for example, a common developing device, in which a magnetic or non-magnetic one- or two-component developer is contacted or not contacted for forming an image, can be used. Such developing device is not particularly limited as long as it has above-described functions, and can be appropriately selected according to the preferred use. Examples thereof include known developing device in which said one- or two-component developer is applied to the photoreceptor 7 using a brush or a roller. Among these, the developing device using developing roller retaining developer on the surface thereof is preferable.

A toner to be used in the developing device will be described below. The toner particles used in the image forming apparatus of the present embodiment preferably have an average shape factor ($ML^2/A\times\pi/4\times100$, wherein ML represents the maximum length of a particle and A represents the projection area of the particle.) of 100 to 150, more preferably 100 to 140. Furthermore, the volume-average particle diameter of the toner particles is preferably 2 μm to 12 μm, more preferably 3 μm to 12 μm, further preferably 3 μm to 9 μm. By using such toner particles having the above-described average shape factor and volume-average particle diameter, developability and transferring property can be enhanced and a high quality image, so-called photographic image, can be obtained.

The method of producing the toner is not particularly limited as long as the obtained toner particles satisfy the above-described average shape factor and volume-average particle diameter. Examples of the method include a kneading and grinding method in which a binding resin, a coloring agent, a releasing agent, and optionally a charge control agent or the like are mixed and kneaded, ground, and classified; a method of altering the shape of the particles obtained by the kneading and grinding method using mechanical shock or heat energy; an emulsion polymerization aggregation method in which a dispersion solution obtained by emulsifying and polymerizing polymerizable monomers of a binding resin is mixed with a dispersion solution containing a coloring agent, a releasing agent, and optionally a charge control agent and other agents, then aggregated, heated, and fused to obtain toner particles; a suspension polymerization method in which polymerizable monomers to obtain a binding resin and a solution containing a coloring agent, a releasing agent, and optionally a charge control agent and other agents, are suspended in an aqueous solvent and polymerized therein; and a dissolution-suspension method in which a binding resin and a solution containing a coloring agent, a releasing agent, and optionally a charge control agent and other agents, is suspended in an aqueous solvent to form particles.

Moreover, known methods such as a method of producing toner particles having a core-shell structure in which aggregated particles are further attached to the toner particles obtained by the above-described method, as the core, then heated and fused. As the method of producing toner particles, a suspension-polymerization method, an emulsion polymerization aggregation method, and a dissolution suspension method carried out in an aqueous solvent are preferred, and an emulsion polymerization aggregation method is most preferred from the viewpoint of controlling the shape and particle diameter distribution.

Toner mother particles comprise a binding resin, a coloring agent and a releasing agent, and as appropriate, further comprise silica and a charge control agent.

Examples of the binding resins used in the toner mother particles include monopolymers and copolymers of styrenes such as styrene and chlorostyrene, monoolefins such as ethylene, propylene, butylene, and isoprene, vinyl esters such as vinyl acetate, vinyl propionate, vinyl benzoate, vinyl butyrate, a-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate, vinyl ethers such as vinyl methyl ether, vinyl ethyl ether, and vinyl butyl ether, and vinyl ketones such as vinyl methyl ketone, vinyl hexyl ketone, and vinyl isopropenyl ketone, and polyester resins synthesized by copolymerization of dicarboxylic acids and diols.

Examples of the typical binding resins include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, polypropylene and polyester resins. Other examples include polyurethane, epoxy resins, silicone resins, polyamide, modified rosin and paraffin wax.

Examples of the typical coloring agents include magnetic powder such as magnetite and ferrite, carbon black, aniline blue, chalcoyl blue, chrome yellow, ultramarine blue, Du Pont oil red, quinoline yellow, methylene blue chloride, phthalocyanine blue, malachite green oxalate, lamp black, rose bengal, C. I. Pigment Red 48:1, C. I. Pigment Red 122, C. I. Pigment Red 57:1, C. I. Pigment Yellow 97, C. I. Pigment Yellow 17, C. I. Pigment Blue 15:1, and C. I. Pigment Blue 15:3.

Examples of the typical releasing agents include low-molecular polyethylene, low-molecular polypropylene, Fischer-Tropsch wax, montan wax, carnauba wax, rice wax and candelilla wax.

As the charge control agent, known agents such as azo metal-complex compounds, metal-complex compounds of salicylic acid, and resin-type charge control agents having polar groups can be used. When toner particles are produced by a wet method, it is preferred to use materials hardly soluble in water from the viewpoint of controlling ion strength and reducing contamination by waste water. The toner may be either a magnetic toner which contains a magnetic material or a non-magnetic toner which contains no magnetic material.

The toner particles used in the developing device 11 can be produced by mixing the above-described toner mother particles and external additives using a Henschel mixer, a V blender or the like. When the toner mother particles are produced by a wet process, external additives can be added by a wet method.

Lubricant particles may be added to the toner used in the developing device 11. Examples of the lubricant particles include solid lubricants such as graphite, molybdenum disulfide, talc, fatty acids and metal salts of fatty acids, low molecular weight polyolefins such as polypropylene, polyethylene and polybutene, silicones having a softening point by heating, fatty-acid amides such as oleic acid amide, erucic acid amide, ricinoleic acid amide and stearic acid amide, vegetable waxes such as carnauba wax, rice wax, candelilla wax, Japan wax and jojoba oil, animal waxes such as beeswax, mineral and petroleum waxes such as montan wax, ozokerite, ceresine, paraffin wax, microcrystalline wax and Fischer-Tropsch wax, and modified products thereof. These may be used alone or in combination of two or more kinds thereof. The average particle diameter is preferably in the range of 0.1 μm to 10 μm, and those having the above-described chemical structure may be ground into particles having the same particle diameter. The content of the particles in the toner is preferably in the range of 0.05 to 2.0% by weight, more preferably 0.1 to 1.5% by weight.

Inorganic particles, organic particles or composite particles to which inorganic particles are attached to the organic particles may be added to the toner particles used in the developing device 11 for the purpose of removing a deposition or a deterioration-inducing substance from the surface of an electrophotographic photoreceptor.

Examples of the appropriate inorganic particles include various inorganic oxides, nitrides and borides such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride and boron nitride.

The above-described inorganic particles may be treated with titanium coupling agents such as tetrabutyl titanate, tetraoctyl titanate, isopropyltriisostearoyl titanate, isopropyltridecylbenzenesulfonyl titanate and bis(dioctylpyrophosphate)oxyacetate titanate, silane coupling agents such as γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane and p-methylphenyltrimethoxysilane.

The above-described particles hydrophilized with metal salts of higher fatty acids such as silicone oil, stearic acid aluminum, stearic acid zinc and stearic acid calcium are also preferably used.

As the organic particles, particles of graphite, carbon fluoride comprising graphite to which fluorine is bonded, polyethylene tetrafluoride resin (PTFE), perfluoroalkoxy•fluorine resin (PFA), ethylene tetrafluoride•propylene hexafluoride copolymer (FEP), ethylene•ethylene tetrafluoride copolymer (ETFE), polychloroethylene trifluoride (PCTFE), vinylidene fluoride (PVDF), and vinyl fluoride (PVF) can be used.

The particle diameter based on the number average particle diameter is preferably 5 nm to 1000 nm, more preferably 5 nm to 800 nm, further preferably 5 nm to 700 nm. If the average particle diameter is less than the lower limit, the particles tend to have insufficient abrasive properties. On the other hand, if the average particle diameter exceeds the upper limit, the particles tend to scratch the surface of an electrophotographic photoreceptor. The total of the content of the above-described particles and lubricant particles is preferably 0.6% by weight or more.

As the other inorganic oxides added to the toner particles, small inorganic oxide particles having a primary diameter of 40 nm or less are preferably used from the viewpoint of powder mobility and charge control, and inorganic oxide particles having a larger diameter than that of the small inorganic oxide particles are preferably added from the viewpoint of adhesiveness reduction and charge control. Known inorganic oxide particles may be used, but the combination of silica and titanium oxide particles is preferred for precise charge control.

Surface treatment of small inorganic particles enhances the dispersibility and powder mobility of the particles. Furthermore, the addition of carbonates such as calcium carbonate and magnesium carbonate, and inorganic minerals such as hydrotalcite is also preferably used to remove discharge products.

Color toner particles for electrophotography are used in combination with carriers. Examples of the carrier include iron powder, glass beads, ferrite powder, nickel powder and those coated with a resin. The mixing ratio of the carriers can be determined as appropriate.

Examples of the transfer device 40 include known transfer charging devices such as a contact type transfer charging devices using a belt, a roller, a film, a rubber blade, a scorotron transfer charging device and a corotron transfer charging device utilizing corona discharge.

As the intermediate transfer body 50, a belt which is imparted semiconductivity (intermediate transfer belt) of polyimide, polyamide imide, polycarbonate, polyarylate, polyester, rubber or the like is used. The intermediate transfer body 50 may also take the form of a drum.

In addition to the above-described devices, the image forming apparatus 100 may further be provided with, for example, a photodischarge device for photodischarging the photoreceptor 7.

Figure 5:
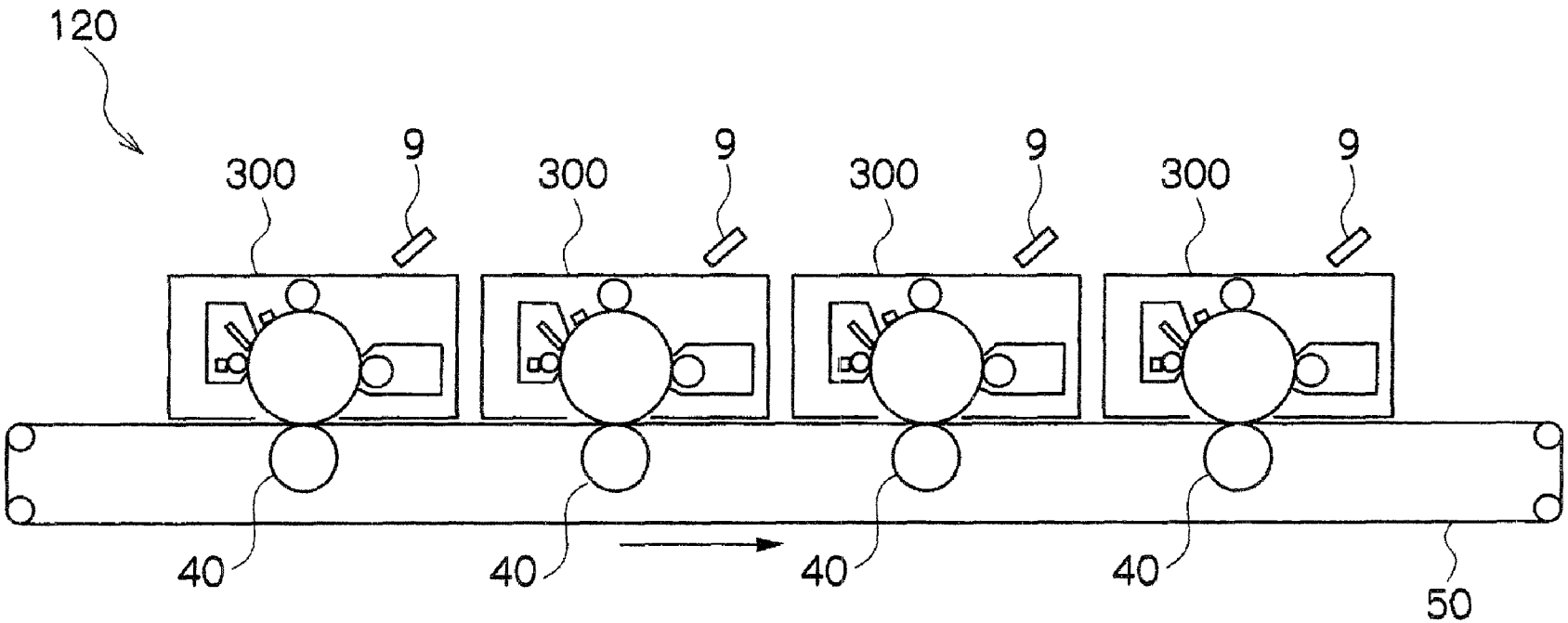
FIG. 5 is a schematic block diagram showing another image forming apparatus concerning an aspect of the invention.

FIG. 5 is a schematic block diagram showing an image forming apparatus 120 according to another exemplary embodiment of the invention. As shown in FIG. 5, the image forming apparatus 120 is a full color image forming apparatus of tandem type including four processing cartridges 300. In the image forming apparatus 120, four processing cartridges 300 are disposed parallel with each other on the intermediate transfer body 50, and one electrophotographic photoreceptor can be used for one color. The image forming apparatus 120 has the same constitution as the image forming apparatus 100, except being tandem type.

When the electrophotographic photoreceptor of the invention is used in a tandem type image forming apparatus, the electrical characteristics of the four photoreceptors are stabilized, which provides high image quality with excellent color balance over the long time.

In the image forming apparatus (processing cartridge) according to an exemplary embodiment of the invention, the development apparatus (development unit) preferably includes a development roller as a developer retainer which moves (rotates) in the direction opposite to the traveling direction (rotation direction) of the electrophotographic photoreceptor. For example, the development roller has a cylindrical development sleeve for retaining the developer on the surface thereof, and the development apparatus has a control member for controlling the amount of the developer fed to the development sleeve. When the development roller of the development apparatus is moved (rotated) in the direction opposite to the rotation direction of the electrophotographic photoreceptor, the surface of the electrophotographic photoreceptor is rubbed with the toner retained between the development roller and the electrophotographic photoreceptor.

In cleaning the residual toner on the electro-photographic photoreceptor, the surface of the electro-photographic photoreceptor is strongly rubbed by raising pushing pressure of a blade or the like to increase cleaning efficiency of the toner of an almost spherical shape.

Conventional electrophotographic photoreceptors are highly damaged by such rubbing, so that abrasion, scratch, or filming of a toner is liable to occur, and image degradation is caused. However, by forming electrophotographic photoreceptor surface heightened by the crosslinked product of the specific charge transporting material of the invention (in particular, the material capable of obtaining a cured film high in crosslinking density by containing increased number of reactive functional groups in high concentration) and thickened to obtain excellent electric characteristics, it becomes possible to maintain high image quality for a long period of time. It is thought that the deposition of discharge products is restrained for extremely long period of time.

In addition, in the image forming apparatus (processing cartridge) according to an exemplary embodiment of the invention, from the viewpoint of preventing deposit of discharge products over the longer term, the space between the development sleeve and the photoreceptor is preferably 200 μm or more and 600 μm or less, and more preferably 300 μm or more and 500 μm or less. From the same viewpoint, the space between the development sleeve and control blade, which is a control member for controlling the amount of the developer, is preferably 300 μm or more and 1000 μm or less, and more preferably 400 μm or more and 750 μm or less. From the viewpoint of preventing deposit of discharge products over the longer term, the absolute moving velocity of the development roll surface (process speed) is preferably from 1.5 times to 2.5 times, and more preferably from 1.7 times to 2.0 times the moving velocity of the photoreceptor surface.

In the image forming apparatus (processing cartridge) according to an exemplary embodiment of the invention, the development apparatus (development unit) includes a developer retainer having a magnetic substance, and develops an electrostatic latent image with preferably a two-component developer containing a magnetic carrier and a toner. With the structure, finer color images are produced, and higher quality and longer life are achieved in comparison with other structure using a one-component developing solution, particularly a non-magnetic one-component developer.

EXAMPLES

Exemplary embodiments will now be illustrated in more detail with reference to examples. However, the invention is not limited to the examples.

Synthesis Example 1

Synthesis of Compound (A-4)

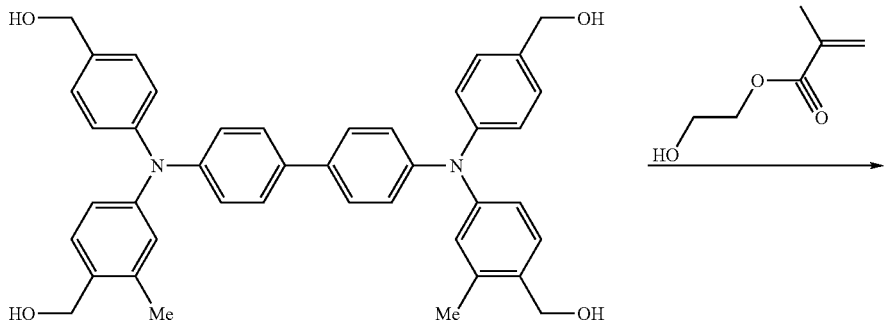

(1)

-continued

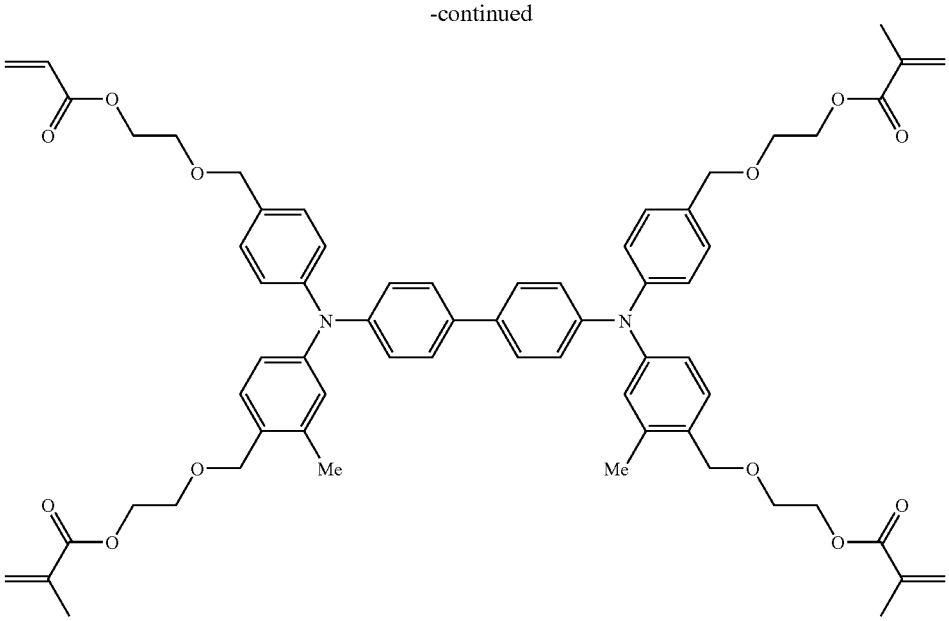

(A-4)

Figure 7:
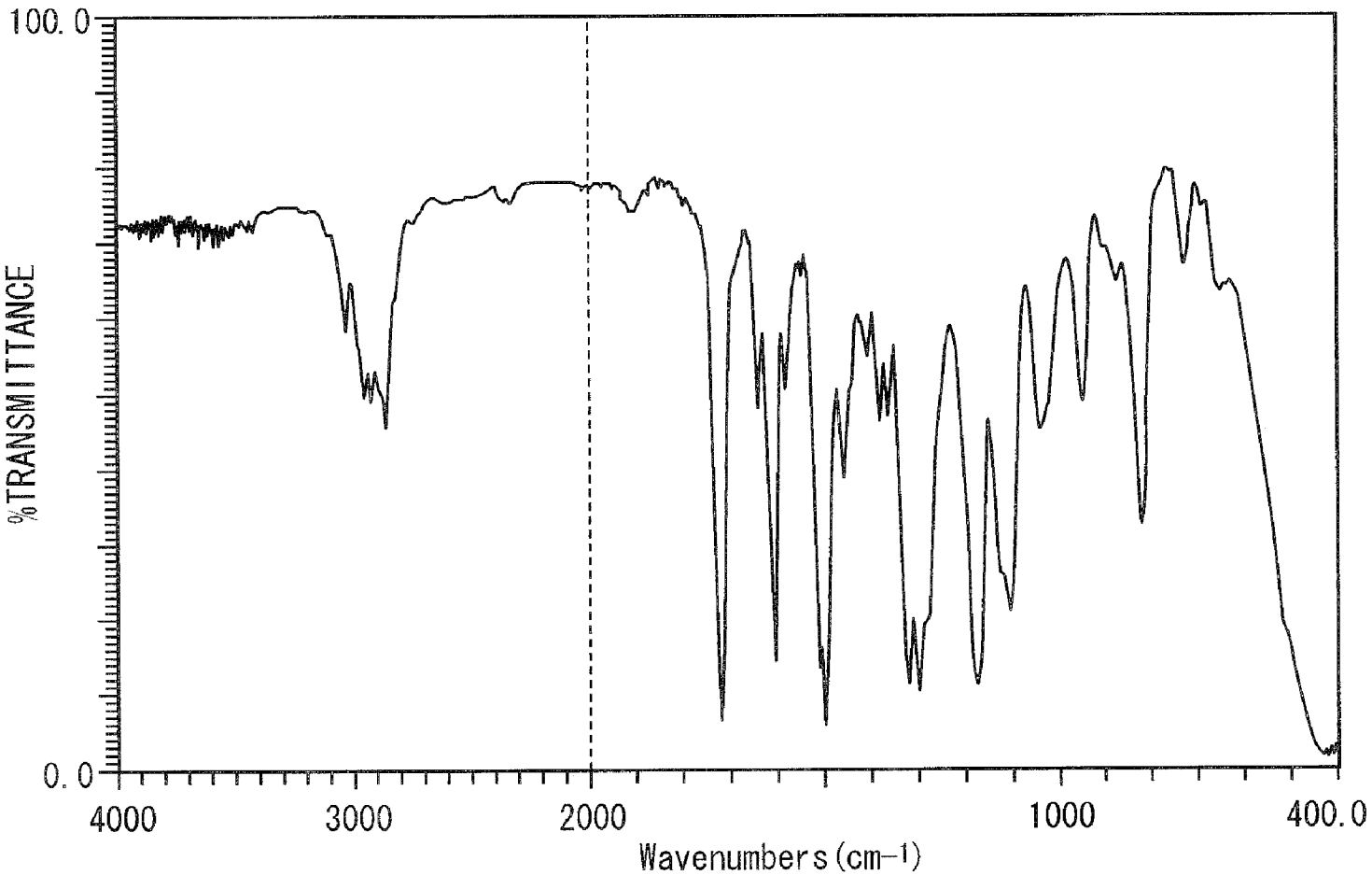
FIG. 7 is an IR spectrum of product (A-4)

The above Compound (1) (10 g), 50 g of hydroxyethyl methacrylate, 20 ml of tetrahydrofuran, and 0.5 g of Amberlyst 15E (manufactured by ORGANO CORPORATION) are put into a 200 ml flask, and stirred at room temperature for 24 hours. After termination of reaction, 100 ml of methanol is added to the reaction solution, and a precipitated oily product is taken out by decantation. The oily product is refined by silica gel column chromatography to obtain 12 g of oily Compound (A-4). The IR spectrum of the obtained (A-4) is shown in FIG. 7.

Synthesis Example 2

Synthesis of Compound (A-17)

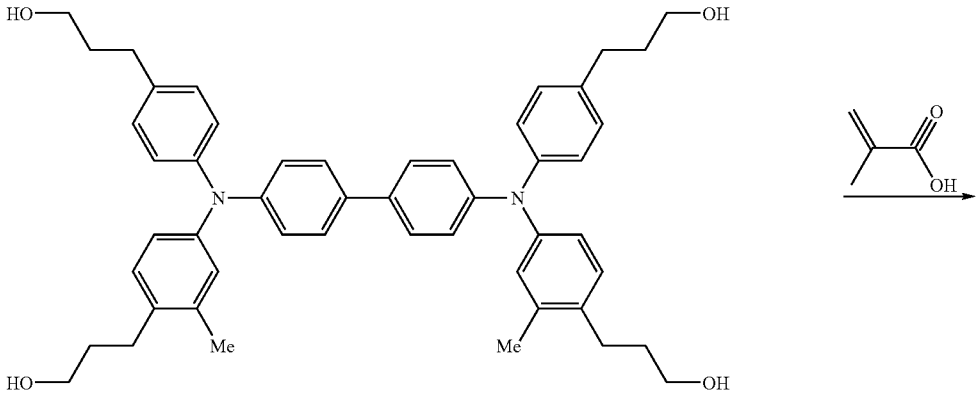

(2)

-continued

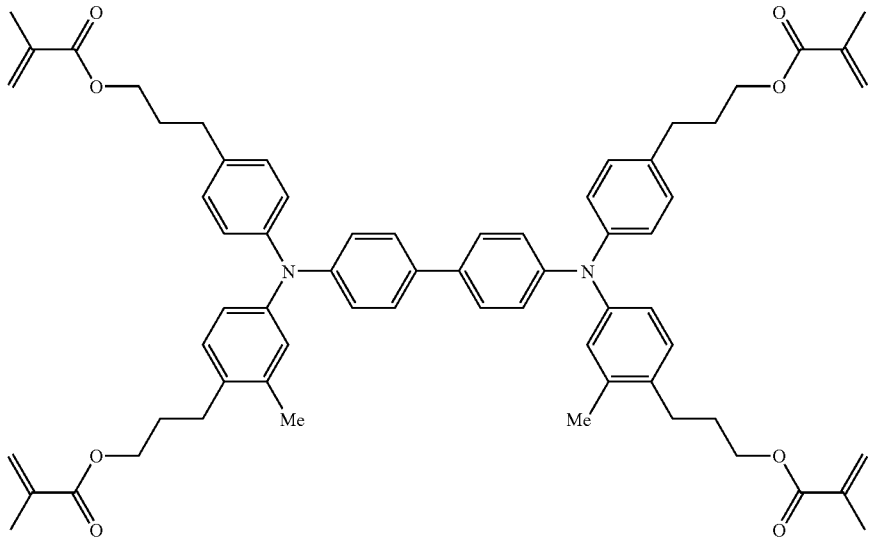

(A-17)

Figure 8:
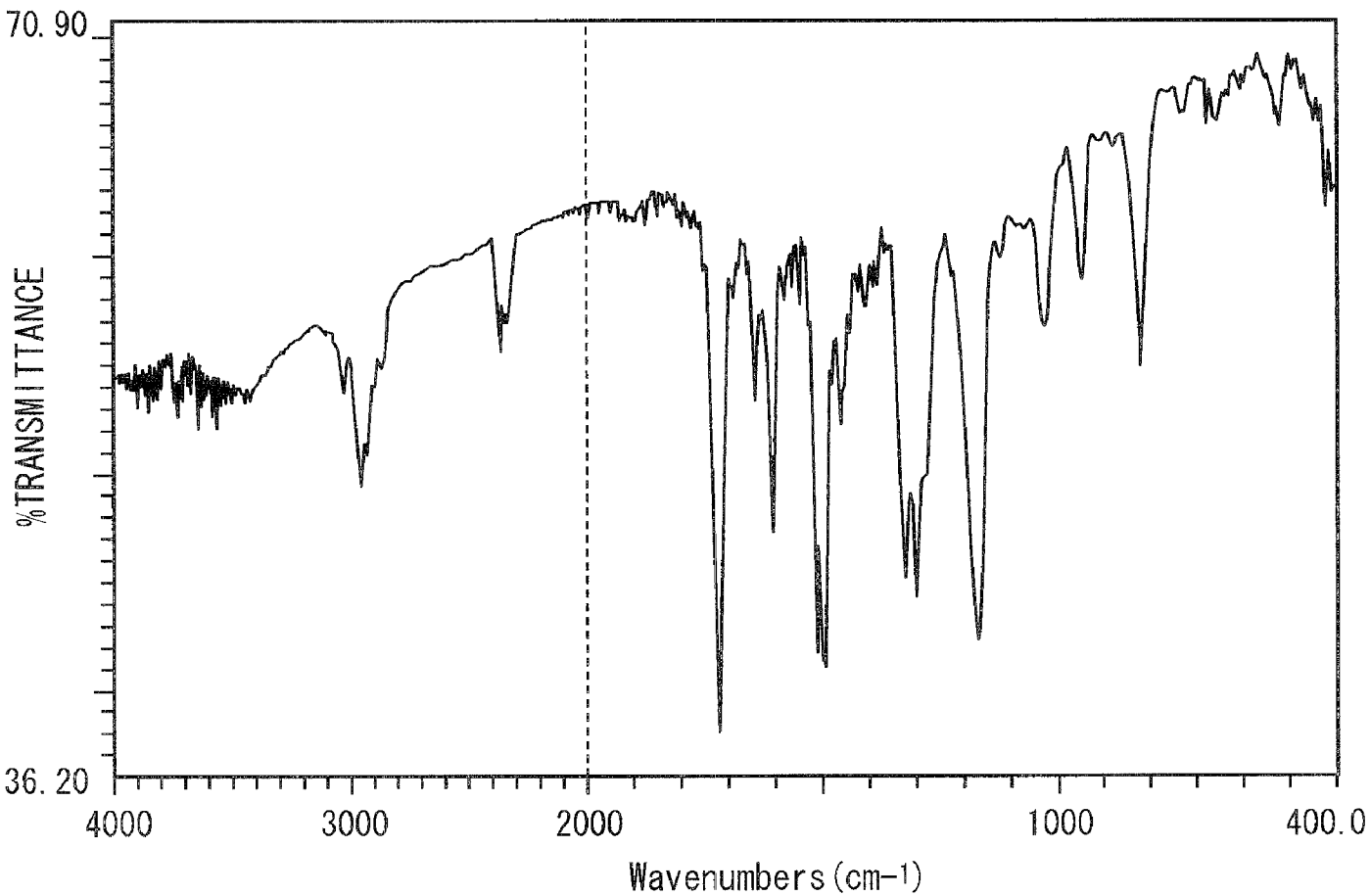
FIG. 8 is an IR spectrum of product (A-17)

The above Compound (2) (36 g), 75 g of methacrylic acid, 300 ml of toluene, and 2 g of p-toluenesulfonic acid are put into a 500 ml flask, and refluxed with heating for 10 hours. After termination of reaction, the reaction product is cooled, poured into 2,000 ml of water and an organic layer is separated, and further washed with water. After being dried with anhydrous sodium sulfate, a toluene layer is refined with silica gel column chromatography to obtain 30 g of Compound (A-17). The IR spectrum of the obtained (A-17) is shown in FIG. 8.

Synthesis Example 3

Synthesis of Compound (A-18)

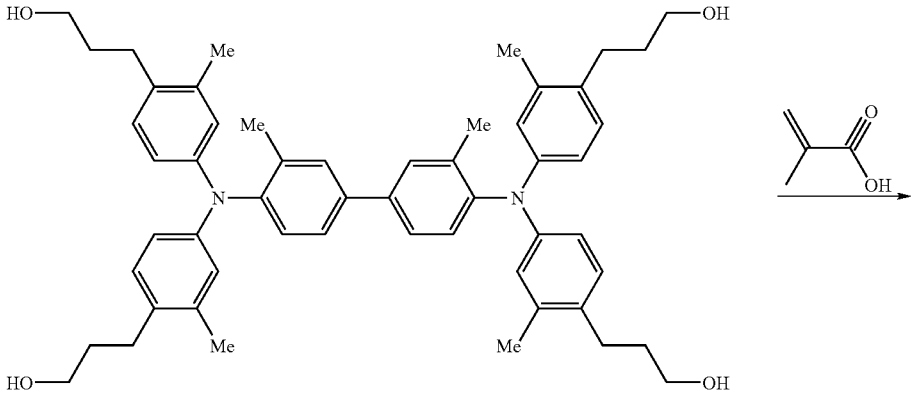

(3)

-continued

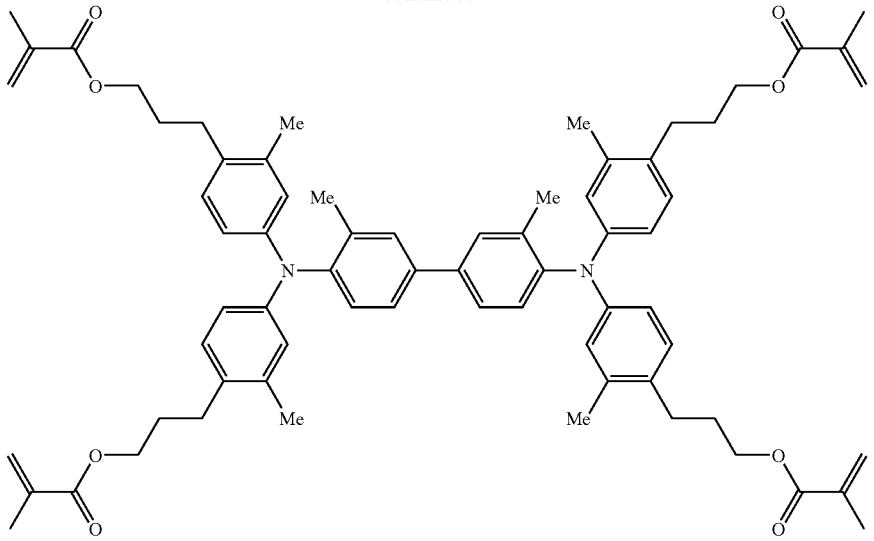

(A-18)

Figure 9:
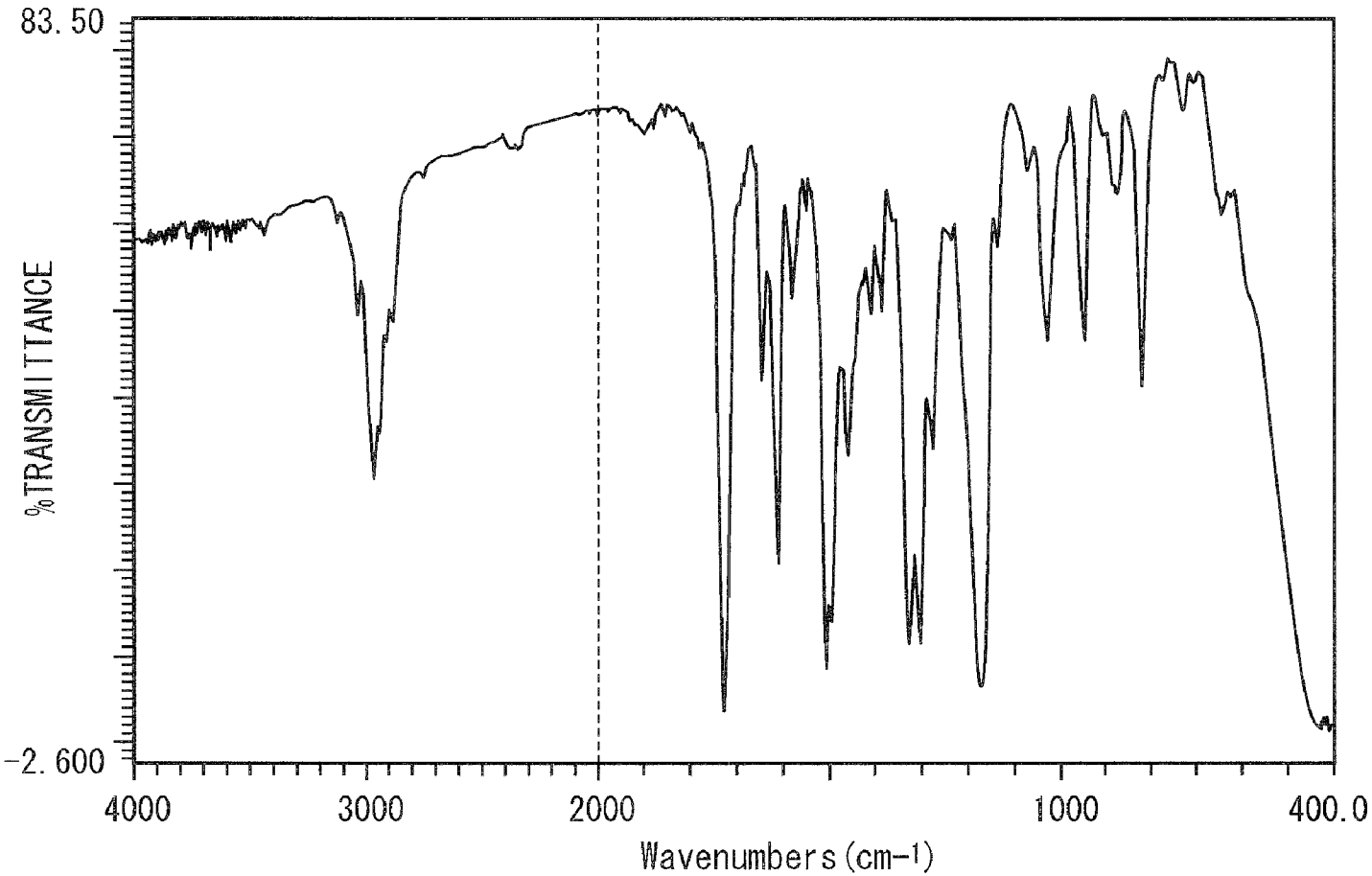
FIG. 9 is an IR spectrum of product (A-18)

The above Compound (3) (50 g), 107 g of methacrylic acid, 300 ml of toluene, and 2 g of p-toluenesulfonic acid are put into a 500 ml flask, and refluxed with heating for 10 hours. After termination of reaction, the reaction product is cooled, poured into 2,000 ml of water and an organic layer is separated, and further washed with water. After a toluene layer is dried with anhydrous sodium sulfate, refined with silica gel column chromatography to obtain 38 g of Compound (A-18). The IR spectrum of the obtained (A-18) is shown in FIG. 9.

Comparative Synthesis Example 1

The above Compound (2) (36 g), 70 g of acrylic acid, 300 ml of toluene, and 2 g of p-toluenesulfonic acid are put into a 500 ml flask, and refluxed with heating for 10 hours. After termination of reaction, the reaction product is cooled, poured into 2,000 ml of water and an organic layer is separated, and farther washed with water. After a toluene layer is dried with anhydrous sodium sulfate, refined with silica gel column chromatography, but objective compound cannot be isolated due to gelation during distillation of the solvent under reduced pressure.

Comparative Synthesis Example 2

After reaction by adding 0.5 g of hydroquinone to Comparative Synthesis Example 1, the same treatments as in Comparative Synthesis Example 1 are carried out, but objective compound cannot be isolated due to gelation during distillation of the solvent under reduced pressure.

The materials used in examples and comparative examples are shown below.

<Particles>

Colloidal silica (trade name: PL-1, manufactured by Fuso Chemical Co., Ltd.)

Titanium oxide (Titone R-1T, manufactured by Sakai Chemical Industry Co., Ltd.)

PTFE (trade name: Lubron L-2, manufactured by Daikin Industries Ltd.)

<Polymers (c) and (d)>

Bisphenol Z polycarbonate (PC(Z), molecular weight: 40,000, manufactured by Mitsubishi Gas Chemical Co., Inc.): polymer (c) not reacting with the specific charge transporting materials (a)

Polymethyl methacrylate (PMMA, molecular weight: 20,000): polymer (c) not reacting with the specific charge transporting materials (a)

Polycarbonate having a carbon-carbon double bond prepared in accordance with the Synthesis Example 1 disclosed in JP-A No. 5-323630 (molecular weight: 20,000): polymer (d) reacting with the specific charge transporting materials (a)

<Curing Catalyst>

Azobisisobutyronitrile (AIBN, manufactured by Otsuka Chemical Co., Ltd.)

PERBUTYL® C (PBC, manufactured by NOF CORPORATION)

$OT_{AZO}$-15 ($OT_{AZO}$-15, manufactured by Otsuka Chemical Co., Ltd.)

<Monomer Not Having Charge Transportability Reacting with the Specific Charge Transporting Materials (a): Curing Agent>

Isobutyl acrylate (IBA, manufactured by Wako Pure Chemical Industries)

Ethoxylated bisphenol diacrylate (ABE-300, manufactured by Shin-Nakamura Chemical Co., Ltd.)

Trimethylolpropane triacrylate (THE330, manufactured by Nippon Kayaku Co., Ltd.)

Example 1

(Formation of Undercoating Layer)

100 parts by weight of zinc oxide (average particle diameter: 70 nm, manufactured by Tayca Corporation, specific surface area: 15 $m^2/g$) is stirred and mixed with 500 parts by weight of toluene, into which 1.3 parts by weight of a silane coupling agent (trade name: KBM503, manufactured by Shin-Etsu Chemical Co., Ltd.) is added and stirred for 2 hours. Subsequently, toluene is removed by distillation under reduced pressure, and baking is carried out at a temperature of 120° C. for 3 hours to obtain the zinc oxide having the surface treated with the silane coupling agent.

110 parts by weight of the surface-treated zinc oxide is stirred and mixed with 500 parts by weight of tetrahydrofuran, into which a solution in which 0.6 parts by weight of alizarin is dissolved in 50 parts by weight of tetrahydrofuran is added, then stirred at a temperature of 50° C. for 5 hours. Subsequently, the zinc oxide to which the alizarin is added is collected by filtration under a reduced pressure, and dried under reduced pressure at a temperature of 60° C. to obtain alizarin-added zinc oxide.

38 parts by weight of a solution prepared by dissolving 60 parts by weight of the alizarin-added zinc oxide, 13.5 parts by weight of a curing agent (blocked isocyanate, trade name: Sumidur 3175, manufactured by Sumitomo-Bayer Urethane Co., Ltd.) and 15 parts by weight of a butyral resin (trade name: S-Lec BM-1, manufactured by Sekisui Chemical Co., Ltd.) in 85 parts by weight of methyl ethyl ketone is mixed with 25 parts by weight of methyl ethyl ketone. The mixture is dispersed using a sand mill with the glass beads having a diameter of 1 mm for 2 hours to obtain a dispersion.

0.005 parts by weight of dioctyltin dilaurate as a catalyst, and 40 parts by weight of silicone resin particles (trade name: Tospal 145, manufactured by GE Toshiba Silicone Co., Ltd.) are added to the dispersion to obtain a coating solution for a undercoating layer A undercoating layer having a thickness of 18 μm is formed by applying the coating solution on an aluminum substrate having a diameter of 30 mm, a length of 340 mm and a thickness of 1 mm by dip coating, and drying to cure at a temperature of 170° C. for 40 minutes.

(Formation of Charge Generating Layer)

A mixture comprising 15 parts by weight of hydroxy gallium phthalocyanine having the diffraction peaks at least at 7.3°, 16.0°, 24.9° and 28.0° of Bragg angles (2θ±0.2°) in an X-ray diffraction spectrum of Cukα X ray as a charge generating substance, 10 parts by weight of vinyl chloride-vinyl acetate copolymer resin (trade name: VMCH, manufactured by Nippon Unicar Co., Ltd.) as a binding resin, and 200 parts by weight of n-butyl acetate is dispersed using a sand mill with the glass beads of 1 mm diameter for 4 hours. 175 parts by weight of n-butyl acetate and 180 parts by weight of methyl ethyl ketone are added to the obtained dispersion, then stirred to obtain a coating solution for a charge generating layer. The coating solution for charge generating layer is applied to the undercoating layer by dip coating, and dried at an ordinary temperature (25° C.) to form a charge generating layer having a film thickness of 0.2 μm.

(Formation of Charge Transporting Layer)

45 parts by weight of N,N'-diphenyl-N,N'-bis(3-methylphenyl)-[1,1']biphenyl-4,4'-diamine and 55 parts by weight of bisphenol Z polycarbonate resin (viscosity average molecular weight: 50,000) are dissolved in 800 parts by weight of chlorobenzene to obtain a coating solution for a charge transporting layer. The coating solution is applied onto the charge generating layer, then dried at a temperature of 130° C. for 45 minutes to form a charge transporting layer having a film thickness of 15 μm.

(Formation of Protective Layer)

A protective layer-forming coating solution is prepared by blending 30 parts by weight of a specific charge transporting material (Compound A-4), 0.2 parts by weight of colloidal silica (trade name: PL-1, manufactured by Fuso Chemical Co., Ltd.), 30 parts by weight of toluene, 0.1 parts by weight of 3,5-di-t-butyl-4-hydroxytoluene (BHT), and 0.2 parts by weight of azobisisobutyro-nitrile. The obtained coating solution is coated on a charge transporting layer by a spray coating method, the coated layer is subjected to air drying at room temperature for 30 minutes, heating from room temperature to 150° C. for 30 minutes, and heating-curing treatment at 150° C. for 30 minutes to obtain a protective layer having a thickness of 10 μm.

An electrophotographic photoreceptor is obtained according to the above method. The photoreceptor is taken as Photoreceptor 1.

—Evaluation—

<Evaluation of Image Quality>

The electrophotographic photoreceptor made as described above is mounted on DocuCentre Color 400CP manufactured by Fuji Xerox Co., Ltd., and continuously subjected to the following evaluations under low temperature and low humidity (8° C., 20% RH), and high temperature and high humidity (28° C., 85% RH).

More specifically, image formation test is conducted on 3000 sheets at low temperature and low humidity environment (8° C., 20% RH). After the image formation test on 3000 sheets, the image forming apparatus is allowed to stand for 24 hours in the low temperature and low humidity environment (8° C., 20% RH). As for image quality of the image printed on the $3000^{th}$ sheet immediately after the image formation test on 3000 sheets, and the image printed on the first sheet after standing, image quality uniformity, fog, streak and image deletion are evaluated. The results are shown in Table 4.

After that, image formation test on 3,000 sheets is performed in the high temperature and high humidity environment (28° C., 85% RH) after image formation test in the low temperature and low humidity environment. After the image formation test on 3000 sheets, the image forming apparatus is allowed to stand for 24 hours in the high temperature and high humidity environment (28° C., 85% RH). As for image quality of the image printed on the $3000^{th}$ sheet immediately after the image formation test on 3000 sheets, and the image printed on the first sheet after standing, image quality uniformity, fog, streak and image deletion are evaluated.

The results of evaluation are shown in Table 5 below.

In image formation test, paper "P" (manufactured by Fuji Xerox Co., Ltd., 210 mm×297 mm, crossfeed) is used.

<Evaluation of Uniformity of Image Quality>

Figure 6A:
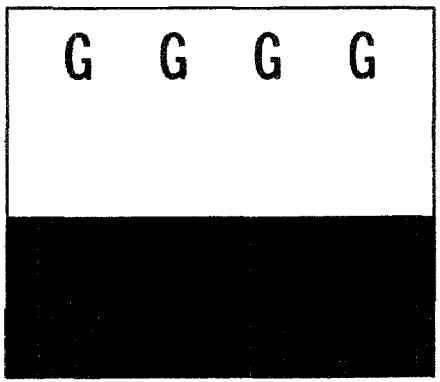
FIG. 6A is a drawing showing the image pattern for use in image evaluation.
Figure 6B:
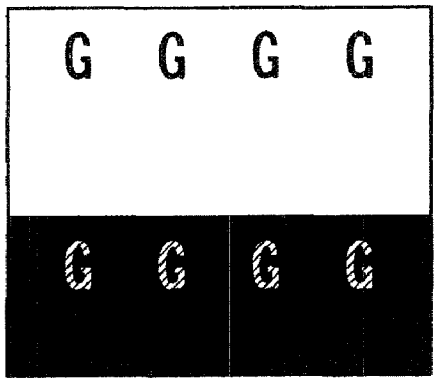
FIG. 6B is a drawing showing the image pattern for use in image evaluation.
Figure 6C:
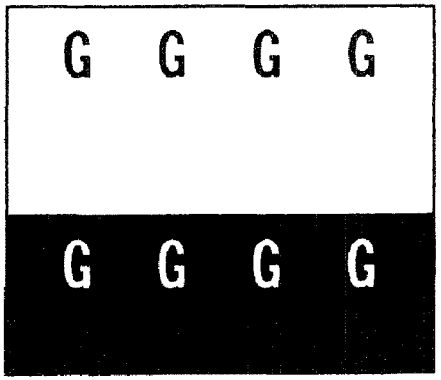
FIG. 6C is a drawing showing the image pattern for use in image evaluation.

A chart of a pattern having letters and a black area of density of 30% shown in FIG. 6 is printed, and density unevenness of the black region of density of 30% is visually observed as uniformity of image quality.

A: Density unevenness is from good to slight.

B: Density unevenness is observed a little.

C: Density unevenness is clearly observed.

<Evaluation of Fogs>

The degree of toner adhesiveness to the white area is evaluated by visual observation using the same sample with the evaluation of uniformity of image quality.

A: Good.

B: Light fog is developed.

C: Fog having a damaging effect of image quality is developed.

<Evaluation of Streaks>

Development of streaks is evaluated by visual observation using the same sample with the evaluation of uniformity of image quality.

A: Good.

B: Streaks are partially developed.

C: Streaks having a damaging effect on image quality are developed.

<Evaluation of Image Degradation>

Image degradation is evaluated by using the same sample as in the above image quality evaluation, and blur of plenty of lines of black region of density of 30% is judged by visual observation.

A: Good

B: Blur does not occur during continuous printing but generated after standing for one day (24 hours).

C: Blur occurs even during continuous printing.

—Evaluation of Protective Layer (Outermost Layer)—

Adhesion and abrasion loss of the protective layer (outermost layer) are evaluated as follows.

<Evaluation of Adhesion of Protective Layer>

After performing image formation test on 6,000 sheets in total in the low temperature and low humidity environment, and in the high temperature and high humidity environment as above, 5×5 of 2 mm square of notches are made on the protective layer with a cutter knife, a mending tape (manufactured by Sumitomo 3M Limited) is stuck and peeled. Adhesion of the protective layer is evaluated by the number that remain when the mending tape is peeled.

The more the residual number, the more excellent is the adhesion of the protective layer to the lower layer.

A: 21 or more remain.

B: 11 to 20 remain.

C: 10 or less remain.

The results of evaluation are shown in Table 4 below.

<Measurement of Abrasion Loss of Outermost Layer>

After performing image formation test on 6,000 sheets in total at low temperature low humidity and high temperature high humidity, abrasion loss of the photoreceptor is measured and this is taken as abrasion loss of the outermost layer.

The smaller the abrasion loss, the higher is the mechanical strength of the outermost layer.

The results of evaluation are shown in Table 5 below.

Examples 2 to 16

Photoreceptors 2 to 16 are manufactured in the same manner as in Example 1 except for changing the specific charge transporting material (a), other charge transporting materials, and the kinds and blending amounts of various additives (particles, polymers, curing agents, antioxidants, and curing catalysts) according to Tables 1 to 3, and evaluations are performed. The thickness of each protective layer is adjusted with DocuCentre Color 400CP to a thickness capable of obtaining proper potential.

The results of evaluation are shown in Tables 4 and 5.

Examples 17 to 25

Photoreceptors 17 to 25 are manufactured in the same manner as in Examples 1 to 9 respectively except for changing the binder resin used in formation of the charge transporting layer to bisphenol Z polycarbonate resin (viscosity average molecular weight: 55,000), and evaluations are performed in the same manner as in Example 1. The thickness of each protective layer is adjusted with DocuCentre Color 400CP to a thickness capable of obtaining proper potential.

The results of evaluations are shown in Tables 4 and 5.

Example 26

Photoreceptor 26 is manufactured in the same manner as in Example 1 except for changing the formation of the charge transporting layer as follows, and evaluations are performed. The results of evaluations are shown in Tables 4 and 5.

(Formation of Charge Transporting Layer)

Compound (a) having the structure shown below (45 parts by weight) and 55 parts by weight of bisphenol Z polycarbonate resin (viscosity average molecular weight: 40,000) are added to 800 parts by weight of chlorobenzene and dissolved to obtain a charge transporting layer-forming coating solution. The coating solution is coated on a charge-generating layer and dried at 130° C. for 45 minutes to obtain a charge-transporting layer having a thickness of 17 μm.

Compound (a)

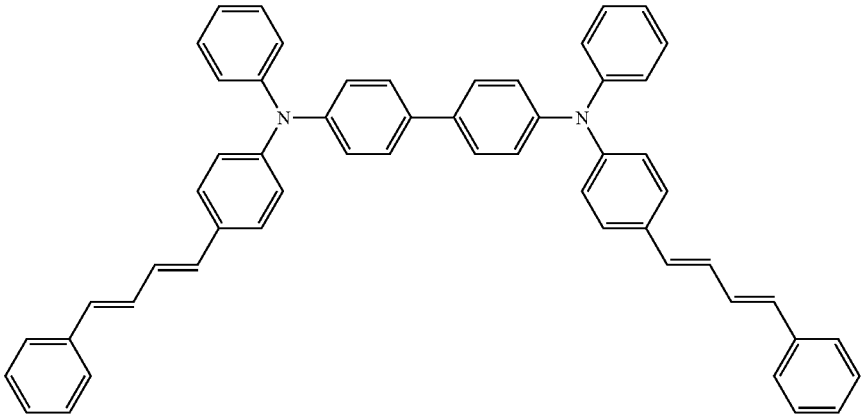

Example 27

Photoreceptor 27 is manufactured in the same manner as in Example 1 except for changing the formation of the charge transporting layer as follows, and evaluations are performed. The results of evaluations are shown in Tables 4 and 5.

(Formation of Charge Transporting Layer)

Compound (b) having the structure shown below (50 parts by weight) and 50 parts by weight of bisphenol Z polycarbonate resin (viscosity average molecular weight: 50,000) are added to 800 parts by weight of chlorobenzene and dissolved to obtain a charge transporting layer-forming coating solution. The coating solution is coated on a charge-generating layer and dried at 130° C. for 45 minutes to obtain a charge transporting layer having a thickness of 15 μm.

Compound (b)

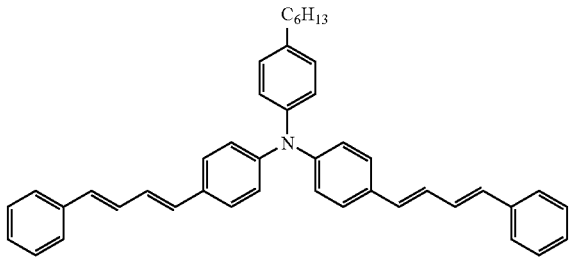

Example 28

Photoreceptor 28 is manufactured in the same manner as in Example 1 except for changing the formation of the charge transporting layer as follows, and evaluations are performed. The results of evaluations are shown in Tables 4 and 5.

(Formation of Charge Transporting Layer)

Compound (c) having the structure shown below (50 parts by weight) and 50 parts by weight of bisphenol Z polycarbonate resin (viscosity average molecular weight: 80,000) are added to 800 parts by weight of chlorobenzene and dissolved to obtain a charge transporting layer-forming coating solution. The coating solution is coated on a charge-generating layer and dried at 130° C. for 45 minutes to obtain a charge transporting layer having a thickness of 15 μm.

Compound (c)

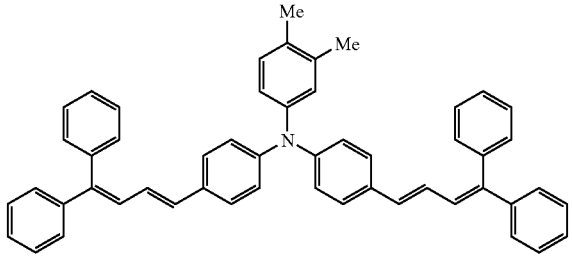

Example 29

Formation up to the charge-generating layer is performed in the same manner as in Example 1. After that, the charge transporting layer is formed as follows to prepare photoreceptor 29 and evaluations are carried out in the same manner as in Example 1. The results of evaluations are shown in Tables 4 and 5.

(Formation of Charge Transporting Layer)

A charge transporting layer-forming coating solution is prepared by blending 30 parts by weight of a specific charge transporting material (Compound A-4), 10 parts by weight of Compound (b), 5 parts by weight of PMMA, 30 parts by weight of toluene, 0.1 parts by weight of 3,5-di-t-butyl-4-hydroxytoluene (BHT), and 0.2 parts by weight of azobisisobutyronitrile. The obtained coating solution is coated on a charge generating layer by a dip coating method, the coated layer is subjected to air drying at room temperature for 30 minutes, heating from room temperature to 150° C. for 30 minutes, and heating-curing treatment at 150° C. for 30 minutes to form a charge transporting layer having a thickness of 20 μm, and obtain a photoreceptor in Example 29.

Example 30

Formation up to the charge-generating layer is performed in the same manner as in Example 1. After that, the charge transporting layer is formed as follows to prepare photoreceptor 30 and evaluations are carried out in the same manner as in Example 1. The results of evaluations are shown in Tables 4 and 5.

(Formation of Charge Transporting Layer)

A charge transporting layer-forming coating solution is prepared by blending 30 parts by weight of a specific charge transporting material (Compound A-17), 10 parts by weight of Compound (c), 5 parts by weight of PC(Z), 30 parts by weight of toluene, 0.1 parts by weight of 3,5-di-t-butyl-4-hydroxytoluene (BHT), and 0.2 parts by weight of azoisobutyronitrile. The obtained coating solution is coated on a charge generating layer by a dip coating method, the coated layer is subjected to air drying at room temperature for 30 minutes, heating from room temperature to 150° C. for 30 minutes, and heating-curing treatment at 150° C. for 30 minutes to form a charge transporting layer having a thickness of 20 μm, and obtain a photoreceptor in Example 30.

Example 31

Formation up to the charge transporting layer is performed in the same manner as in Example 1. After that, the protective layer is formed as follows to prepare photoreceptor 31 and evaluations are carried out in the same manner as in Example 1. The results of evaluations are shown in Tables 4 and 5.

(Formation of Protective Layer)

A protective layer-forming coating solution is prepared by blending 30 parts by weight of a specific charge transporting material (Compound A-4), 0.2 parts by weight of colloidal silica (trade name: PL-1, manufactured by Fuso Chemical Co., Ltd.), 30 parts by weight of toluene, 0.1 parts by weight of 3,5-di-t-butyl-4-hydroxytoluene (BHT), and 0.2 parts by weight of 2,4,6-trimethyl-benzoyldiphenyl phosphine oxide (a photo-curing catalyst x). The obtained coating solution is coated on a charge transporting layer by a spray coating method, the coated layer is subjected to air drying at room temperature for 30 minutes, and then light irradiation with a metal halide lamp on the condition of irradiation intensity of 500 mW/cm$^2$ and irradiation time of 300 seconds for photopolymerization curing to form a protective layer having a thickness of 10 μm, and obtain a photoreceptor in Example 31.

Example 32

Formation up to the charge transporting layer is performed in the same manner as in Example 1. After that, the protective layer is formed as follows to prepare photoreceptor 32 and evaluations are carried out in the same manner as in Example 1. The results of evaluations are shown in Tables 4 and 5.

(Formation of Protective Layer)

A protective layer-forming coating solution is prepared by blending 30 parts by weight of a specific charge transporting material (Compound A-4), 0.2 parts by weight of colloidal silica (trade name: PL-1, manufactured by Fuso Chemical Co., Ltd.), 30 parts by weight of toluene, and 0.1 parts by weight of 3,5-di-t-butyl-4-hydroxytoluene (BHT). The obtained coating solution is coated on a charge transporting layer by a spray coating method, the coated layer is subjected to air drying at room temperature for 30 minutes, and then electron beam curing with an electron beam irradiation apparatus to form a protective layer having a thickness of 10 μm, and obtain a photoreceptor in Example 32.

Comparative Examples 1 to 3

Comparative photoreceptors 1 to 3 are manufactured in the same manner as in Example 1 except for changing the specific charge transporting material (Compound A-4) for use in a protective layer to other charge transporting materials Compound I-8, Compound II-7 and Compound III-2, respectively, and evaluations are performed in the same manner as in Example 1.

The results of evaluation are shown in Tables 4 and 5.

Comparative Examples 4 to 6

Comparative photoreceptors 4 to 6 are manufactured in the same manner as in Example 3 except for changing the specific charge transporting material (Compound A-5) for use in a protective layer to other charge transporting materials Compound I-8, Compound II-7 and Compound III-2, respectively, and evaluations are performed in the same manner as in Example 1.

The results of evaluation are shown in Tables 4 and 5.

Comparative Examples 7 to 9

Comparative photoreceptors 7 to 9 are manufactured in the same manner as in Example 4 except for changing the specific charge transporting material (Compound A-9) for use in a protective layer to other charge transporting materials Compound I-8, Compound II-7 and Compound III-2, respectively, and evaluations are performed in the same manner as in Example 1.

The results of evaluation are shown in Tables 4 and 5.

Comparative Examples 10 to 12

Comparative photoreceptors 10 to 12 are manufactured in the same manner as in Example 14 except for changing the specific charge transporting material (Compound A-4) for use in a protective layer to other charge transporting materials Compound I-8, Compound II-7 and Compound III-2, respectively, and evaluations are performed in the same manner as in Example 1.

The results of evaluation are shown in Tables 4 and 5.

TABLE 1

| | | | | Additives | | | | |
|---|---|---|---|---|---|---|---|---|
| Example No. | Specific Charge Transporting Material (blending amount: parts by weight) | Other Charge Transporting Material (blending amount: parts by weight) | Other Charge Transporting Material (blending amount: parts by weight) | Particles (blending amount: parts by weight) | Polymer, Curing Agent (blending amount: parts by weight) | Antioxidant (blending amount: parts by weight) | Curing Catalyst (blending amount: parts by weight) | Thickness of Outermost Layer (μm) |
| Example 1 | A-4 (30) | — | — | PL-1 (0.2) | — | BHT (0.1) | AIBN (0.2) | 10 |
| Example 2 | A-2 (30) | — | — | L-2 (0.3) | PC (Z) (1) | BHT (0.1) | AIBN (0.2) | 9 |
| Example 3 | A-5 (30) | — | — | — | PMMA (1) | — | AIBN (0.2) | 9 |
| Example 4 | A-9 (30) | — | — | — | R-Resin (2) | BHT (0.1) | AIBN (0.2) | 7 |
| Example 5 | A-11 (30) | — | — | PL-1 (0.2) | — | BHT (0.1) | PBC (0.2) | 10 |
| Example 6 | A-17 (30) | — | — | L-2 (0.3) | — | SANOL LS770 (0.1) | OTA (0.2) | 10 |
| Example 7 | A-18 (30) | — | — | — | — | — | AIBN (0.2) | 11 |
| Example 8 | A-21 (30) | — | — | R-1T (0.3) | PMMA (1) | — | AIBN (0.2) | 9 |
| Example 9 | A-18 (25) | I-8 (5) | — | — | PC (Z) (1) | BHT (0.1) | AIBN (0.2) | 9 |
| Example 10 | A-18 (25) | II-7 (5) | — | — | PC (Z) (1) | BHT (0.1) | AIBN (0.2) | 9 |
| Example 11 | A-18 (25) | II-19 (5) | — | — | PC (Z) (1) | BHT (0.1) | AIBN (0.2) | 9 |
| Example 12 | A-18 (25) | III-2 (5) | — | — | PMMA (1) | — | PBC (0.2) | 9 |
| Example 13 | A-4 (20) | I-9 (5) | II-19 (5) | — | PMMA (1) | — | OTA (0.2) | 9 |
| Example 14 | A-4 (5) | I-9 (15) | — | — | THE 330 (10) | BHT (0.1) | AIBN (0.2) | 6 |
| Example 15 | A-4 (10) | II-19 (15) | — | — | IBA (5) | BHT (0.1) | OTA (0.2) | 6 |
| Example 16 | A-4 (5) | I-9 (15) | — | — | ABE-300 (10) | — | AIBN (0.2) | 6 |

TABLE 2

| | Specific Charge | | Additives | | | | |
|---|---|---|---|---|---|---|---|
| Example No. | Transporting Material (blending amount: parts by weight) | Other Charge Transporting Material (blending amount: parts by weight) | Particles (blending amount: parts by weight) | Polymer, Curing Agent (blending amount: parts by weight) | Antioxidant (blending amount: parts by weight) | Curing Catalyst (blending amount: parts by weight) | Thickness of Outermost Layer (μm) |
| Example 17 | A-4 (30) | — | PL-1 (0.2) | — | BHT (0.1) | AIBN (0.2) | 10 |
| Example 18 | A-2 (30) | — | L-2 (0.3) | PC (Z) (1) | BHT (0.1) | AIBN (0.2) | 9 |
| Example 19 | A-5 (30) | — | — | PMMA (1) | — | AIBN (0.2) | 9 |
| Example 20 | A-9 (30) | — | — | R-Resin (2) | BHT (0.1) | AIBN (0.2) | 8 |
| Example 21 | A-11 (30) | — | PL-1 (0.2) | — | BHT (0.1) | PBC (0.2) | 10 |
| Example 22 | A-17 (30) | — | L-2 (0.3) | — | SANOL LS770 (0.1) | OTA (0.2) | 10 |
| Example 23 | A-18 (30) | — | — | PC (Z) (1) | BHT (0.1) | AIBN (0.2) | 9 |
| Example 24 | A-21 (30) | — | R-1T (0.3) | PMMA (1) | — | AIBN (0.2) | 9 |
| Example 25 | A-18 (30) | I-8 (5) | — | PC (Z) (1) | BHT (0.1) | AIBN (0.2) | 9 |
| Example 26 | A-4 (30) | — | PL-1 (0.2) | — | BHT (0.1) | AIBN (0.2) | 10 |

TABLE 2-continued

| Example No. | Specific Charge Transporting Material (blending amount: parts by weight) | Other Charge Transporting Material (blending amount: parts by weight) | Additives: Particles (blending amount: parts by weight) | Additives: Polymer, Curing Agent (blending amount: parts by weight) | Additives: Antioxidant (blending amount: parts by weight) | Additives: Curing Catalyst (blending amount: parts by weight) | Thickness of Outermost Layer (μm) |
|---|---|---|---|---|---|---|---|
| Example 27 | A-4 (30) | — | PL-1 (0.2) | — | BHT (0.1) | AIBN (0.2) | 10 |
| Example 28 | A-4 (30) | — | PL-1 (0.2) | — | BHT (0.1) | AIBN (0.2) | 10 |
| Example 29 | A-4 (30) | Compound (b) (10) | — | PMMA (5) | BHT (0.1) | AIBN (0.2) | 20 |
| Example 30 | A-17 (30) | Compound (c) (10) | — | PMMA (5) | BHT (0.1) | AIBN (0.2) | 20 |
| Example 31 | A-4 (30) | — | PL-1 (0.2) | — | BHT (0.1) | Photo-curable catalyst x (0.2) | 10 |
| Example 32 | A-4 (30) | — | PL-1 (0.2) | — | BHT (0.1) | — | 10 |

15

TABLE 3

| Example No. | Specific Charge Transporting Material (blending amount: parts by weight) | Other Charge Transporting Material (blending amount: parts by weight) | Additives: Particles (blending amount: parts by weight) | Additives: Polymer, Curing Agent (blending amount: parts by weight) | Additives: Antioxidant (blending amount: parts by weight) | Additives: Curing Catalyst (blending amount: parts by weight) | Thickness of Outermost Layer (μm) |
|---|---|---|---|---|---|---|---|
| Comparative Example 1 | I-8 (30) | — | PL-1 (0.2) | — | BHT (0.1) | AIBN (0.2) | 10 |
| Comparative Example 2 | II-7 (30) | — | PL-1 (0.2) | — | BHT (0.1) | AIBN (0.2) | 10 |
| Comparative Example 3 | III-2 (30) | — | PL-1 (0.2) | — | BHT (0.1) | AIBN (0.2) | 10 |
| Comparative Example 4 | I-8 (30) | — | — | PMMA (1) | — | AIBN (0.2) | 9 |
| Comparative Example 5 | II-7 (30) | — | — | PMMA (1) | — | AIBN (0.2) | 9 |
| Comparative Example 6 | III-2 (30) | — | — | PMMA (1) | — | AIBN (0.2) | 9 |
| Comparative Example 7 | I-8 (30) | — | — | R-Resin (2) | BHT (0.1) | AIBN (0.2) | 8 |
| Comparative Example 8 | II-7 (30) | — | — | R-Resin (2) | BHT (0.1) | AIBN (0.2) | 8 |
| Comparative Example 9 | III-2 (30) | — | — | R-Resin (2) | BHT (0.1) | AIBN (0.2) | 8 |
| Comparative Example 10 | I-8 (5) | I-9 (15) | — | THE330(10) | BHT (0.1) | AIBN (0.2) | 6 |
| Comparative Example 11 | II-7 (5) | I-9 (15) | — | THE330(10) | BHT (0.1) | AIBN (0.2) | 6 |
| Comparative Example 12 | III-2 (5) | I-9 (15) | — | THE330(10) | BHT (0.1) | AIBN (0.2) | 6 |

TABLE 4

| Ex. No. | Image Formation Test in the Low Temperature and Low Humidity (8° C., 20% RH): Image on 3,000$^{th}$ Sheet: Image Quality Uniformity | Fog | Streak | Image degradation | First Image after Standing for 24 Hours: Image Quality Uniformity | Fog | Streak | Image degradation | Adhesion |
|---|---|---|---|---|---|---|---|---|---|
| Ex. 1 | A | A | A | A | A | A | A | A | B |
| Ex. 2 | A | A | A | A | A | A | A | A | A |
| Ex. 3 | A | A | A | A | A | A | A | A | A |
| Ex. 4 | A | A | A | A | A | A | A | A | B |
| Ex. 5 | A | A | A | A | A | A | A | A | A |
| Ex. 6 | A | A | B | A | A | A | B | A | B |
| Ex. 7 | A | A | A | A | A | A | A | A | A |
| Ex. 8 | A | A | A | A | A | A | A | A | A |
| Ex. 9 | A | A | A | A | A | A | A | A | A |
| Ex. 10 | A | A | A | A | A | A | A | A | B |
| Ex. 11 | A | A | A | A | A | A | A | A | A |
| Ex. 12 | A | A | A | A | A | A | A | A | A |

TABLE 4-continued

| | Image Formation Test in the Low Temperature and Low Humidity (8° C., 20% RH) | | | | | | | | |
|---|---|---|---|---|---|---|---|---|---|
| | Image on 3,000th Sheet | | | | First Image after Standing for 24 Hours | | | | |
| Ex. No. | Image Quality Uniformity | Fog | Streak | Image degradation | Image Quality Uniformity | Fog | Streak | Image degradation | Adhesion |
| Ex. 13 | A | A | A | A | A | A | A | A | A |
| Ex. 14 | A | A | A | A | A | B | A | A | A |
| Ex. 15 | A | A | A | A | A | B | A | A | A |
| Ex. 16 | A | A | A | A | A | B | A | A | B |
| Ex. 17 | A | A | A | A | A | A | A | A | A |
| Ex. 18 | A | A | A | A | A | A | A | A | A |
| Ex. 19 | A | A | A | A | A | A | A | A | A |
| Ex. 20 | A | A | A | A | A | A | A | A | A |
| Ex. 21 | A | A | A | A | A | A | A | A | A |
| Ex. 22 | A | A | A | A | A | A | A | A | A |
| Ex. 23 | A | A | A | A | A | A | A | A | A |
| Ex. 24 | A | A | A | A | A | A | A | A | A |
| Ex. 25 | A | A | A | A | A | A | A | A | A |
| Ex. 26 | A | A | A | A | A | A | A | A | B |
| Ex. 27 | A | A | A | A | A | A | A | A | A |
| Ex. 28 | A | A | A | A | A | A | A | A | A |
| Ex. 29 | A | A | A | A | A | A | A | A | — |
| Ex. 30 | A | A | A | A | A | A | A | A | — |
| Ex. 31 | A | A | B | A | A | A | B | A | B |
| Ex. 32 | A | A | B | A | A | A | B | A | B |
| Comp. Ex. 1 | The image cannot be obtained due to curing failure of the outermost layer. | | | | | | | | |
| Comp. Ex. 2 | A | A | A | A | A | A | A | A | A |
| Comp. Ex. 3 | B | A | A | A | B | A | A | A | B |
| Comp. Ex. 4 | The image cannot be obtained due to curing failure of the outermost layer. | | | | | | | | |
| Comp. Ex. 5 | A | B | A | A | A | B | A | A | A |
| Comp. Ex. 6 | B | B | A | A | B | B | A | A | B |
| Comp. Ex. 7 | The image cannot be obtained due to curing failure of the outermost layer. | | | | | | | | |
| Comp. Ex. 8 | A | A | A | A | A | A | A | A | A |
| Comp. Ex. 9 | B | B | A | A | A | B | A | A | B |
| Comp. Ex. 10 | A | B | A | A | B | B | A | A | A |
| Comp. Ex. 11 | A | B | A | A | A | B | A | A | A |
| Comp. Ex. 12 | B | B | A | A | B | B | A | A | B |

TABLE 5

| | Image Formation Test in the High Temperature and High Humidity Environment (28° C., 85% RH) | | | | | | | | |
|---|---|---|---|---|---|---|---|---|---|
| | Image on 3,000th Sheet | | | | First Image after Standing for 24 Hours | | | | |
| Ex. No. | Image Quality Uniformity | Fog | Streak | Image degradation | Image Quality Uniformity | Fog | Streak | Image degradation | Abrasion Loss (μm) |
| Ex. 1 | A | A | A | A | A | A | A | B | 0.1 |
| Ex. 2 | A | A | A | A | A | A | A | A | 0.2 |
| Ex. 3 | A | A | A | A | A | A | A | A | 0.2 |
| Ex. 4 | A | A | A | A | A | A | A | A | 0.2 |
| Ex. 5 | A | A | A | A | A | A | A | B | 0.1 |
| Ex. 6 | A | A | B | A | A | A | B | A | 0.3 |
| Ex. 7 | A | A | A | A | A | A | A | A | 0.1 |
| Ex. 8 | A | A | A | A | A | A | A | A | 0.2 |
| Ex. 9 | A | A | A | A | A | A | A | A | 0.3 |
| Ex. 10 | A | A | A | A | A | A | A | A | 0.3 |
| Ex. 11 | A | A | A | A | A | A | A | A | 0.3 |
| Ex. 12 | A | A | A | A | A | A | A | A | 0.2 |
| Ex. 13 | A | A | A | A | A | A | A | A | 0.4 |
| Ex. 14 | A | A | A | A | A | A | B | A | 0.5 |
| Ex. 15 | A | A | A | A | A | A | B | A | 0.4 |

TABLE 5-continued

| | Image Formation Test in the High Temperature and High Humidity Environment (28° C., 85% RH) | | | | | | | | |
|---|---|---|---|---|---|---|---|---|---|
| | Image on 3,000$^{th}$ Sheet | | | | First Image after Standing for 24 Hours | | | | |
| Ex. No. | Image Quality Uniformity | Fog | Streak | Image degradation | Image Quality Uniformity | Fog | Streak | Image degradation | Abrasion Loss (μm) |
| Ex. 16 | A | A | A | A | A | A | B | A | 0.6 |
| Ex. 17 | A | A | A | A | A | A | A | B | 0.1 |
| Ex. 18 | A | A | A | A | A | A | A | A | 0.2 |
| Ex. 19 | A | A | A | A | A | A | A | A | 0.2 |
| Ex. 20 | A | A | A | A | A | A | A | A | 0.1 |
| Ex. 21 | A | A | A | A | A | A | A | A | 0.1 |
| Ex. 22 | A | A | A | A | A | A | A | A | 0.3 |
| Ex. 23 | A | A | A | A | A | A | A | A | 0.2 |
| Ex. 24 | A | A | A | A | A | A | A | A | 0.2 |
| Ex. 25 | A | A | A | A | A | A | B | A | 0.3 |
| Ex. 26 | A | A | A | A | A | A | A | B | 0.1 |
| Ex. 27 | A | A | A | A | A | A | A | A | 0.1 |
| Ex. 28 | A | A | A | A | A | A | A | A | 0.1 |
| Ex. 29 | A | A | A | A | A | A | A | A | 0.3 |
| Ex. 30 | A | A | A | A | A | A | A | A | 0.3 |
| Ex. 31 | A | A | B | A | A | A | B | B | 0.1 |
| Ex. 32 | A | A | B | A | A | A | B | B | 0.1 |
| Comp. Ex. 1 | The image cannot be obtained due to curing failure of the outermost layer. | | | | | | | | |
| Comp. Ex. 2 | A | B | C | A | A | B | C | A | 1.5 |
| Comp. Ex. 3 | C | B | B | A | C | B | B | B | 0.5 |
| Comp. Ex. 4 | The image cannot be obtained due to curing failure of the outermost layer. | | | | | | | | |
| Comp. Ex. 5 | A | B | B | A | A | B | C | A | 1.6 |
| Comp. Ex. 6 | C | B | B | A | C | B | B | A | 0.7 |
| Comp. Ex. 7 | The image cannot be obtained due to curing failure of the outermost layer. | | | | | | | | |
| Comp. Ex. 8 | A | A | C | A | A | A | C | A | 1.5 |
| Comp. Ex. 9 | C | C | B | A | C | C | B | B | 0.5 |
| Comp. Ex. 10 | A | B | C | A | A | B | C | A | 1.9 |
| Comp. Ex. 11 | A | B | C | A | A | B | C | A | 1.2 |
| Comp. Ex. 12 | C | C | C | A | C | C | C | A | 1.0 |

As shown in Tables 4 and 5, the examples of the invention are good in all of uniformity of image quality, fog, streak, and image degradation as compared with comparative examples.

In the case where electrophotographic photoreceptors of comparative examples are used, the evaluations in image formation test at high temperature and high humidity are inferior to the evaluations in image formation test in low temperature and low humidity. This is because moisture in the air is adsorbed onto the surface of the photoreceptor and electrostatic latent image flows crosswise and goes out of order, and the way of reception of influence differs according to constituting materials.

Synthesis Example 4

Synthesis of Compound (IV-4)

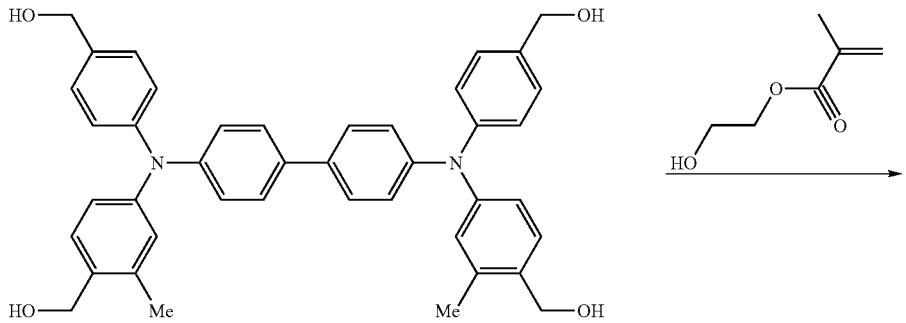

(1)

-continued

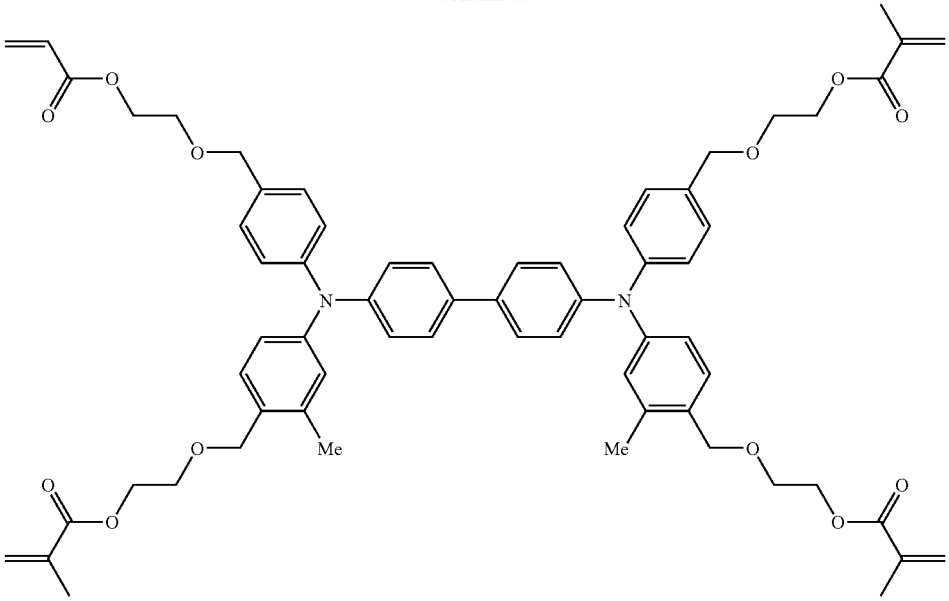

(IV-4)

Figure 14:
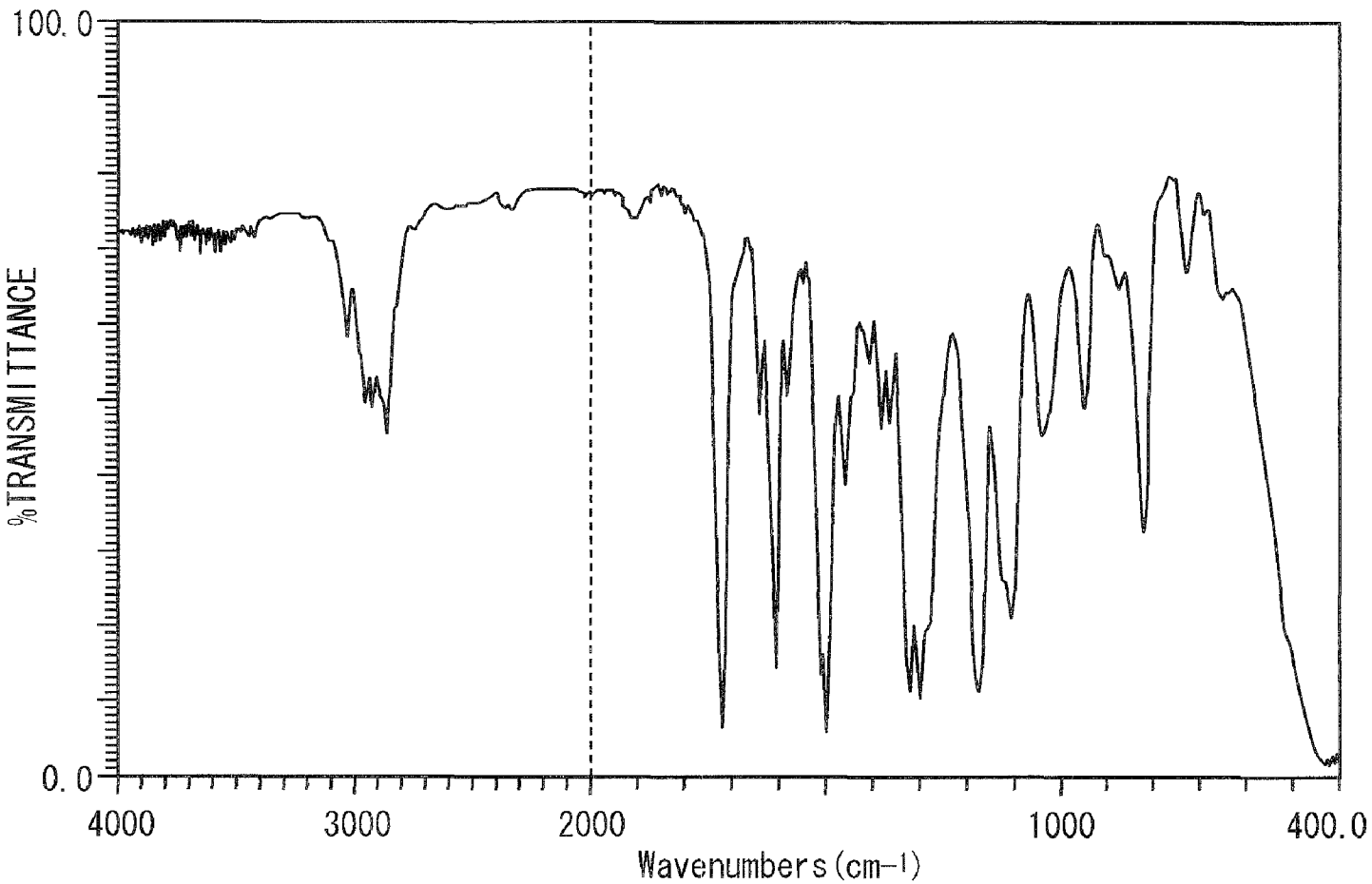
FIG. 14 is an IR spectrum of compound (IV-4).

The above Compound (1) (10 g), 50 g of hydroxyethyl methacrylate, 20 ml of tetrahydrofuran, and 0.5 g of Amberlyst 15E (manufactured by ORGANO CORPORATION) are put into a 200 ml flask, and stirred at room temperature for 24 hours. After termination of reaction, 100 ml of methanol is added to the reaction solution, and a precipitated oily product is taken out by decantation. The oily product is refined by silica gel column chromatography to obtain 12 g of oily Compound (IV-4). The IR spectrum of the obtained (IV-4) is shown in FIG. 14.

Example 33

(Manufacture of Undercoating Layer)

One-hundred (100) parts by weight of zinc oxide (average particle size: 70 nm, manufactured by TAYCA CORPORATION, specific surface area value: 15 $m^2/g$) and 500 parts by weight of toluene are stirred and mixed, and then 1.3 parts by weight of a silane coupling agent (KBM503, manufactured by Shin-Etsu Chemical Co., Ltd.) is added thereto and stirred for 2 hours. After that, toluene is distilled off under reduced pressure, and the reaction product is baked at 120° C. for 3 hours to obtain surface-treated zinc oxide with silane coupling agent.

The surface-treated zinc oxide (110 parts by weight) is stirred and mixed with 500 parts by weight of tetrahydrofuran, and a solution obtained by dissolving 0.6 parts by weight of alizarin in 50 parts by weight of tetrahydrofuran is added thereto, and the mixture is stirred at 50° C. for 5 hours. After that, the alizarin-clad zinc oxide is collected by filtration under reduced pressure and further dried at 60° C. under reduced pressure to obtain alizarin-clad zinc oxide.

Thirty-eight (38) parts by weight of a solution obtained by dissolving 60 parts by weight of the alizarin-clad zinc oxide, 13.5 parts by weight of a curing agent (blocked isocyanate, Sumidule 3175, manufactured by Sumika Bayer Urethane Co., Ltd.), and 15 parts by weight of butyral resin (S-LEC BM-1, manufactured by Sekisui Chemical Co., Ltd.) in 85 parts by weight of methyl ethyl ketone, and 25 parts by weight of methyl ethyl ketone are mixed, and the mixture is dispersed by means of glass beads having a diameter of 1 mmϕ in a sand mill for 2 hours.

To the obtained dispersion, 0.005 parts by weight of dioctyltin dilaurate as a catalyst and 40 parts by weight of silicone resin particles (Tospearl 145, manufactured by GE Toshiba Silicones Co., Ltd.) are added to obtain a coating solution for forming an undercoating layer. The obtained coating solution is coated on an aluminum substrate having a diameter of 30 mm, a length of 340 mm, and a thickness of 1 mm by a dip coating method and dried for curing at 170° C. for 40 minutes to obtain an undercoating layer having a thickness of 18 μm.

(Manufacture of Charge-Generating Layer)

A mixture comprising 15 parts by weight of hydroxygallium phthalocyanine having diffraction peaks at least at the positions of 7.3°, 16.0°, 24.9° and 28.0° of Bragg angles (2θ±0.2°) of an X-ray diffraction spectrum using Cukα X-ray as a charge generating material, 10 parts by weight of vinyl chloride-vinyl acetate copolymer resin (trade name: VMCH, manufactured by Nippon Unicar Co., Ltd.) as a binder resin, and 200 parts by weight of n-butyl acetate is dispersed with a sand mill by means of glass beads having a diameter of 1 mmϕ for 4 hours. A coating solution for forming a charge-generating layer is obtained by adding 175 parts by weight of n-butyl acetate and 180 parts by weight of methyl ethyl ketone to the obtained dispersion. The coating solution for a charge-generating layer is coated on the undercoating layer by a dip coating method and dried at room temperature to obtain a charge generating layer having a thickness of 0.2 μm.

(Manufacture of Charge Transporting Layer)

A coating solution is prepared by blending 80 parts by weight of the foregoing Compound (IV-4), 3 parts by weight of colloidal silica (trade name: PL-1, manufactured by Fuso Chemical Co., Ltd.), 15 parts by weight of a polyvinylphenol resin (weight average molecular weight: about 8,000, manufactured by Aldrich Chemical Company), 100 parts by weight of monochlorobenzene, 2 parts by weight of 3,5-di-t-butyl-4-hydroxytoluene (BHT) as antioxidant, and 0.1 parts by weight of p-toluenesulfonic acid. The coating solution is coated on the charge-generating layer by a dip coating method, and the coated layer is subjected to air drying at room temperature for 30 minutes, and then irradiation with UV ray for 60 seconds to cure the film under the state of nitrogen flow and heating at 150° C. with a Uni-Cure System (manufactured by Ushio Inc.) to obtain an electrophotographic photoreceptor in Example 33.

The thickness of the charge-transporting layer of the photoreceptor is 30 μm.

(Evaluation of Image Quality)

The thus-manufactured electrophotographic photo-receptor is mounted on DocuCentre Color 400CP (manufactured by Fuji Xerox Co., Ltd.), and the following evaluations (ghost, fog and streak) are continuously carried out in low temperature and low humidity (18° C., 20% RH).

That is to say, image formation test is performed on 100 sheets at a low temperature and low humidity environment (18° C., 20% RH), and the image quality of $100^{th}$ sheet is evaluated. Subsequently, image formation test is performed on 50,000 sheets and the image quality of $50{,}000^{th}$ sheet is evaluated. The results of these tests are shown in Table 7.

<Evaluation of Ghost>

Figure 13A:
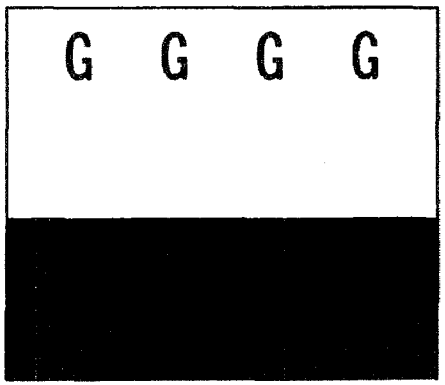
FIG. 13A is an explanatory drawing showing the standard of ghost evaluation.

A chart of a pattern having letters of G and a black area as shown in FIG. 13A is printed, and the state of appearance of the letters of G in the solid black area is visually observed and evaluated as ghost. The criteria of evaluation are as follows.

A: The degree is from good to slight as in FIG. 13A.

Figure 13B:
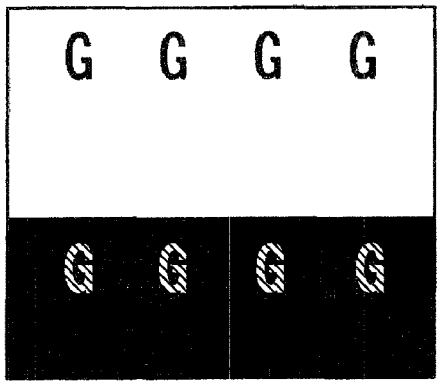
FIG. 13B is an explanatory drawing showing the standard of ghost evaluation.

B: Slightly conspicuous as in FIG. 13B.

Figure 13C:
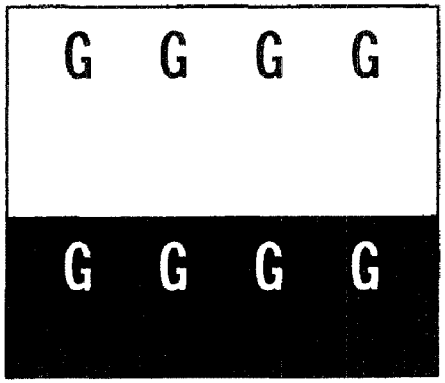
FIG. 13C is an explanatory drawing showing the standard of ghost evaluation.

C: Clearly observed as in FIG. 13C.

<Evaluation of Fog>

The degree of adhesion of the toner to the white area is visually observed and judged by using the same sample with the evaluation of ghost. The criteria of evaluation are as follows.

A: Good.

B: Fog is slightly developed.

C: Fog exerting a bad influence upon image quality is developed.

<Evaluation of Streak>

Streak is visually observed and judged by using the same sample with the evaluation of ghost. The criteria of evaluation are as follows.

A: Good.

B: Streaks are partially developed.

C: Streaks exerting a bad influence upon image quality are developed.

Examples 34 to 39

Electrophotographic photoreceptors in Examples 34 to 39 are manufactured in the same manner as in Example 33 except for changing the compounds represented by formula (A) and additives as shown in Table 6 below, and evaluations are performed in the same manner as in Example 33. The results of evaluations are shown in Table 7 below.

Example 40

Electrophotographic photoreceptor in Example 40 is manufactured as described below by laminating an undercoating layer, a charge-generating layer, charge-transporting layer 1, and charge-transporting layer 2 (this layer also functions as a protective layer) on a conductive substrate in this order, and evaluated in the same manner as in Example 33. A compound represented by formula (A) is used in the formation of charge-transporting layer 2. The results of evaluations are shown in Table 7.

(Manufacture of Undercoating Layer and Charge-Generating Layer)

An undercoating layer and a charge-generating layer are manufactured in the same manner as in Example 33. After that, charge-transporting layers are formed on the charge-generating layer as follows.

(Manufacture of Charge-Transporting Layer 1)

Forty-five (45) parts by weight of N,N'-diphenyl-N,N'-bis-(3-methylphenyl)-[1,1']-biphenyl-4,4'-diamine, and 55 parts by weight of bisphenol Z polycarbonate resin (viscosity average molecular weight: 40,000) are added to 800 parts by weight of chlorobenzene and dissolved to obtain a coating solution for charge-transporting layer 1. The coating solution is coated on the charge-generating layer, and dried at 130° C. for 45 minutes to obtain charge-transporting layer 1 having a thickness of 20 μm.

(Manufacture of Charge-Transporting Layer 2)

A coating solution is prepared by blending 80 parts by weight of the foregoing Compound (IV-4), 3 parts by weight of colloidal silica (trade name: PL-1, manufactured by Fuso Chemical Co., Ltd.), 15 parts by weight of a polyvinylphenol resin (weight average molecular weight: about 8,000, manufactured by Aldrich Chemical Company), 100 parts by weight of monochlorobenzene, 2 parts by weight of 3,5-di-t-butyl-4-hydroxytoluene (BHT), and 0.1 parts by weight of p-toluenesulfonic acid. The coating solution is coated on the charge-transporting layer 1 by a dip coating method, and the coated layer is subjected to air drying at room temperature for 30 minutes, and then irradiation with UV ray for 60 seconds to cure and polymerize the film under the state of nitrogen flow and heating at 150° C. with a Uni-Cure System (manufactured by Ushio Inc.) to form charge-transporting layer 2, thus an electrophotographic photoreceptor in Example 44 is obtained.

The thickness of charge-transporting layer 2 of the photoreceptor is 27 μm.

Example 41

The electrophotographic photoreceptor in Example 41 is manufactured in the same manner as in Example 40 except for forming charge-transporting layer 2 as follows, and evaluations are carried out in the same manner as in Example 33. The results obtained are shown in Table 7.

(Manufacture of Charge-Transporting Layer 2)

A coating solution is prepared by blending 80 parts by weight of the foregoing Compound (IV-16), 3 parts by weight of colloidal silica (trade name: PL-1, manufactured by Fuso Chemical Co., Ltd.), 15 parts by weight of a polyvinylphenol resin (weight average molecular weight: about 8,000, manufactured by Aldrich Chemical Company), 100 parts by weight of monochlorobenzene, 2 parts by weight of 3,5-di-t-butyl-4-hydroxytoluene (BHT) as antioxidant, and 0.1 parts by weight of p-toluenesulfonic acid. The coating solution is coated on the charge-transporting layer 1 by a dip coating method, and the coated layer is subjected to air drying at room temperature for 30 minutes, and then irradiation with UV ray for 60 seconds to cure and polymerize the film under the state of nitrogen flow and heating at 150° C. with a Uni-Cure System (manufactured by Ushio Inc.) to obtain an electrophotographic photoreceptor in Example 41.

The thickness of charge-transporting layer 2 of the photoreceptor is 32 μm.

The results of evaluations in Examples 33 to 41 are shown in Table 7.

TABLE 6

| Ex. No. | Crosslinking Type Charge Transporting Material: Kind (parts by weight) | d + f × e | Crosslinking Type Non-Charge Transporting Material (parts by weight) | Additives: Polymerization Initiator | Particles (parts by weight) | Resin (parts by weight) | Antioxidant (parts by weight) | Thickness of Charge Transporting Layer (μm) |
|---|---|---|---|---|---|---|---|---|
| Ex. 33 | IV-4 (80) | 3 | — | No | PL-1 (3) | Resin 1 (2) | Antioxidant 1 (2) | 30 |
| Ex. 34 | IV-7 (60) | 4 | FA-321M (20) | No | S-1 (3) | Resin 2 (2) | Antioxidant 1 (2) | 33 |
| Ex. 35 | IV-12 (70) | 4 | FA-023M (10) | No | PTFE (3) | — | Antioxidant 2 (2) | 28 |
| Ex. 36 | IV-14 (70) | 4 | FA-321M (10) | No | PL-1 (3) | — | Antioxidant 1 (2) | 35 |
| Ex. 37 | IV-16 (60) | 3 | FA-023M (20) | No | PL-1 (3) | — | Antioxidant 1 (2) | 29 |
| Ex. 38 | IV-18 (80) | 3 | — | No | S-1 (3) | — | Antioxidant 2 (2) | 27 |
| Ex. 39 | IV-4 (80) | 3 | — | No | PL-1 (3) | Resin 1 (2) | Antioxidant 1 (2) | 28 |
| Ex. 40 | IV-4 (65) | 3 | FA-023M (15) | No | PL-1 (3) | Resin 1 (2) | Antioxidant 1 (2) | 47 |
| Ex. 41 | IV-16 (80) | 3 | — | No | PL-1 (3) | Resin 1 (2) | Antioxidant 1 (2) | 32 |

The details of Resin 1, Resin 2, particles, Initiator 1, Antioxidants 1 and 2 in Table 6 are shown below.

Resin 1: Polyvinylphenol resin (weight average molecular weight: about 8,000, manufactured by Aldrich Chemical Company)

Resin 2: Butyral resin (S-LEC BM-1, manufactured by Sekisui Chemical Co., Ltd.)

Particles: PL-1 (manufactured by Fuso Chemical Co., Ltd.), S-1 (manufactured by Titan Kogyo Ltd.)

Initiator 1: Irgacure 184 (manufactured by Ciba Geigy)

Antioxidant 1: BHT

Antioxidant 2: Sanol LS770 (manufactured by Sankyo Lifetech Co., Ltd.)

TABLE 7

(Low temperature and low humidity condition (18° C., 20% RH))

| Example No. | After Test of 100 Sheets: Ghost | Fog | Streak | After Test of 50,000 Sheets: Ghost | Fog | Streak |
|---|---|---|---|---|---|---|
| Example 33 | A | A | B | A | A | B |
| Example 34 | A | A | A | A | A | A |
| Example 35 | A | A | A | A | A | A |
| Example 36 | A | A | A | A | A | A |
| Example 37 | A | A | B | A | A | B |
| Example 38 | A | A | B | A | A | B |
| Example 39 | A | A | A | A | A | A |
| Example 40 | A | A | A | B | B | A |
| Example 41 | A | A | B | B | B | B |

As shown in Table 7, it can be said that deteriorations of electric characteristics and image quality due to repeating use for long are restrained and stable images are obtained in the examples of the invention.

Also, it is apparently seen that the examples are excellent in all of ghost, fog and streak.

What is claimed is:

1. An electrophotographic photoreceptor comprising:

an electrically conductive substrate; and a photo-sensitive layer provided on the conductive substrate, wherein an outermost layer is a cured film comprising a composition containing at least one compound (a) having a triphenylamine structure and four or more methacryloyl groups in one and the same molecule.

2. The electrophotographic photoreceptor according to claim 1, wherein the compound (a) having a triphenylamine structure and four or more methacryloyl groups in one and the same molecule is a compound represented by the following formula (A):

(A)

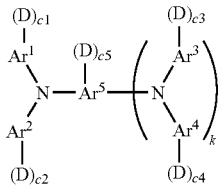

wherein each of $Ar^1$, $Ar^2$, $Ar^3$ and $Ar^4$ independently represents a substituted or unsubstituted aryl group; $Ar^5$ represents a substituted or unsubstituted aryl group or a substituted or unsubstituted arylene group; D represents $—(CH_2)_d—(O—CH_2—CH_2)_e—O—CO—C(CH_3)=CH_2$; each of c1, c2, c3, c4 and c5 independently represents 1 or 2; k represents 0 or 1; d represents an integer of 1 to 5; e represents 0 or 1; and the total number of D is 4 or more.

3. The electrophotographic photoreceptor according to claim 1, wherein the composition further contains a monomer or oligomer (b) not having a charge transportability that is reactive with the compound (a) having a triphenylamine structure and four or more methacryloyl groups in one and the same molecule.

4. The electrophotographic photoreceptor according to claim 1, wherein the composition further contains a polymer (c) that is not reactive with the compound (a) having a triphenylamine structure and four or more methacryloyl groups in one and the same molecule.

5. The electrophotographic photoreceptor according to claim 1, wherein the composition further contains a polymer (d) that is reactive with the compound (a) having a triphenylamine structure and four or more methacryloyl groups in one and the same molecule.

6. The electrophotographic photoreceptor according to claim 1, wherein the composition further contains compounds (e) that are reactive with the compound (a) having a triphenylamine structure and four or more methacryloyl groups in one and the same molecule, and all the compounds (e) have charge transportability.

7. The electrophotographic photoreceptor according to claim 1, wherein the cured film is formed by thermally curing the composition.

8. The electrophotographic photoreceptor according to claim 1, wherein the composition does not contain a polymerization initiator.

9. The electrophotographic photoreceptor according to claim 1, wherein the cured film is obtained by applying heat energy and light energy at the same time to harden the composition.

10. The electrophotographic photoreceptor according to claim 1, wherein the outermost layer further contains particles.

11. The electrophotographic photoreceptor according to claim 1, wherein the outermost layer is a protective layer.

12. The electrophotographic photoreceptor according to claim 1, wherein a resin contained in a lower layer contiguous to the outermost layer has a viscosity average molecular weight of 50,000 or more.

13. A method for manufacturing an electrophotographic photoreceptor comprising coating, on a surface to be coated, a coating solution comprising a composition containing at least one compound (a) having a triphenylamine structure and four or more methacryloyl groups in one and the same molecule to form a film, and heating and curing the film on at a condition temperature of from 100° C. or more andto 170° C. or less to obtain an outermost layer.

14. A method for manufacturing an electrophotographic photoreceptor comprising coating, on a surface to be coated, a coating solution comprising a composition containing at least one compound (a) having a triphenylamine structure and four or more methacryloyl groups in one and the same molecule, and not containing a polymerization initiator, to form a film, and heating and curing the film on at a condition temperature of from 100° C. or more andto 170° C. or less to obtain an outermost layer.

15. A processing cartridge attachable to or detachable from an image forming apparatus, that the cartridge comprising the electro-photographic photoreceptor according to claim 1, and at least one unit selected from the group consisting of a charging unit to charge the electrophotographic photoreceptor, a developing unit to develop an electrostatic latent image formed on the electrophotographic photoreceptor with a toner, and a toner-removaling unit to remove the toner remaining on the surface of the electrophotographic photoreceptor.

16. An image forming apparatus comprising the electrophotographic photoreceptor according to claim 1, a charging unit to charge the electrophotographic photoreceptor, an electrostatic latent image-forming unit to form an electrostatic latent image on the charged electrophotographic photoreceptor, a developing unit to develop the electrostatic latent image formed on the electrophotographic photoreceptor with a toner to form a toner image, and a transferring unit to transfer the toner image to an image-receiving medium.

* * * * *